US010617266B2

(12) United States Patent
Borke

(10) Patent No.: US 10,617,266 B2
(45) Date of Patent: Apr. 14, 2020

(54) HANDS-FREE SHEET PRODUCT DISPENSERS AND RELATED METHODS

(71) Applicant: GPCP IP Holdings LLC, Atlanta, GA (US)

(72) Inventor: Brian S. Borke, Appleton, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 443 days.

(21) Appl. No.: 15/389,208

(22) Filed: Dec. 22, 2016

(65) Prior Publication Data

US 2017/0188759 A1 Jul. 6, 2017

Related U.S. Application Data

(60) Provisional application No. 62/272,881, filed on Dec. 30, 2015.

(51) Int. Cl.
*A47K 10/36* (2006.01)

(52) U.S. Cl.
CPC .. *A47K 10/3618* (2013.01); *A47K 2010/3668* (2013.01)

(58) Field of Classification Search
CPC ..... A47K 10/3618; A47K 2010/3668
See application file for complete search history.

(56) References Cited

U.S. PATENT DOCUMENTS 2,266,958 A * 12/1941 Corbin ..... A47K 10/16 206/390
2,278,029 A * 3/1942 Walsh ..... A47K 10/3643 83/341
3,575,328 A * 4/1971 Jespersen ..... B65H 35/002 225/2
4,712,461 A 12/1987 Rasmussen
6,267,460 B1 * 7/2001 Gaide ..... A47K 10/28 312/34.11
6,412,679 B2 7/2002 Formon et al.
6,419,136 B2 7/2002 Formon et al.
6,742,689 B2 6/2004 Formon et al.
(Continued)

FOREIGN PATENT DOCUMENTS

JP 2004313442 A 11/2004

OTHER PUBLICATIONS

International Search Report and Written Opinion of the International Searching Authority for International Patent Application No. PCT/US2016/068385, dated Apr. 13, 2017.

*Primary Examiner* — William A. Rivera
(74) *Attorney, Agent, or Firm* — Eversheds Sutherland (US) LLP

(57) ABSTRACT

The present disclosure provides a sheet product dispenser for dispensing individual sheets from a roll of perforated sheet product. The sheet product dispenser may include a housing, a roll support disposed within the housing and configured to rotatably support the roll of perforated sheet product, and a mechanical dispensing mechanism disposed within the housing and configured to guide and advance the sheet product during a dispense cycle, wherein the mechanical dispensing mechanism is further configured to mechanically synchronize the dispense cycle with perforation lines of the sheet product. The present disclosure also provides a sheet product dispenser for dispensing individual sheets from a roll of sheet product that may be non-perforated.

27 Claims, 30 Drawing Sheets

(56) References Cited

U.S. PATENT DOCUMENTS

| | | | | |
|---|---|---|---|---|
| 6,745,927 | B2 | 6/2004 | Formon et al. | |
| 6,766,977 | B2 | 7/2004 | Denen et al. | |
| 6,830,210 | B2 | 12/2004 | Formon et al. | |
| 7,237,744 | B2 | 7/2007 | Morris et al. | |
| 7,341,170 | B2 | 3/2008 | Boone | |
| 7,347,134 | B2 | 3/2008 | Lewis et al. | |
| 7,845,593 | B2 | 12/2010 | Formon et al. | |
| 7,887,005 | B2 | 2/2011 | Troutman et al. | |
| 8,079,540 | B2 | 12/2011 | Troutman et al. | |
| 8,079,541 | B2 | 12/2011 | Troutman et al. | |
| 8,079,542 | B2 | 12/2011 | Troutman et al. | |
| 8,079,543 | B2 | 12/2011 | Troutman et al. | |
| 8,083,170 | B2 | 12/2011 | Troutman et al. | |
| 8,321,075 | B2 | 7/2012 | Troutman et al. | |
| 8,321,076 | B2 | 7/2012 | Troutman et al. | |
| 8,240,594 | B2 | 8/2012 | Troutman et al. | |
| 8,336,803 | B2 | 12/2012 | Troutman et al. | |
| 8,561,933 | B2 | 10/2013 | Troutman et al. | |
| 8,632,030 | B2 | 1/2014 | Troutman et al. | |
| 8,943,938 | B2 | 2/2015 | Sahlberg | |
| 9,282,855 | B2 * | 3/2016 | Troutman | A47K 10/36 |
| 9,480,370 | B2 | 11/2016 | Troutman et al. | |
| 2010/0089939 | A1 | 8/2010 | Morris et al. | |
| 2016/0287035 | A1 | 10/2016 | Troutman et al. | |
| 2017/0296004 | A1 * | 10/2017 | Borke | A47K 10/3618 |
| 2018/0325330 | A1 * | 11/2018 | Gottschalk | A47K 10/3643 |
| 2018/0325331 | A1 * | 11/2018 | Gottschalk | A47K 10/3656 |

* cited by examiner

HANDS-FREE SHEET PRODUCT DISPENSERS AND RELATED METHODS

CROSS-REFERENCE TO RELATED APPLICATIONS

This application claims the benefit of U.S. Provisional Application No. 62/272,881, filed on Dec. 30, 2015, which is incorporated herein by reference in its entirety.

FIELD OF THE DISCLOSURE

The present disclosure relates generally to sheet product dispensers and more particularly to hands-free sheet product dispensers and related methods for dispensing individual sheets from a roll of sheet product.

BACKGROUND OF THE DISCLOSURE

Various types of sheet product dispensers are known in the art, including dispensers configured to dispense individual sheets from a roll of sheet product disposed therein. Such dispensers may be mechanical in nature, requiring a user to manually impart a driving force to either the dispenser or the sheet product in order to carry out a dispense cycle. Alternatively, such dispensers may be automated in nature, including electronic dispensing mechanisms and control systems configured to carry out a dispense cycle without requiring a user to impart any driving force to the dispenser or the sheet product.

Certain dispensers, which may be mechanical or automated, may be referred to as "hands-free" dispensers, meaning that a user may obtain an individual sheet of sheet product from the dispenser without having to touch the dispenser itself. Such hands-free dispensers may be configured to dispense individual sheets from a roll of non-perforated sheet product. Alternatively, such hands-free dispensers may be configured to dispense individual sheets from a roll of perforated sheet product.

According to one configuration, a mechanical hands-free dispenser may be configured to present a "tail" portion (i.e., an exposed end portion) of a roll of non-perforated sheet product disposed within a housing of the dispenser. Specifically, the dispenser may be configured to present the tail portion extending from a dispenser outlet defined in the housing. The dispenser may include a mechanical cutting mechanism, such as a spring-loaded drum and a cutting knife, disposed within the housing and configured to perforate the sheet product during a dispense cycle. In use of the dispenser, a user may grasp and pull the tail portion to impart a driving force sufficient to advance the sheet product further out of the dispenser outlet and to actuate the mechanical cutting mechanism to perforate the sheet product, thereby defining an individual sheet to be separated by the user along a perforation line. In this manner, a length of the individual sheet obtained may be equal to a sum of a length of the tail portion (a "tail length") and a length over which the user pulls the tail portion (a "pull length"). Upon separation of the individual sheet, a new tail portion remains extending from the dispenser outlet for use in a subsequent dispense cycle. Although this configuration may provide adequate dispensing of sheet product in many applications, the dispenser may present certain drawbacks in other applications, including: a high pull force required to advance the sheet product and to actuate the mechanical cutting mechanism, a high paper strength required to withstand the required pull force, a large housing required to accommodate the mechanical cutting mechanism disposed therein, a limited range of variation of a ratio of the tail length to the pull length, a limited amount of energy that may be generated by the driving force imparted by the user during a dispense cycle, and challenges in reliably perforating the sheet product and presenting a tail portion, particularly in view of the limited amount of energy generated.

According to another configuration, an automated hands-free dispenser may be configured to present a tail portion of a roll of non-perforated sheet product disposed within a housing of the dispenser. Specifically, the dispenser may be configured to present the tail portion extending from a dispenser outlet defined in the housing, and the dispenser may include a tear bar positioned about the dispenser outlet. The dispenser also may include an electronic dispensing mechanism disposed within the housing and configured to guide the sheet product from the roll to the dispenser outlet during a dispense cycle. In use of the dispenser, a user may grasp and pull the tail portion against the tear bar to separate an individual sheet of sheet product from the roll. In this manner, a length of the individual sheet obtained may be equal to a length of the tail portion (a "tail length"). Upon separation of the individual sheet, the electronic dispensing mechanism may be activated to carry out a dispense cycle to advance the roll of sheet product and present a new tail portion extending from the dispenser outlet. Although this configuration may provide adequate dispensing of sheet product in many applications, the dispenser may present certain drawbacks in other applications, including: a high paper strength required to withstand the required dispensing forces generated by the electronic dispensing mechanism, a large housing required to accommodate the electronic dispensing mechanism disposed therein, a complexity of the electronic dispensing mechanism and associated control system, and challenges in reliably separating an individual sheet via the tear bar and presenting a tail portion.

According to another configuration, a mechanical hands-free dispenser may be configured to present a tail portion of a roll of perforated sheet product disposed within a housing of the dispenser. Specifically, the dispenser may be configured to present the tail portion extending from a dispenser outlet defined in the housing such that a leading perforation line (i.e., a perforation line closest to the tail portion and defining a leading individual sheet) is disposed within the housing. The dispenser may include a mechanical dispensing mechanism, such as one or more rollers, disposed within the housing and configured to guide the sheet product from the roll to the dispenser outlet during a dispense cycle. In use of the dispenser, a user may grasp and pull the tail portion to impart a driving force sufficient to advance the sheet product through the mechanical dispensing mechanism and further out of the dispenser outlet. The user continues to pull the tail portion until the leading perforation line is disposed outside of the housing, at which point tension applied along the perforation line, due to friction between a next individual sheet and the mechanical dispensing mechanism, is sufficient to separate the leading individual sheet. In this manner, a length of the individual sheet obtained may be equal to a sum of a length of the tail portion (a "tail length") and a length over which the user pulls the tail portion (a "pull length"). Upon separation of the leading individual sheet, a new tail portion remains extending from the dispenser outlet for use in a subsequent dispense cycle. Although this configuration may provide adequate dispensing of sheet product in many applications, the dispenser may present certain drawbacks in other applications, including: a high pull force required to advance the sheet product through the mechanical dispensing mechanism, a high paper strength required to withstand the required pull force, a limited range of variation of a ratio of the tail length to the pull length, a limited amount of energy that may be generated by the driving force imparted by the user during a dispense cycle, and challenges in reliably separating the leading individual sheet with the leading perforation line disposed outside of the housing and presenting a tail portion, particularly in view of the limited amount of energy generated.

There is thus a desire for improved hands-free sheet product dispensers and related methods for dispensing individual sheets from a roll of sheet product to address one or more of the potential drawbacks discussed above.

SUMMARY OF THE DISCLOSURE

In one aspect, the present disclosure provides a sheet product dispenser for dispensing individual sheets from a roll of perforated sheet product. The sheet product dispenser may include a housing, a roll support disposed within the housing and configured to rotatably support the roll of perforated sheet product, and a mechanical dispensing mechanism disposed within the housing and configured to guide and advance the sheet product during a dispense cycle, wherein the mechanical dispensing mechanism is further configured to mechanically synchronize the dispense cycle with perforation lines of the sheet product.

In another aspect, the present disclosure provides a sheet product dispenser for dispensing individual sheets from a roll of non-perforated sheet product. The sheet product dispenser may include a housing, a roll support disposed within the housing and configured to rotatably support the roll of non-perforated sheet product, and a mechanical dispensing mechanism disposed within the housing and configured to guide and advance the sheet product during a dispense cycle. The mechanical dispensing mechanism may include a first drive roller rotatably supported by the housing and configured to engage and grip the sheet product throughout the dispense cycle, a second drive roller rotatably supported by the housing and configured to engage and grip the sheet product throughout the dispense cycle, and a plurality of gears configured to drive the second drive roller at a varying rate during the dispense cycle.

In still another aspect, the present disclosure provides a sheet product dispenser for dispensing individual sheets from a roll of sheet product. The sheet product dispenser may include a housing, a roll support disposed within the housing and configured to rotatably support the roll of sheet product, and a mechanical dispensing mechanism disposed within the housing and configured to guide and advance the sheet product during a dispense cycle. The mechanical dispensing mechanism may include a drum rotatably supported by the housing and configured to engage and grip the sheet product throughout the dispense cycle, a cutting knife movably coupled to the drum and configured to move between a retracted position and an extended position, and a cam rotatably supported by the housing and configured to control movement of the cutting knife between the retracted position and the extended position.

In another aspect, the present disclosure provides a sheet product dispenser for dispensing individual sheets from a roll of sheet product. The sheet product dispenser may include a housing, a roll support disposed within the housing and configured to rotatably support the roll of sheet product, and a mechanical dispensing mechanism disposed within the housing and configured to guide and advance the sheet product during a dispense cycle. The mechanical dispensing mechanism may include a drum rotatably supported by the housing and configured to engage and grip the sheet product throughout the dispense cycle, a plurality of non-circular gears, and a tail spring coupled to the housing and one of the plurality of non-circular gears. The tail spring may be configured to extend and store energy during a portion of the dispense cycle and to retract and release energy during another portion of the dispense cycle.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating example embodiments of the disclosure, in which the use of the same reference numerals indicates similar or identical items. Certain embodiments may include elements and/or components other than those illustrated in the drawings, and some elements and/or components may not be present in certain embodiments.

DETAILED DESCRIPTION

Figure 1:
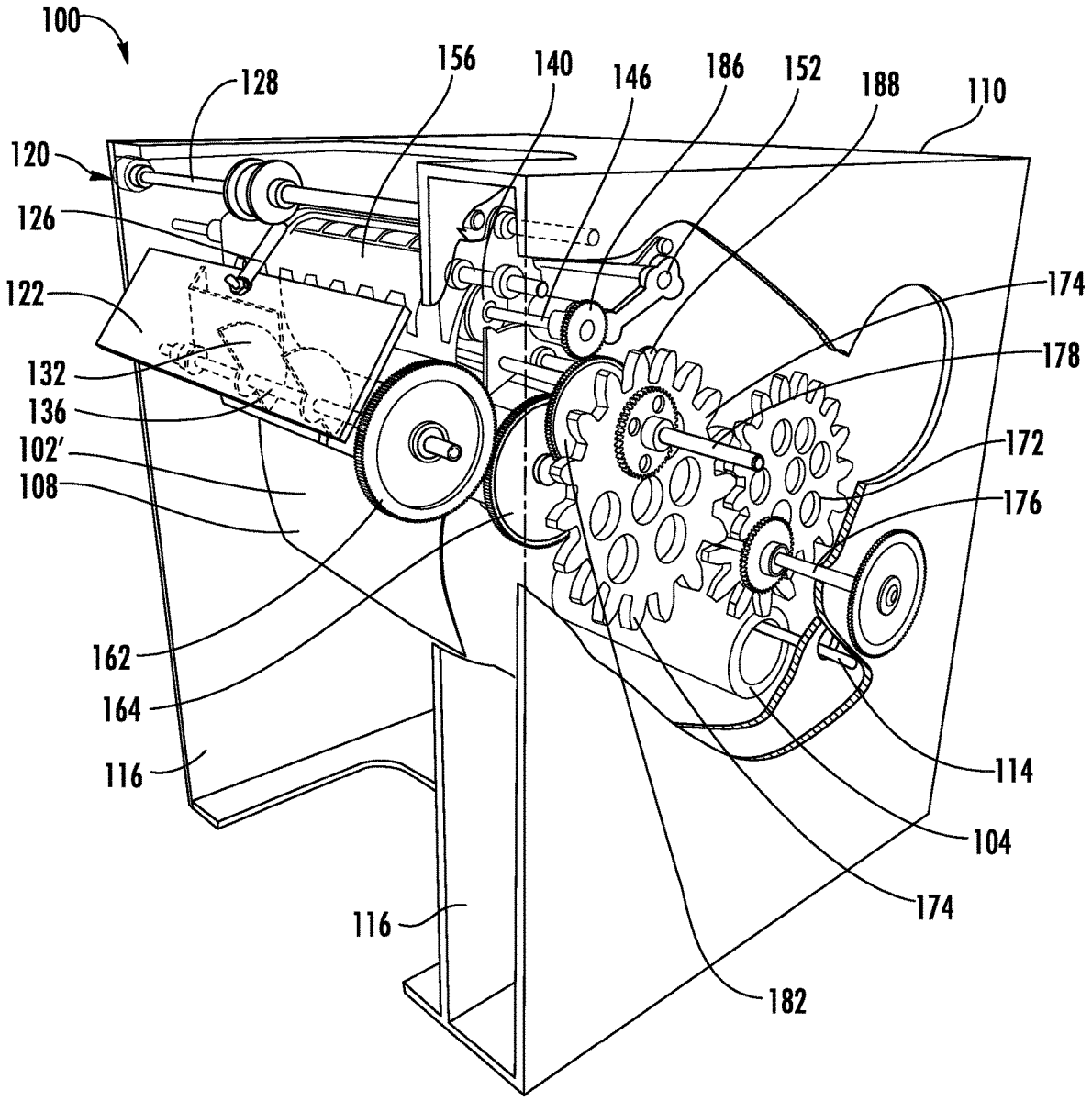
FIG. 1 is a perspective view of an example mechanical hands-free sheet product dispenser in accordance with one or more embodiments of the disclosure.

The present disclosure includes example embodiments of hands-free sheet product dispensers and related methods for dispensing individual sheets from a roll of sheet product to address one or more of the potential drawbacks discussed above. Reference is made herein to the accompanying drawings illustrating the example embodiments of the disclosure, in which the use of the same reference numerals indicates similar or identical items. Throughout the disclosure, depending on the context, singular and plural terminology may be used interchangeably.

As used herein, the term "sheet products" is inclusive of natural and/or synthetic cloth or paper sheets. Sheet products may include both woven and non-woven articles. There are a wide variety of non-woven processes for forming sheet products, which can be either wetlaid or drylaid. Examples of non-woven processes include, but are not limited to, hydroentangled (sometimes called "spunlace"), double recreped (DRC), airlaid, spunbond, carded, paper towel, and melt-blown processes. Further, sheet products may contain fibrous cellulosic materials that may be derived from natural sources, such as wood pulp fibers, as well as other fibrous material characterized by having hydroxyl groups. Examples of sheet products include, but are not limited to, wipers, napkins, tissues, towels, or other fibrous, film, polymer, or filamentary products.

As used herein, the term "non-circular gears" (NCGs) is inclusive of any gear that does not have a circular shape and thus does not have a constant gear ratio. Examples of non-circular gears include, but are not limited to, gears having an elliptical, square, rectangular, triangular, trapezoidal, or other regular or irregular shape that is non-circular. According to its shape and corresponding varying gear ratio, a non-circular gear may be used to vary a rate at which a mating gear or other component is driven throughout a rotation of the non-circular gear. Further, according to its shape and corresponding varying gear ratio, a non-circular gear may be used to vary a torque generated by the non-circular gear throughout a rotation thereof.

FIG. 1 shows a perspective view of an example mechanical hands-free sheet product dispenser 100 in accordance with one or more embodiments of the disclosure. FIGS. 2A-2E show side views of a portion of the dispenser 100 in different states during a dispense cycle. The dispenser 100 may be configured to dispense individual sheets 102 from a roll 104 of perforated sheet product. The roll 104 of perforated sheet product may be formed in a conventional manner, whereby the individual sheets 102 are at least partially defined by perforation lines 106 or other predefined lines of weakness extending between adjacent sheets 102. In this manner, the perforation lines 106 may be configured to facilitate separation of the sheets 102 from one another during use of the dispenser 100.

As is described in detail herein below, the dispenser 100 may be configured to present a tail portion 108 (i.e., an exposed end portion) of the roll 104 to be grasped and pulled by a user during a dispense cycle. Specifically, as is shown, the tail portion 108 may be a leading end portion of a leading individual sheet 102' to be dispensed during a dispense cycle. A leading perforation line 106' (i.e. the perforation line closest to the tail portion 108 and at least partially defining the leading individual sheet 102') may extend between the leading individual sheet 102' and a next individual sheet 102". It will be understood that the terms "leading" and "next" are used herein for the purpose of describing relevant portions of the roll 104 of sheet product prior to and during a given dispense cycle, and that these terms are adjusted when describing relevant portions prior to and during a subsequent dispense cycle. In this manner, upon completion of a first dispense cycle for dispensing the leading individual sheet 102', the next individual sheet 102" for the first dispense cycle becomes the leading individual sheet 102' for a second dispense cycle.

As is shown, the dispenser 100 may include a housing 110, and the roll 104 of perforated sheet product may be disposed within the housing 110 for dispensing the individual sheets 102 therefrom. The roll 104 may be rotatably supported within the housing 110 by a roll support, such as a roll shaft 114 attached to opposing side walls 116 of the housing 110. In some embodiments, the housing 110 may include a dispenser outlet (not shown) defined in a wall thereof, such as a front wall or a bottom wall of the housing. The dispenser 100 may be configured to present the tail portion 108 extending from the dispenser outlet and out of the housing 110 to be grasped and pulled by a user.

The dispenser 100 also may include a mechanical dispensing mechanism 120 disposed within the housing 110 and configured to guide and advance the sheet product from the roll 104 during a dispense cycle. The mechanical dispensing mechanism 120 may include a carriage 122 configured to move with respect to the housing 110 during a dispense cycle. As is described in detail below, the carriage 122 may be configured to move downward with respect to the housing 110 during a portion of the dispense cycle and to move upward with respect to the housing 110 during another portion of the dispense cycle. In some embodiments, the carriage 122 may be pivotally attached to the housing 110 and configured to pivot downward and upward with respect to the housing 110. For example, a rear end of the carriage 122 may be pivotally attached to the side walls 116 of the housing 110 via a pair of link arms 124. The mechanical dispensing mechanism 120 also may include a return spring 126 fixedly attached to a front end of the carriage 122 and configured to bias the carriage 122 to move upward with respect to the housing 110. As is shown, the return spring 126 may be attached to the housing 110 by a spring support, such as a spring shaft 128 attached to the side walls 116 of the housing 110.

The mechanical dispensing mechanism 120 further may include a number of rollers configured to guide and advance the sheet product from the roll 104 during a dispense cycle as a user grasps and pulls the tail portion 108 to impart a driving force thereto. Specifically, the number of rollers may include first and second crescent rollers 132, 134 attached to the carriage 122 and configured to receive the sheet product therebetween. The crescent rollers 132, 134 may be configured to engage and grip the sheet product during a portion of the dispense cycle and to disengage the sheet product during another portion of the dispense cycle. As is shown, the crescent rollers 132, 134 may be respectively positioned about and coupled to first and second crescent roller axles 136, 138 supported by the carriage 122 and allowing the crescent rollers 132, 134 to rotate with respect to the carriage 122. The number of rollers also may include first and second drive rollers 140, 142 and a pinch roller 144 attached to the housing 110 and configured to receive the sheet product therebetween. The drive rollers 140, 142 and the pinch roller 144 may be configured to engage and grip the sheet product during a portion of the dispense cycle and to engage but release grip of the sheet product during another portion of the dispense cycle. As is shown, the drive rollers 140, 142 may be respectively positioned about and coupled to first and second drive roller axles 146, 148 supported by the side walls 116 of the housing 110 and allowing the drive rollers 140, 142 to rotate with respect to the housing 110. The pinch roller 144 similarly may be positioned about and coupled to a pinch roller axle 150 supported by the housing 110 via a pinch roller arm 152 and allowing the pinch roller 144 to rotate with respect to the housing 110. As is shown, the mechanical dispensing mechanism 120 also may include a sheet product guide 156 disposed above the first drive roller 140 and configured to guide the sheet product downward toward the crescent rollers 132, 134.

The mechanical dispensing mechanism 120 further may include a number of gears configured to drive the drive rollers 140, 142 at a varying rate during a dispense cycle, as is described in detail below. Specifically, the number of gears may include first and second crescent roller gears 162, 164 respectively positioned about and coupled to the crescent roller axles 136, 138 supported by the carriage 122 and allowing the crescent roller gears 162, 164 to rotate with respect to the carriage 122. As is shown, the crescent roller gears 162, 164 may be circular gears that engage one another throughout the dispense cycle. The number of gears also may include a first transfer gear 166 positioned about and coupled to a first transfer gear axle 168 supported by the carriage 122 and allowing the first transfer gear 166 to rotate with respect to the carriage 122. As is shown, the first transfer gear 166 may be a circular gear that engages the second crescent roller gear 164 throughout the dispense cycle.

The number of gears also may include first and second non-circular gears 172, 174 respectively positioned about and coupled to first and second non-circular gear axles 176, 178 supported by the housing 110 and allowing the non-circular gears 172, 174 to rotate with respect to the housing 110. As is shown, the non-circular gears 172, 174 may be elliptical gears that engage one another throughout the dispense cycle. The number of gears also may include a second transfer gear 180 positioned about and coupled to the first non-circular gear axle 176 supported by the housing 110 and allowing the second transfer gear 180 to rotate with respect to the housing 110. As is shown, the second transfer gear 180 may be a circular gear that engages the first transfer gear 166 throughout the dispense cycle. The number of gears also may include a third transfer gear 182 positioned about and coupled to the second non-circular gear axle 178 supported by the housing 110 and allowing the third transfer gear 182 to rotate with respect to the housing 110. As is shown, the third transfer gear 182 may be a circular gear.

The number of gears also may include first and second drive roller gears 186, 188 respectively positioned about and coupled to the drive roller axles 146, 148 supported by the housing 110 and allowing the drive roller gears 186, 188 to rotate with respect to the housing 110. As is shown, the drive roller gears 186, 188 may be circular gears that each engage the third transfer gear 182 throughout the dispense cycle. Ultimately, the number of gears may be configured to interact with one another to drive the drive rollers 140, 142 at a varying rate throughout a dispense cycle as a user grasps and pulls the tail portion 108 to impart a driving force to the sheet product.

Figure 2A:
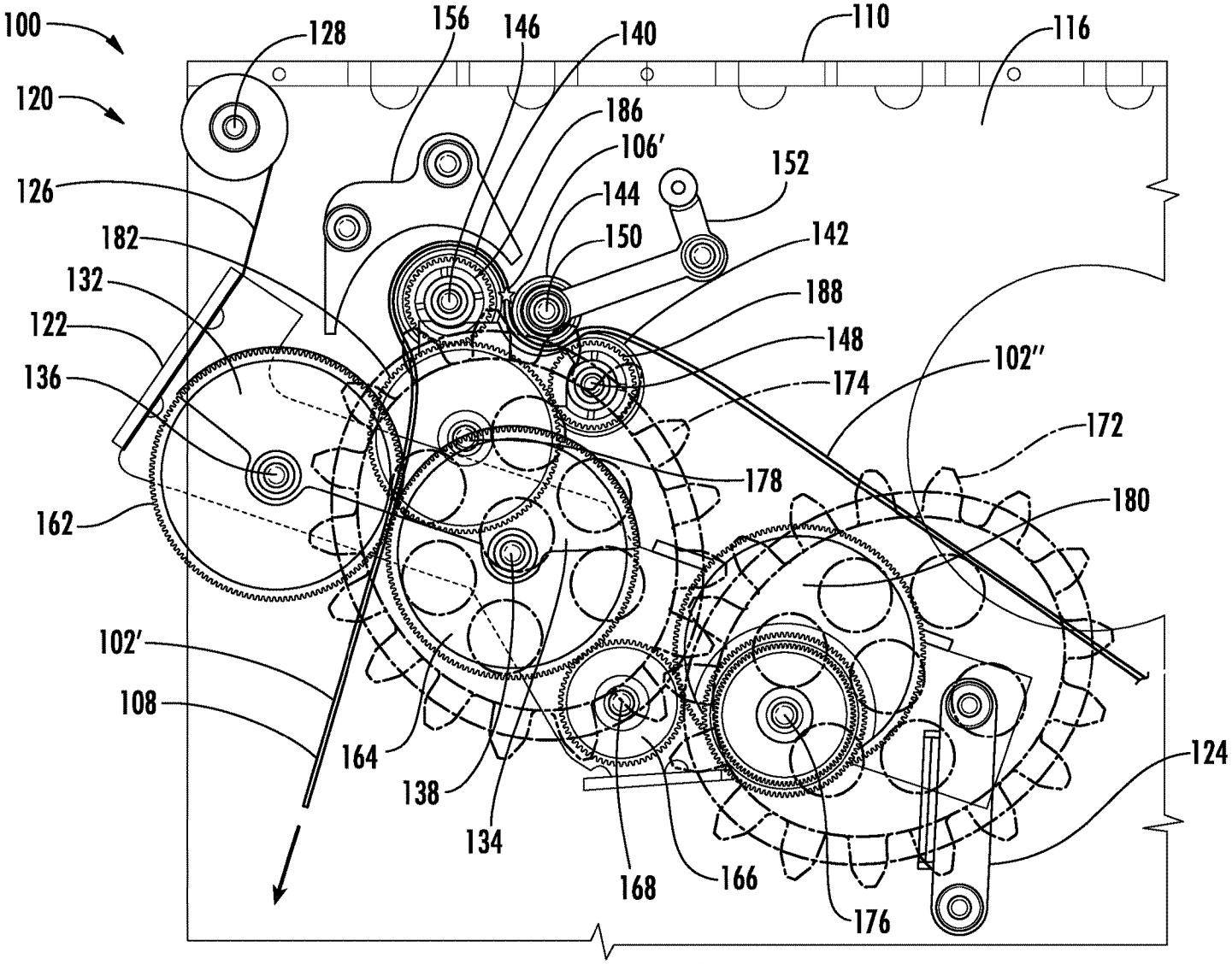
FIG. 2A is a side view of a portion of the example mechanical hands-free sheet product dispenser of FIG. 1, showing a mechanical dispensing mechanism in a first state during a dispense cycle.

FIGS. 2A-2E show side views of the mechanical dispensing mechanism 120 in a number of different states during a dispense cycle as may be carried out using the dispenser 100. FIG. 2A shows the mechanical dispensing mechanism 120 in a first state of the dispense cycle, in which the tail portion 108 (the leading end portion of the leading sheet 102') is presented and available to be grasped and pulled by a user. In the first state, the carriage 122 is maintained in an upward position by the return spring 126, which is in a retracted position. The crescent rollers 132, 134 are engaging and gripping a portion of the leading sheet 102' received therebetween, while the first drive roller 140 is engaging and gripping another portion of the leading sheet 102' disposed thereover. As is shown, in the first state, the leading perforation line 106' is disposed along the rear side of the first drive roller 140 approximately between the first drive roller 140 and the pinch roller 144, such that the second drive roller 142 and the pinch roller 144 are engaging and gripping a portion of the next sheet 102".

The user pulls the tail portion 108 downward to impart a driving force to the sheet product to carry out the dispense cycle. As the user initially pulls the tail portion 108 downward, the crescent rollers 132, 134 continue to grip a portion of the leading sheet 102' received therebetween, which causes the crescent rollers 132, 134 to rotate (clockwise and counter-clockwise, respectively, in the side views shown) along with the crescent roller axles 136, 138 and also causes the carriage 122 to move downward with respect to the housing 110. The downward movement of the carriage 122 causes the return spring 126 to extend downward and store energy. The rotation of the crescent roller axles 136, 138 causes the crescent roller gears 162, 164 to rotate (clockwise and counter-clockwise, respectively), which causes the first transfer gear 166 to rotate (clockwise). The rotation of the first transfer gear 166 causes the second transfer gear 180 to rotate (counter-clockwise) along with the first non-circular gear axle 176, which causes the first non-circular gear 172 to rotate (counter-clockwise). The rotation of the first non-circular gear 172 causes the second non-circular gear 174 to rotate (clockwise) along with the second non-circular gear axle 178, which causes the third transfer gear 182 to rotate (clockwise). The rotation of the third transfer gear 182 causes the drive roller gears 186, 188 to rotate (both counter-clockwise) along with the drive roller axles 146, 148, which causes the drive rollers 140, 142 to rotate (both counter-clockwise). In this manner, initial pulling of the tail portion 108 downward causes the crescent rollers 132, 134 to rotate (clockwise and counter-clockwise, respectively), which ultimately causes the drive rollers 140, 142 to rotate (both counter-clockwise) in a dispensing direction of the leading sheet 102'.

As discussed above, by their nature, the non-circular gears 172, 174 have a varying gear ratio, which is dependent upon the orientation of the non-circular gears 172, 174 throughout a rotation thereof. Accordingly, an output of the non-circular gears 172, 174 to the drive rollers 140, 142 (via the second non-circular gear axle 178, the third transfer gear 182, the drive roller gears 186, 188, and the drive roller axles 146, 148) varies throughout the dispense cycle, and thus the non-circular gears 172, 174 drive the drive rollers 140, 142 at a varying rate throughout the dispense cycle. In the first state of the dispense cycle, the non-circular gears 172, 174 are in an orientation in which the output to the drive rollers 140, 142 is very slow compared to the input from the initial pulling of the tail portion 108 and the downward movement of the carriage 122. Accordingly, as the user initially pulls the tail portion 108, the contact surfaces of the drive rollers 140, 142 rotate at a slower rate than the tail portion 108 is pulled. In the first state, the crescent rollers 132, 134 grip the leading individual sheet 102', and the second drive roller 142 and the pinch roller 144 grip the next individual sheet 102". Because the second drive roller 142 is rotating at a slower rate than the crescent rollers 132, 134 advance, there is tension in the portions of the leading individual sheet 102' and the next individual sheet 102" between the crescent rollers 132, 134 and the second drive roller 142. This tension causes the first drive roller 140 to grip the leading individual sheet 102'. In the first state, the crescent rollers 132, 134 grip the sheet product harder than the first drive roller 140, the second drive roller 142, and the pinch roller 144 grip the sheet product, and thus the sheet product skids between the second drive roller 142 and the pinch roller 144 and over the first drive roller 140 (i.e. the first drive roller 140, the second drive roller 142, and the pinch roller 144 release grip of the sheet product) as the user initially pulls the tail portion 108. Because the leading perforation line 106' is disposed along the rear side of the first drive roller 140, the leading perforation line 106' generally is not exposed to the full tension generated in the leading sheet 102' as the user pulls the tail portion 108 and the crescent rollers 132, 134 grip the leading sheet 102'.

Figure 2B:
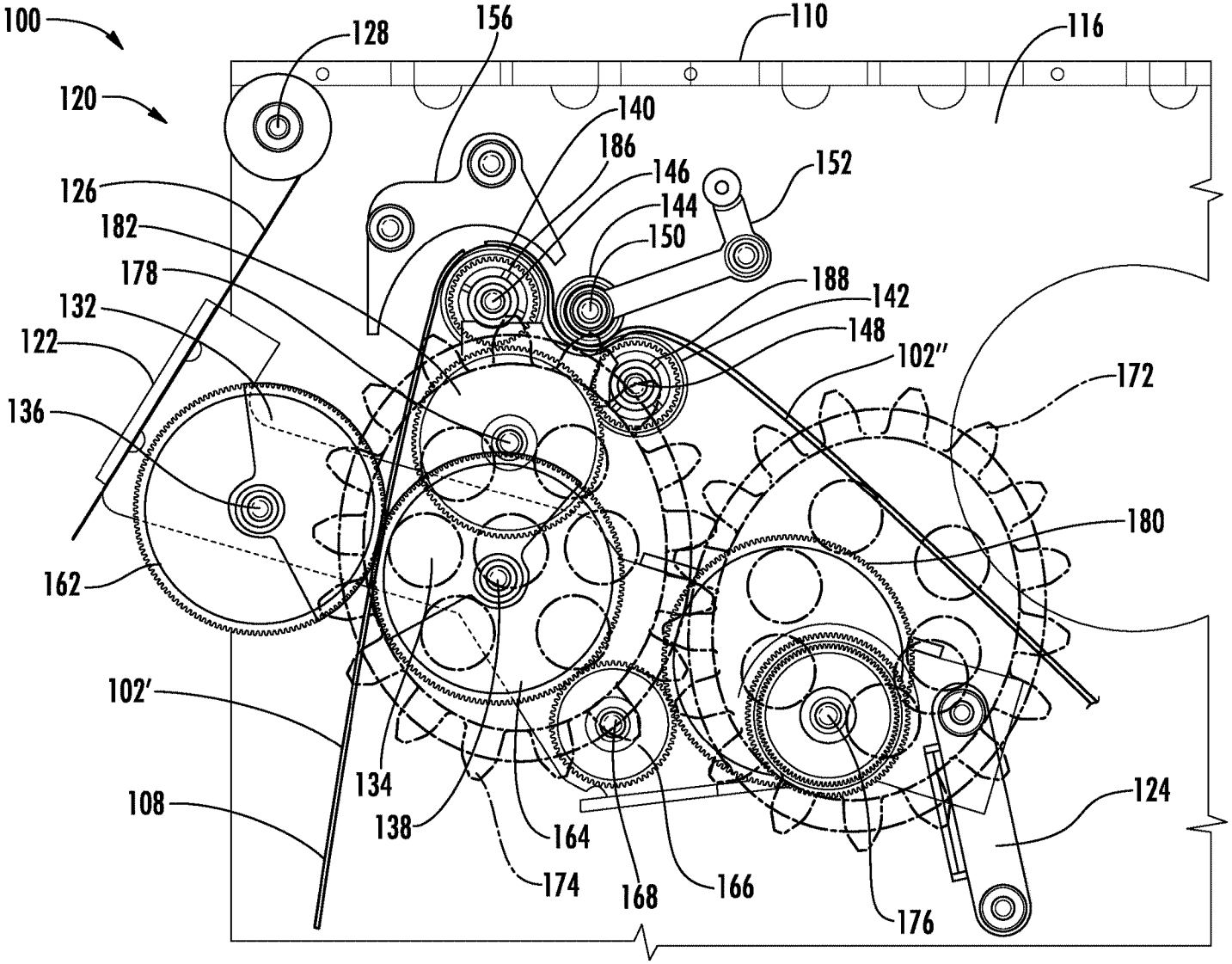
FIG. 2B is a side view of a portion of the example mechanical hands-free sheet product dispenser of FIG. 1, showing the mechanical dispensing mechanism in a second state during the dispense cycle.

FIG. 2B shows the mechanical dispensing mechanism 120 in a second state of the dispense cycle, following initial pulling of the tail portion 108 and skidding of the sheet product until the leading perforation line 106' advances over the top of the first drive roller 140. Because the leading perforation line 106' is disposed far enough along the front side of the first drive roller 140, the leading perforation line 106' is exposed to most of the tension generated in the leading sheet 102' as the user continues to pull the tail portion 108 and the crescent rollers 132, 134 continue to grip the leading sheet 102'. Ultimately, the leading perforation line 106' is exposed to enough tension to separate the leading sheet 102' from the next sheet 102" along the leading perforation line 106', as is shown. Upon separation of the leading sheet 102', the next sheet 102" no longer skids between the second drive roller 142 and the pinch roller 144 as the user continues to pull the tail portion 108. Instead, the second drive roller 142 and the pinch roller 144 grip and advance the next sheet 102" relatively slowly, according to the rotation of the second drive roller gear 188 as determined by the gear ratio of the non-circular gears 172, 174. Meanwhile, the crescent rollers 132, 134 continue to grip the leading sheet 102' and rotate, the carriage 122 continues to move downward, and the return spring 126 continues to extend downward and store more energy. The rotation of the crescent rollers 132, 134 causes the various gears of the mechanical dispensing mechanism 120 to continue to rotate as described above.

Figure 2C:
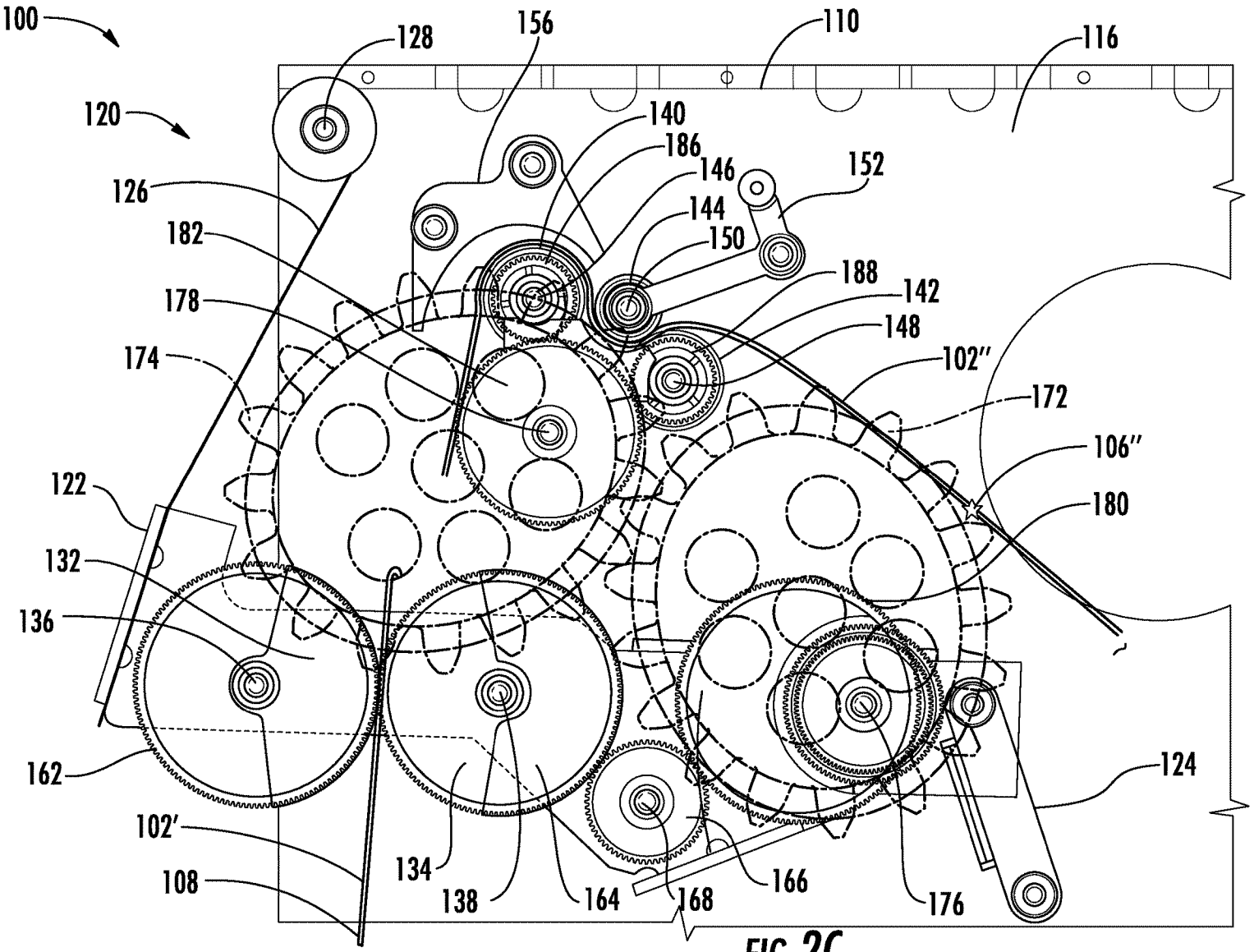
FIG. 2C is a side view of a portion of the example mechanical hands-free sheet product dispenser of FIG. 1, showing the mechanical dispensing mechanism in a third state during the dispense cycle.

FIG. 2C shows the mechanical dispensing mechanism 120 in a third state of the dispense cycle, following continued pulling of the tail portion 108 downward by the user. The crescent rollers 132, 134 continue to grip the leading sheet 102' and rotate, the carriage 122 continues to move downward, and the return spring 126 continues to extend downward and store more energy. The rotation of the crescent rollers 132, 134 causes the various gears of the mechanical dispensing mechanism 120 to continue to rotate as described above. In the third state of the dispense cycle, the non-circular gears 172, 174 are in an orientation in which the output to the drive rollers 140, 142 is very fast compared to the input from the pulling of the tail portion 108 and the downward movement of the carriage 122. Accordingly, as the user continues to pull the tail portion 108, the contact surfaces of the drive rollers 140, 142 rotate and advance the next sheet 102" at a faster rate than the tail portion 108 is pulled. As the next sheet 102" is advanced, the next perforation line 106" approaches but does not yet contact the second drive roller 142.

Figure 2D:
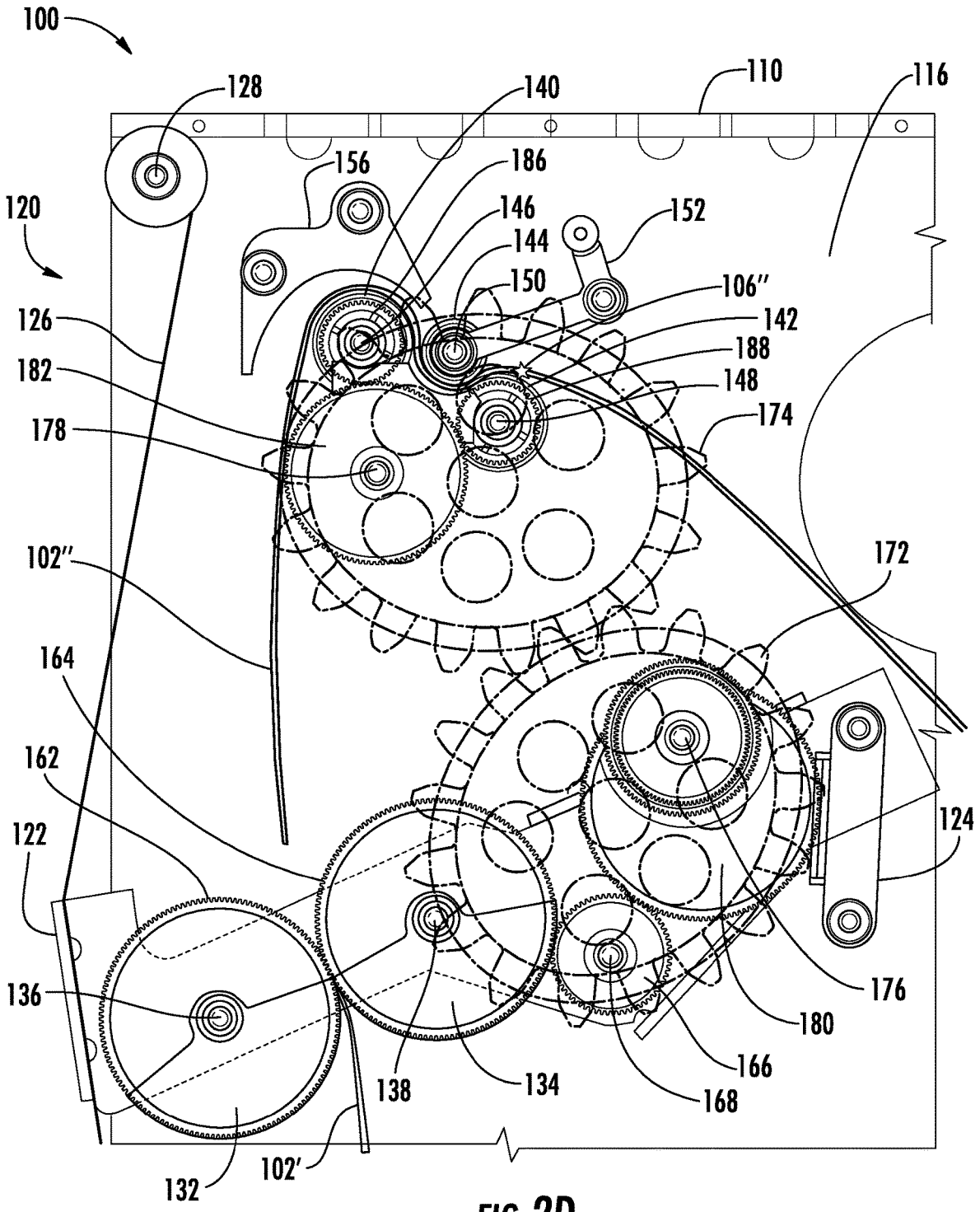
FIG. 2D is a side view of a portion of the example mechanical hands-free sheet product dispenser of FIG. 1, showing the mechanical dispensing mechanism in a fourth state during the dispense cycle.

FIG. 2D shows the mechanical dispensing mechanism 120 in a fourth state of the dispense cycle, following continued pulling of the tail portion 108 downward by the user. In the fourth state, the crescent rollers 132, 134 disengage and release grip of the leading sheet 102', allowing the user to take the leading sheet 102'. Meanwhile, the return spring 126 begins to pull the carriage 122 upward with respect to the housing 110 as the return spring 126 retracts and releases the energy stored during downward movement of the carriage 122. The upward movement of the carriage 122 causes the various gears of the mechanical dispensing mechanism 120 to continue to rotate as described above. Accordingly, the drive rollers 140, 142 continue to rotate and advance the next sheet 102" as the carriage 122 continues to move upward. In the fourth state of the dispense cycle, the next perforation line 106" contacts the second drive roller 142, as is shown.

Figure 2E:
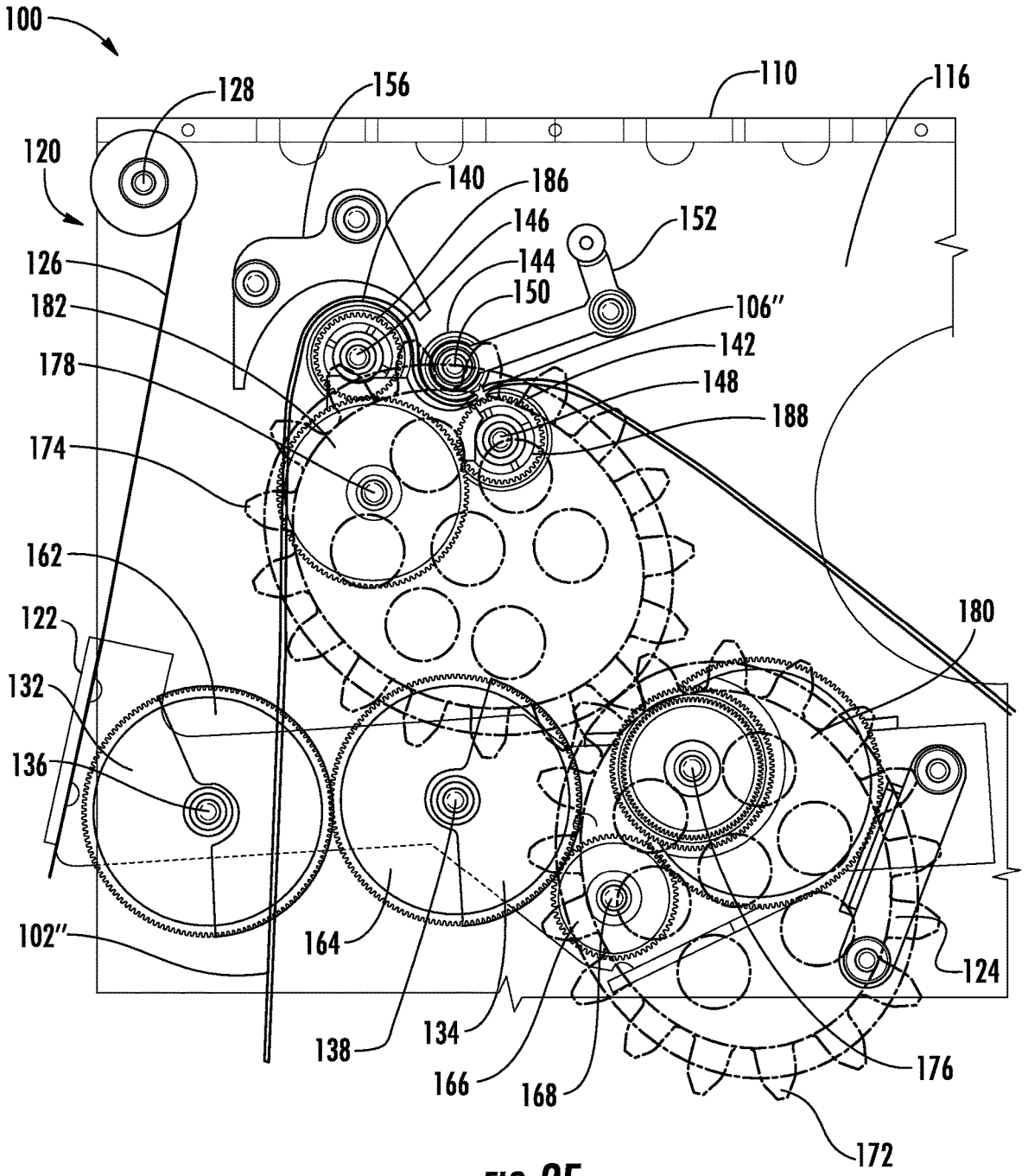
FIG. 2E is a side view of a portion of the example mechanical hands-free sheet product dispenser of FIG. 1, showing the mechanical dispensing mechanism in a fifth state during the dispense cycle.

FIG. 2E shows the mechanical dispensing mechanism 120 in a fifth state of the dispense cycle, following continued upward movement of the carriage 122 as the return spring 126 continues to retract and release the stored energy. In the fifth state, the crescent rollers 132, 134 are in an open orientation, and a leading end portion of the next sheet 102" extends freely through a gap defined between the crescent rollers 132, 134, as is shown. In this manner, the crescent rollers 132, 134 do not engage or grip the next sheet 102". The continued upward movement of the carriage 122 causes the various gears of the mechanical dispensing mechanism 120 to continue to rotate as described above. In the fifth state of the dispense cycle, the non-circular gears 172, 174 are in an orientation in which the output to the drive rollers 140, 142 is very slow compared to the input from the upward movement of the carriage 122. Accordingly, as the return spring 126 continues to pull the carriage 122 upward, the contact surfaces of the drive rollers 140, 142 rotate and advance the next sheet 102" at a slower rate than the carriage 122 is pulled. In this manner, the energy stored in the return spring 126 is used almost entirely to move the carriage 122 upward and reveal the leading end portion of the next sheet 102" that is already extended. Notably, the return spring 126 has a very high mechanical advantage to overcome any resistance that the roll 104 may present while unwinding. In the fifth state of the dispense cycle, the next perforation line 106" is disposed approximately between the second drive roller 142 and the pinch roller 144, as is shown. Following continued upward movement of the carriage 122 as the return spring 126 continues to retract and release the stored energy, the mechanical dispensing mechanism 120 returns to the first state, as is shown in FIG. 2A, and is ready to begin a subsequent dispense cycle.

The dispenser 100 may be configured to mechanically synchronize a dispense cycle with the perforation lines 106 of the roll 104 of sheet product. Specifically, the mechanical dispensing mechanism 120 may be configured to mechanically synchronize a dispense cycle with a leading perforation line 106' (a next perforation line 106" of a previous dispense cycle) that advanced too far during the previous dispense cycle (i.e., a leading perforation line 106' that is advanced further than the leading perforation line 106' shown in FIG. 2A). The mechanical dispensing mechanism 120 also may be configured to mechanically synchronize a dispense cycle with a leading perforation line 106' (a next perforation line 106" of a previous dispense cycle) that did not advance far enough during the previous dispense cycle (i.e., a leading perforation line 106' that is not advanced as far as the leading perforation line 106' shown in FIG. 2A).

Mechanical synchronization may occur between the first state and the second state of the dispense cycle. As described above, when a user initially pulls the tail portion 108, the crescent rollers 132, 134 grip the sheet product while the sheet product skids over the first drive roller 140. In this manner, the sheet product moves at a higher speed when skidding over the first drive roller 140 and moves at a lower speed when being driven by the drive rollers 140, 142. If, for some reason, a leading perforation line 106' advanced too far during a previous dispense cycle, when a user pulls the tail portion 108 to initiate a new dispense cycle, the sheet product would not skid at the higher speed over the first drive roller 140 for very long (if at all) before the leading perforation line 106' would be exposed to enough tension to separate the leading sheet 102' from the next sheet 102", after which the next sheet 102" would be driven by the drive rollers 140, 142 at the lower speed. Accordingly, the next sheet 102" would spend a shorter amount of time at the higher speed and would travel a shorter distance than during a typical dispense cycle, thereby compensating for having been advanced too far during a previous dispense cycle. If, for some reason, a leading perforation line 106' did not advance far enough during a previous dispense cycle, when a user pulls the tail portion 108 to initiate a new dispense cycle, the sheet product would skid at the higher speed over the first drive roller 140 for longer before the leading perforation line 106' would be exposed to enough tension to separate the leading sheet 102' from the next sheet 102", after which the next sheet 102" would be driven by the drive rollers 140, 142 at the lower speed. Accordingly, the next sheet 102" would spend a longer amount of time at the higher speed and would travel a longer distance than during a typical dispense cycle, thereby compensating for not having advanced far enough during a previous dispense cycle. In this manner, the mechanical dispensing mechanism 120, and thus the overall dispenser 100, may compensate and synchronize a dispense cycle with the perforation lines 106 of the roll 104 of sheet product.

The dispenser 100 may be configured to dispense individual sheets 102 having a predetermined sheet length (i.e., the roll 104 has a predetermined distance between adjacent perforation lines 106), which may depend on the type of sheet product dispensed. For example, the dispenser 100 may be configured to dispense individual sheets 102 of paper towels having a predetermined sheet length of 8.5 inches. Based on the configuration and operation of the mechanical dispensing mechanism 120, specifically the movement of the carriage 122 and the skidding of the sheet product during a dispense cycle, the sheet length may be less than a sum of a length of the tail portion 108 (a "tail length") and a length over which a user pulls the tail portion (a "pull length") during the dispense cycle. For example, the dispenser 100 may be configured to dispense individual sheets 102 having a sheet length of 8.5 inches, wherein the tail length is 4.25 inches and the pull length is 7.25 inches. In contrast, as described above, known mechanical hands-free dispensers generally are configured to dispense individual sheets having a sheet length that is equal to a sum of the tail length and the pull length. For example, known mechanical hands-free dispensers configured to dispense individual sheets having a sheet length of 8.5 inches and to present a tail portion having a tail length of 4.25 inches would require a pull length of 4.25 inches. Ultimately, as compared to known dispensers, the dispenser 100 may allow a lower pull force (i.e., a driving force imparted by a user) required for a given sheet length and tail length, due to the greater pull length required. Additionally, as compared to known dispensers, the dispenser 100 may allow a lower paper strength required for a given sheet length and tail length, due to the lower pull force allowed. Further, as compared to known dispensers, the dispenser 100 may generate a greater amount of energy from a given pull force, due to the greater pull length required, which may provide greater reliability in presenting a tail portion.

The dispenser 100 also may be configured to mechanically "lockout" (i.e., prevent dispensing of) a roll 104 of sheet product including individual sheets 102 having a sheet length outside of a predetermined range. For example, the dispenser 100 may be configured to mechanically lockout a roll 104 of sheet product including individual sheets 102 having a sheet length outside of a predetermined range of 8.25 to 8.75 inches. As described above, proper operation of the mechanical dispensing mechanism 120 requires the perforation lines 106 to be disposed generally at certain positions relative to the various rollers and gears at certain portions of a dispense cycle. Attempting to dispense a roll 104 of sheet product including individual sheets 102 having a sheet length outside of a predetermined range would cause the perforation lines 106 to be disposed at incorrect positions relative to the various rollers and gears at certain portions of a dispense cycle. As also described above, the mechanical dispensing mechanism 120 is configured to provide a certain degree of skidding of the sheet product over the first drive roller 140 during an initial portion of a dispense cycle. Specifically, the mechanical dispensing mechanism 120 is configured such that a length of rotation of the contact surface of the first drive roller 140 (a "rotation length") during the dispense cycle is less than the individual sheet length, which causes the skidding of the sheet product to occur and enables the mechanical synchronization of the dispense cycle with the perforation lines 106. Accordingly, the dispenser 100 may be configured to dispense individual sheets 102 having a sheet length of 8.5 inches, wherein the rotation length of the contact surface of the first drive roller 140 is 8.0 inches. It will be understood that the dimensions of the dispenser 100, particularly the mechanical dispensing mechanism 120, and the individual sheets 102 may be selected depending upon the type of sheet product to be dispensed.

Figure 3:
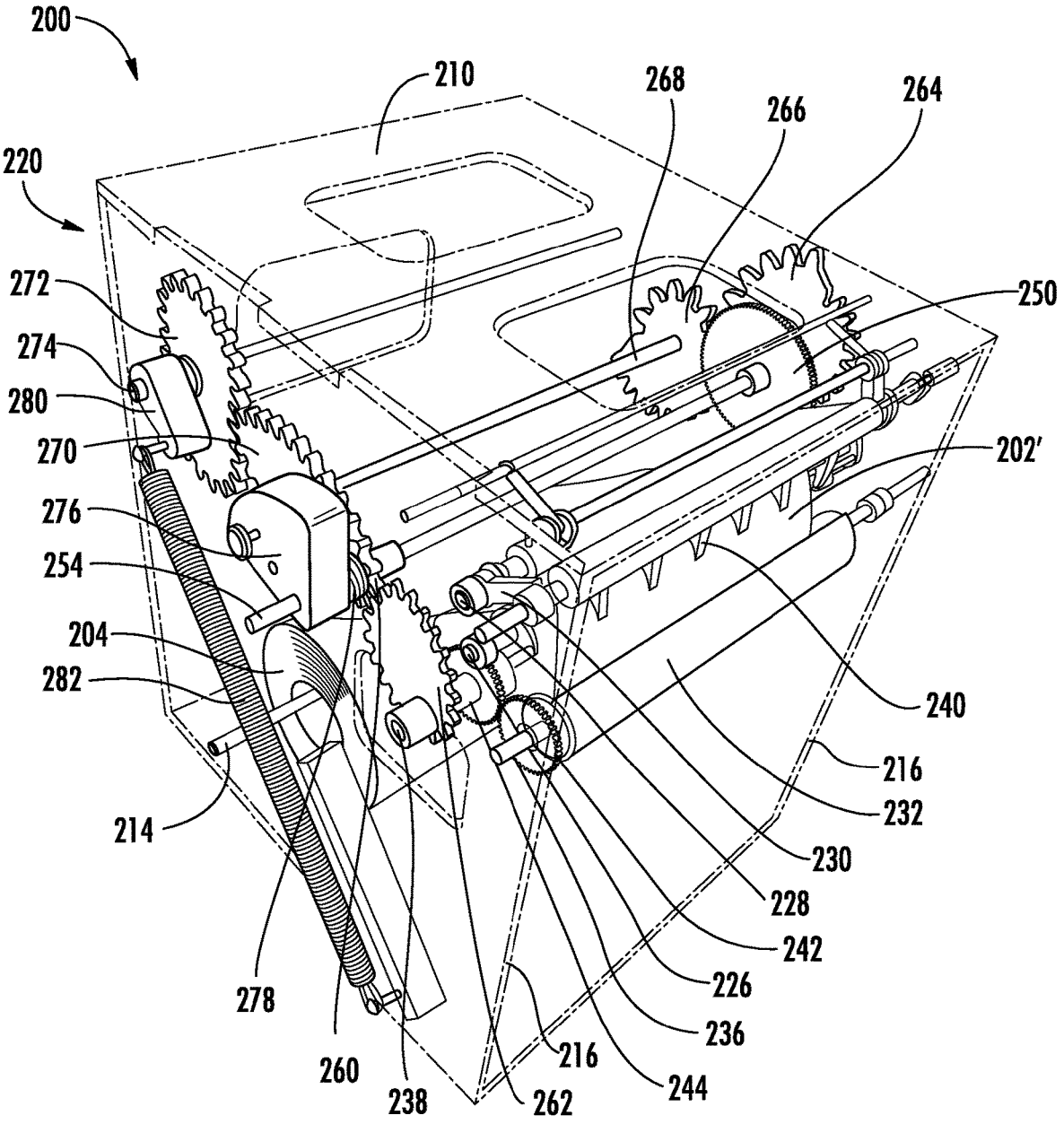
FIG. 3 is a perspective view of an example mechanical hands-free sheet product dispenser in accordance with one or more embodiments of the disclosure.
Figure 4:
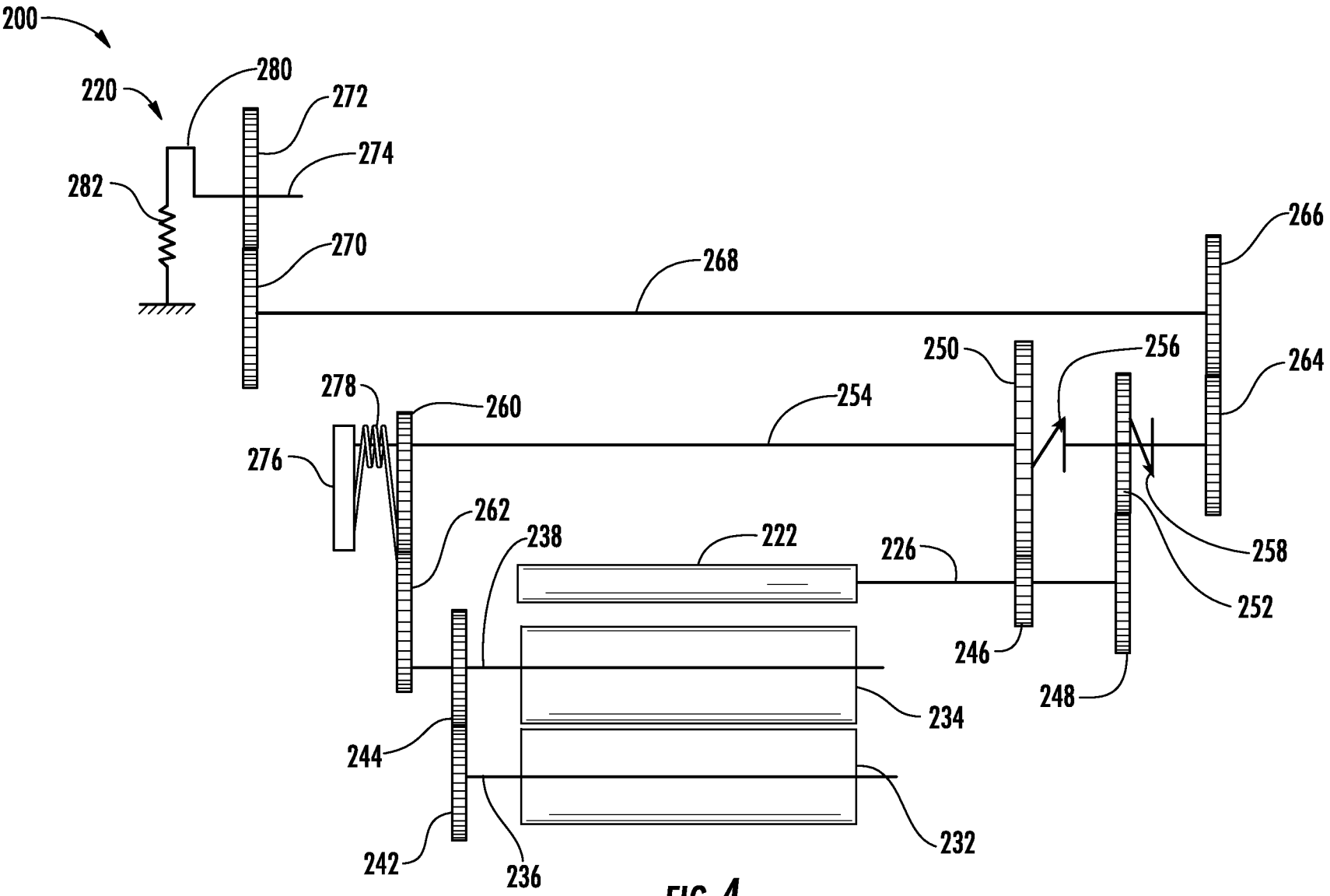
FIG. 4 is a schematic diagram of a portion of the example mechanical hands-free sheet product dispenser of FIG. 3, showing a mechanical dispensing mechanism.
Figure 5A:
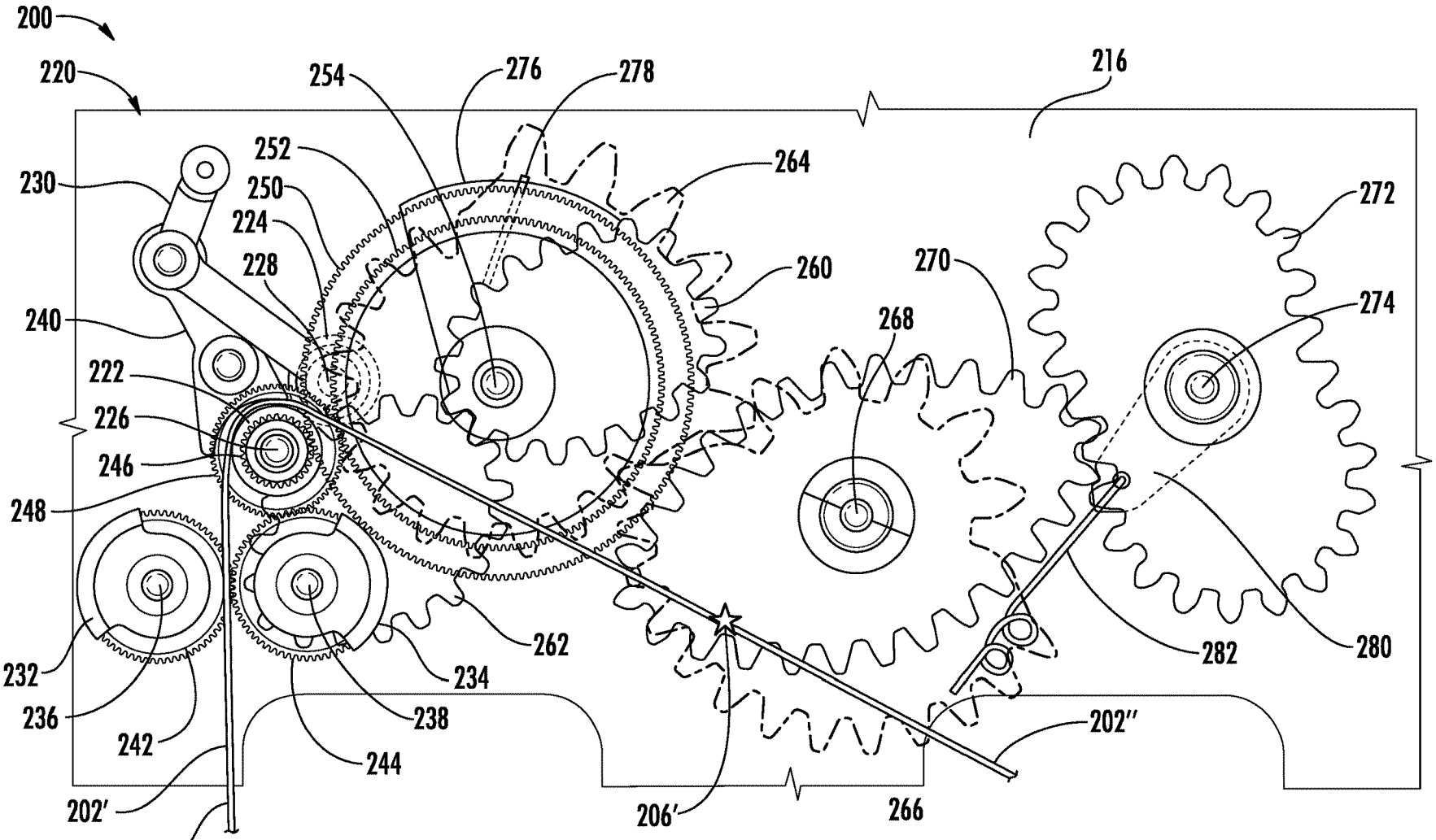
FIG. 5A is a side view of a portion of the example mechanical hands-free sheet product dispenser of FIG. 3, showing a mechanical dispensing mechanism in a first state during a dispense cycle.
Figure 5B:
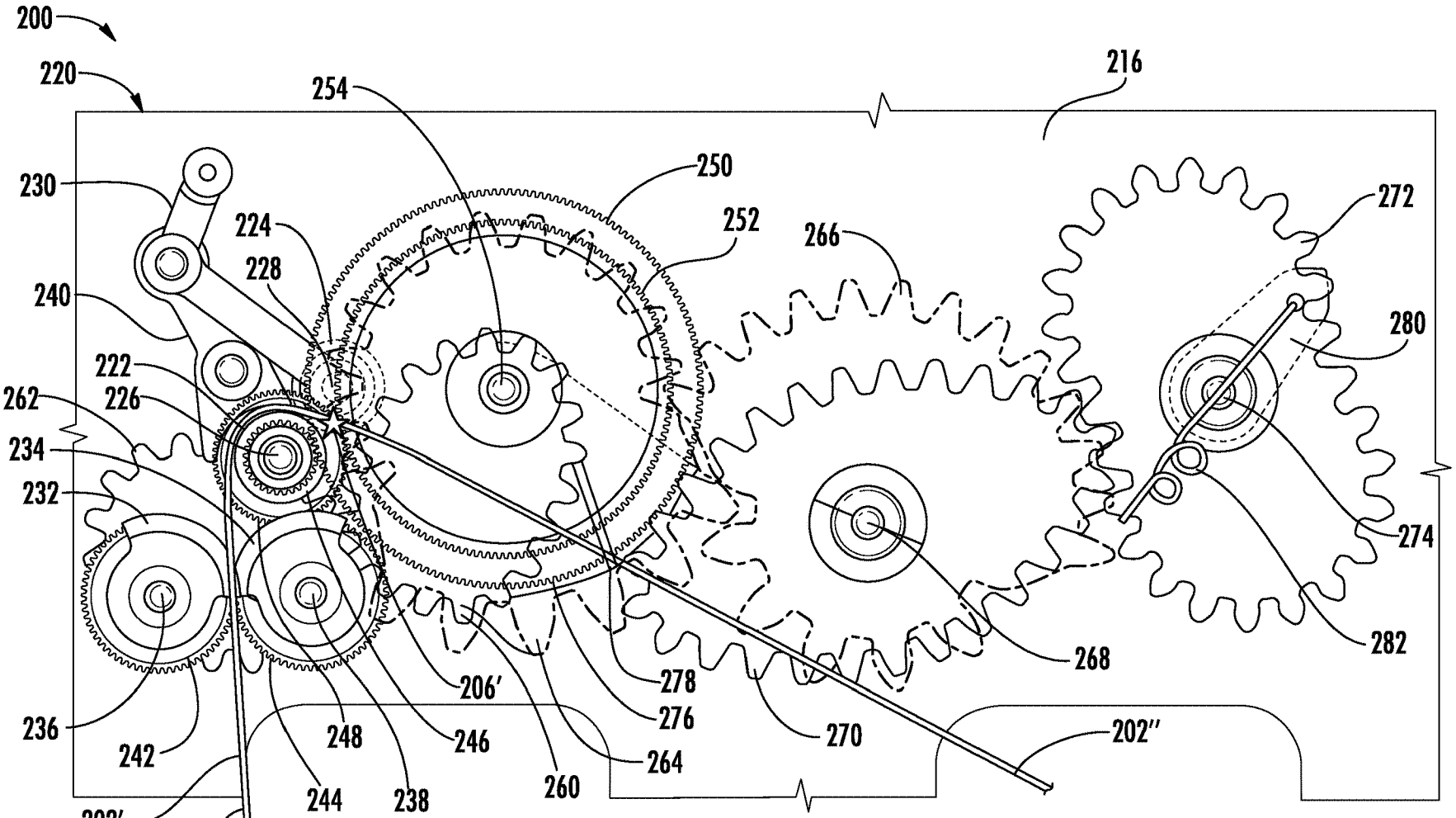
FIG. 5B is a side view of a portion of the example mechanical hands-free sheet product dispenser of FIG. 3, showing the mechanical dispensing mechanism in a second state during the dispense cycle.
Figure 5C:
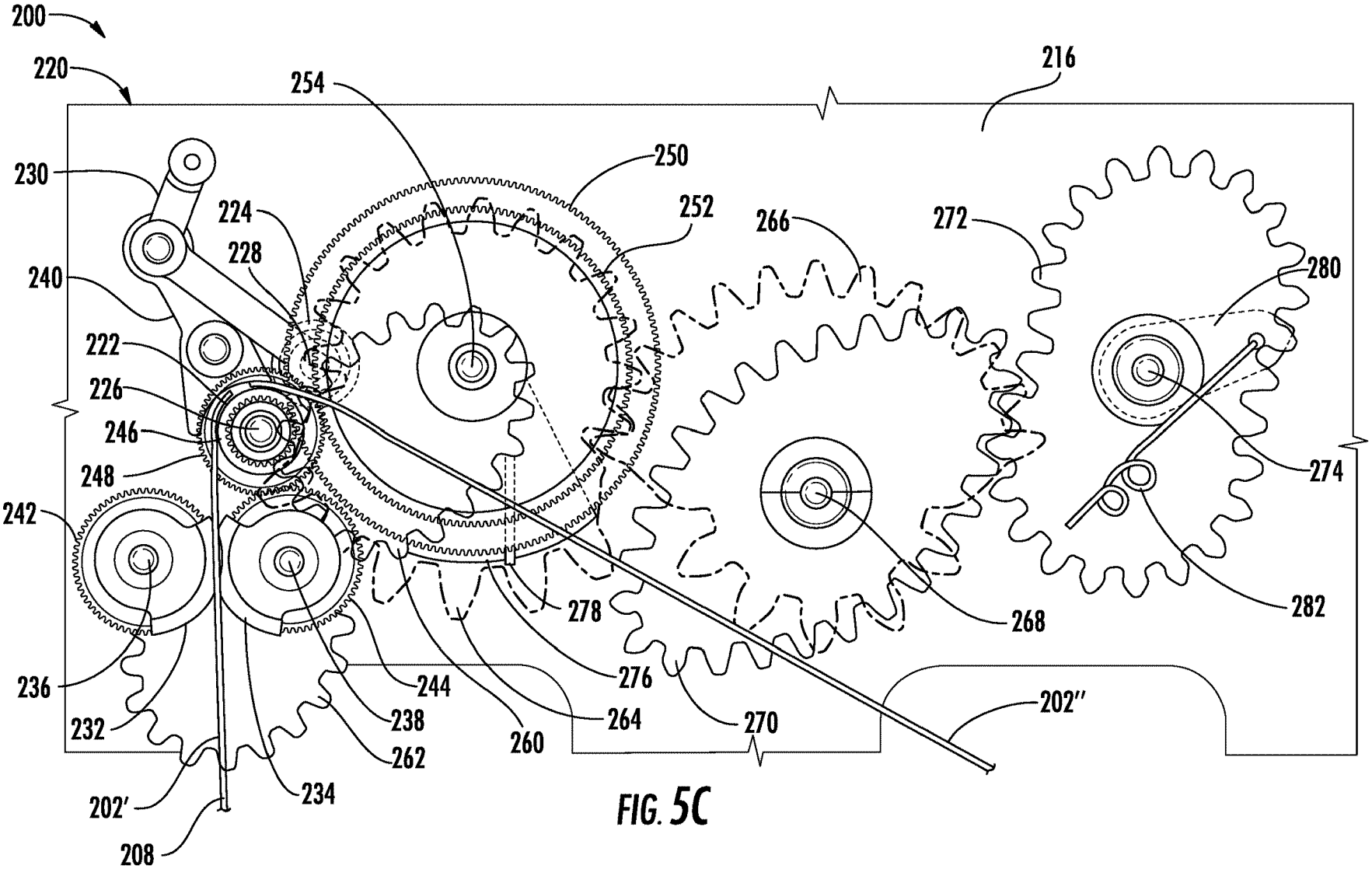
FIG. 5C is a side view of a portion of the example mechanical hands-free sheet product dispenser of FIG. 3, showing the mechanical dispensing mechanism in a third state during the dispense cycle.

FIG. 3 shows a perspective view of an example mechanical hands-free sheet product dispenser 200 in accordance with one or more embodiments of the disclosure. FIG. 4 shows a schematic diagram of a portion of the dispenser 200. FIGS. 5A-5C show side views of a portion of the dispenser 200 in different states during a dispense cycle. The dispenser 200 may be configured to dispense individual sheets 202 from a roll 204 of perforated sheet product. The roll 204 of perforated sheet product may be formed in a conventional manner, whereby the individual sheets 202 are at least partially defined by perforation lines 206 or other predefined lines of weakness extending between adjacent sheets 202. In this manner, the perforation lines 206 may be configured to facilitate separation of the sheets 202 from one another during use of the dispenser 200.

As is described in detail herein below, the dispenser 200 may be configured to present a tail portion 208 (i.e., an exposed end portion) of the roll 204 to be grasped and pulled by a user during a dispense cycle. Specifically, as is shown, the tail portion 208 may be a leading end portion of a leading individual sheet 202' to be dispensed during a dispense cycle. A leading perforation line 206' (i.e. the perforation line closest to the tail portion 208 and at least partially defining the leading individual sheet 202') may extend between the leading individual sheet 202' and a next individual sheet 202". It will be understood that the terms "leading" and "next" are used herein for the purpose of describing relevant portions of the roll 204 of sheet product prior to and during a given dispense cycle, and that these terms are adjusted when describing relevant portions prior to and during a subsequent dispense cycle. In this manner, upon completion of a first dispense cycle for dispensing the leading individual sheet 202', the next individual sheet 202" for the first dispense cycle becomes the leading individual sheet 202' for a second dispense cycle.

As is shown, the dispenser 200 may include a housing 210, and the roll 204 of perforated sheet product may be disposed within the housing 210 for dispensing the individual sheets 202 therefrom. The roll 204 may be rotatably supported within the housing 210 by a roll support, such as a roll shaft 214 attached to opposing side walls 216 of the housing 210. In some embodiments, the housing 210 may include a dispenser outlet (not shown) defined in a wall thereof, such as a front wall or a bottom wall of the housing. The dispenser 200 may be configured to present the tail portion 208 extending from the dispenser outlet and out of the housing 210 to be grasped and pulled by a user.

The dispenser 200 also may include a mechanical dispensing mechanism 220 disposed within the housing 210 and configured to guide and advance the sheet product from the roll 204 during a dispense cycle. The mechanical dispensing mechanism 220 may include a number of rollers configured to guide and advance the sheet product from the roll 204 during a dispense cycle as a user grasps and pulls the tail portion 208 to impart a driving force thereto. Specifically, the number of rollers may include a drive roller 222 and a pinch roller 224 attached to the housing 210 and configured to receive the sheet product therebetween. The drive roller 222 and the pinch roller 224 may be configured to engage and grip the sheet product throughout the dispense cycle. As is shown, the drive roller 222 may be positioned about and coupled to a drive roller axle 226 supported by the side walls 216 of the housing 210 and allowing the drive roller 222 to rotate with respect to the housing 210. The pinch roller 224 similarly may be positioned about and coupled to a pinch roller axle 228 supported by the housing 210 via a pinch roller arm 230 and allowing the pinch roller 224 to rotate with respect to the housing 210. The number of rollers also may include first and second crescent rollers 232, 234 attached to the housing 210 and configured to receive the sheet product therebetween. The crescent rollers 232, 234 may be configured to engage and grip the sheet product during a portion of the dispense cycle and to disengage and release grip of the sheet product during another portion of the dispense cycle. As is shown, the crescent rollers 232, 234 may be respectively positioned about and coupled to first and second crescent roller axles 236, 238 supported by the housing 210 and allowing the crescent rollers 232, 234 to rotate with respect to the housing 210. The mechanical dispensing mechanism 220 also may include a sheet product guide 240 disposed above the drive roller 222 and configured to guide the sheet product downward toward the crescent rollers 232, 234, as is shown.

The mechanical dispensing mechanism 220 also may include a number of gears configured to drive the crescent rollers 232, 234 at a varying rate throughout a dispense cycle, as is described in detail below. Specifically, the number of gears may include first and second crescent roller gears 242, 244 respectively positioned about and coupled to the crescent roller axles 236, 238 supported by the housing 210 and allowing the crescent roller gears 242, 244 to rotate with respect to the housing 210. As is shown, the crescent roller gears 242, 244 may be circular gears that engage one another throughout the dispense cycle. The number of gears also may include first and second drive roller gears 246, 248 each positioned about and coupled to the drive roller axle 226 supported by the housing 210 and allowing the drive roller gears 246, 248 to rotate with respect to the housing 210. As is shown, the drive roller gears 246, 248 may be circular gears.

The number of gears also may include first and second transfer gears 250, 252 each positioned about and coupled to a preloader axle 254 supported by the housing 210 and allowing the first and second transfer gears 250, 252 to rotate with respect to the housing 210. The first and second transfer gears 250, 252 may be respectively coupled to the preloader axle 254 via first and second one-way bearings 256, 258. The first one-way bearing 256 may allow the first transfer gear 250 to lock to the preloader axle 254 during a portion of the dispense cycle and to override the preloader axle 254 during another portion of the dispense cycle, and the second one-way bearing 258 may allow the second transfer gear 252 to lock to the preloader axle 254 during a portion of the dispense cycle and to override the preloader axle 254 during another portion of the dispense cycle, as is described in detail below. The first one-way bearing 256 may have an orientation that is opposite an orientation of the second one-way bearing 258, such that the first transfer gear 250 locks to the preloader axle 254 while the second transfer gear 252 overrides the preloader axle 254, and the first transfer gear 250 overrides the preloader axle 254 while the second transfer gear 252 locks to the preloader axle 254. As is shown, the first transfer gear 250 may be a circular gear that engages the first drive roller gear 246 throughout the dispense cycle, and the second transfer gear 252 may be a circular gear that engages the second drive roller gear 248 throughout the dispense cycle.

The number of gears also may include a first non-circular gear 260 positioned about and free to rotate with respect to (i.e., not coupled to) the preloader axle 254 supported by the housing 210. As is shown, the first non-circular gear 260 may have a generally elliptical shape. The number of gears also may include a second non-circular gear 262 positioned about and coupled to the second crescent roller axle 238 supported by the housing 210 and allowing the second non-circular gear 262 to rotate with respect to the housing 210. As is shown, the second non-circular gear 262 may have a generally elliptical shape and may engage the first non-circular gear 260 throughout the dispense cycle. The number of gears also may include a third non-circular gear 264 positioned about and coupled to the preloader axle 254 supported by the housing 210 and allowing the third non-circular gear 264 to rotate with respect to the housing 210. As is shown, the third non-circular gear 264 may have a multiple segments, each with a constant pitch radius, including discontinuous step changes in pitch radii between segments. The number of gears also may include a fourth non-circular gear 266 positioned about and coupled to a transfer axle 268 supported by the housing 210 and allowing the fourth non-circular gear 266 to rotate with respect to the housing 210. As is shown, the fourth non-circular gear 266 may have multiple segments, each with a constant pitch radius, including discontinuous step changes in pitch radii between segments, and may engage the third non-circular gear 264 throughout the dispense cycle. The number of gears also may include a fifth non-circular gear 270 positioned about and coupled to the transfer axle 268 supported by the housing 210 and allowing the fifth non-circular gear 270 to rotate with respect to the housing 210. As is shown, the fifth non-circular gear 270 may have a shape that has a continuously changing pitch radius and that is customized to deliver a desired dispensing performance. The number of gears also may include a sixth non-circular gear 272 positioned about and coupled to a tail spring axle 274 supported by the housing 210 and allowing the sixth non-circular gear 272 to rotate with respect to the housing 210. As is shown, the sixth non-circular gear 272 may have a shape that has a continuously changing pitch radius and that is customized to deliver a desired dispensing performance, and may engage the fifth non-circular gear 270 throughout the dispense cycle.

The mechanical dispensing mechanism 220 also may include a crescent preloader 276 positioned about and coupled to the preloader axle 254 supported by the housing 210 and allowing the crescent preloader 276 to rotate with respect to the housing 210. As is shown, the crescent preloader 276 also may be attached to the first non-circular gear 260 via a crescent preloader spring 278, such as a torsional spring, positioned therebetween. As is described in detail below, the crescent preloader spring 278 may be configured to compress and store energy as the crescent preloader 276 and the first non-circular gear 260 rotate with respect to one another during a portion of the dispense cycle, and to expand and release the stored energy as the crescent preloader 276 and the first non-circular gear 260 rotate with respect to one another during another portion of the dispense cycle.

The mechanical dispensing mechanism 220 also may include a tail spring arm 280 positioned about and coupled to the tail spring axle 274 supported by the housing 210 and allowing the tail spring arm 280 to rotate with respect to the housing 210. As is shown, the tail spring arm 280 also may be attached to the housing 210 via a tail spring 282, such as a coil spring, positioned therebetween. As is described in detail below, the tail spring 282 may be configured to extend and store energy as the tail spring arm 280 rotates with respect to the housing 210 during a portion of the dispense cycle, and to retract and release the stored energy as the tail spring arm 280 rotates with respect to the housing 210 during another portion of the dispense cycle.

FIGS. 5A-5C show side views of the mechanical dispensing mechanism 220 in a number of different states during a dispense cycle as may be carried out using the dispenser 200. FIG. 5A shows the mechanical dispensing mechanism 220 in a first state of the dispense cycle, in which the tail portion 208 (the leading end portion of the leading sheet 202') is presented and available to be grasped and pulled by a user. In the first state, the drive roller 222 and the pinch roller 224 are engaging and gripping a portion of the leading sheet 202' received therebetween, while the crescent rollers 232, 234 are in an open orientation allowing the leading sheet 202' to extend freely through a gap defined between the crescent rollers 232, 234. As is shown, the leading perforation line 206' is disposed a distance upstream of the drive roller 222 and the pinch roller 224. In the first state, the crescent preloader 276 may hold the crescent preloader spring 278 in a slightly compressed and loaded condition against the first non-circular gear 260, such that the crescent preloader spring 278 stores a small amount of energy. The tail spring arm 280 may hold the tail spring 282 in a slightly extended and loaded condition, such that the tail spring 282 stores a small amount of energy. In the first state, the tail spring 282 is held at a "bottom-dead-center" orientation, and thus the tail spring 282 has its shortest length of the dispense cycle.

The user pulls the tail portion 208 downward to impart a driving force to the sheet product to carry out the dispense cycle. As the user initially pulls the tail portion 208 downward, the drive roller 222 and the pinch roller 224 continue to grip a portion of the leading sheet 202' received therebetween, which causes the drive roller 222 to rotate (counterclockwise in the side views shown) along with the drive roller axle 226. The rotation of the drive roller axle 226 causes the first and second drive roller gears 246, 248 to rotate (both counter-clockwise), which causes first and second transfer gears 250, 252 to rotate (both clockwise). The gear ratio of the first drive roller gear 246 and the first transfer gear 250 and the gear ratio of the second drive roller gear 248 and the second transfer gear 252 are configured such that the first transfer gear 250 rotates at a slower rate than the second transfer gear 252. Due to the orientation of the first and second one-way bearings 256, 258 and the slower speed of the first transfer gear 250, the first transfer gear 250 locks to and thus rotates the preloader axle 254 (clockwise), while the second transfer gear 252 overrides the preloader axle 254. In other words, when only the drive roller 222 is inputting force into the mechanical dispensing mechanism 220 (due to the driving force imparted by the user) yet the dispensing mechanism 220 would tend to remain stationary due to friction, the first one-way bearing 256 is configured to lock the first transfer gear 250 to the preloader axle 254 and rotate the preloader axle 254 at the slow speed, while the second one-way bearing 258 is configured to cause the second transfer gear 252 to override the preloader axle 254 at the faster speed. The rotation of the preloader axle 254 causes the crescent preloader 276 and the third non-circular gear 264 to rotate (both clockwise). The rotation of the crescent preloader 276 causes the first non-circular gear 260 to rotate (clockwise) via the force stored in the crescent preloader spring 278. The rotation of the first non-circular gear 260 causes the second non-circular gear 262 to rotate (counter-clockwise) along with the second crescent roller axle 238, which causes the second crescent roller gear 244 and the second crescent roller 234 to rotate (both counter-clockwise). The rotation of the second crescent roller gear 244 causes the first crescent roller gear 242 to rotate (clockwise) along with the first crescent roller axle 236, which causes the first crescent roller 232 to rotate (clockwise). The rotation of the third non-circular gear 264 causes the fourth non-circular gear 266 to rotate (counter-clockwise) along with the transfer axle 268, which causes the fifth non-circular gear 270 to rotate (counter-clockwise). The rotation of the fifth non-circular gear 270 causes the sixth non-circular gear 272 to rotate (clockwise) along with the tail spring axle 274, which causes the tail spring arm 280 to rotate (clockwise). The rotation of the tail spring arm 280 causes the tail spring 282 to extend upward and store energy. In this manner, initial pulling of the tail portion 208 downward by the user causes the drive roller 222 to rotate (counter-clockwise), which ultimately causes the crescent rollers 232, 234 to rotate (clockwise and counter-clockwise, respectively) and the tail spring 282 to extend and store energy.

As discussed above, by their nature, the first and second non-circular gears 260, 262 have a varying gear ratio, which is dependent upon the orientation of the non-circular gears 260, 262 throughout a rotation thereof. Accordingly, an output of the first and second non-circular gears 260, 262 to the crescent rollers 232, 234 (via the crescent roller axles 236, 238 and the crescent roller gears 242, 244) varies throughout the dispense cycle, and thus the non-circular gears 260, 262 drive the crescent rollers 232, 234 at a varying rate throughout the dispense cycle. In the first state of the dispense cycle, the first and second non-circular gears 260, 262 are in an orientation in which the output to the crescent rollers 232, 234 is very slow compared to the input from the initial pulling of the tail portion 208. Accordingly, as the user initially pulls the tail portion 208, the crescent rollers 232, 234 rotate at a slower rate than the tail portion 208 is pulled and the drive roller 222 is rotating.

FIG. 5B shows the mechanical dispensing mechanism 220 in a second state of the dispense cycle, following continued pulling of the tail portion 208 until the tail spring 282 reaches a "top-dead-center" orientation. Accordingly, the tail spring 282 has its longest length of the dispense cycle and stores the greatest amount of energy. In the second state, the crescent rollers 232, 234 engage and grip a portion of the leading sheet 202', while the drive roller 222 engages and grips another portion of the leading sheet 202', as is shown. In the second state, the first and second non-circular gears 260, 262 are in an orientation in which the output of the non-circular gears 260, 262 would be very fast, such that the crescent rollers 232, 234 would rotate at a rate faster than the tail portion 208 is pulled and the drive roller 222 is rotating. However, because the crescent rollers 232, 234 and the drive roller 222 are simultaneously gripping the leading sheet 202', and because there is tension in the leading sheet 202' between the crescent rollers 232, 234 and the drive roller 222, the crescent rollers 232, 234 are constrained to rotate at the same rate as the drive roller 222 as the user continues to pull the tail portion 208. The slower actual rate of rotation of the crescent rollers 232, 234 causes the crescent preloader spring 278 to compress and store more energy as the crescent preloader 276 rotates faster than the first non-circular gear 260, which is limited in speed by the crescent rollers 232, 234 as described above. Because the drive roller 222 is still inputting force into the mechanical dispensing mechanism 220 (due to the continued driving force imparted by the user), the first transfer gear 250 remains locked to and thus continues to rotate the preloader axle 254 according to the slow gear ratio of the first drive roller gear 246 and the first transfer gear 250, while the second transfer gear 252 continues to override the preloader axle 254. In the second state, the leading perforation line 206' is disposed along the rear side of the drive roller 222, and thus the leading perforation line 206' generally is not exposed to the full tension generated in the leading sheet 202' between the crescent rollers 232, 234 and the drive roller 222. As the user continues to pull the tail portion 208, the various gears continue to rotate as described above and the tail spring 282 moves beyond the top-dead-center orientation and begins to retract and release the stored energy, which reduces the driving force required from the user. Further, as the user continues to pull the tail portion 208, the tension generated in the leading sheet 202' between the crescent rollers 232, 234 and the drive roller 222 increases as the crescent preloader spring 278 continues to compress and store more energy. Further, as the user continues to pull the tail portion 208, the leading perforation line 206' is exposed to increasing tension as it rotates along the drive roller 222 and closer to the crescent rollers 232, 234.

FIG. 5C shows the mechanical dispensing mechanism 220 in a third state of the dispense cycle, following continued pulling of the tail portion 208 until the leading perforation line 206' advances over the top of the drive roller 222. In the third state, the drive roller 222 and the pinch roller 224 engage and grip a portion of the next sheet 202" received therebetween, while the crescent rollers 232, 234 engage and grip a portion of the leading sheet 202'. Because the leading perforation line 206' is disposed far enough along the front side of the drive roller 222, the leading perforation line 206' is exposed to the tension generated in the leading sheet 202' between the crescent rollers 232, 234 and the drive roller 222. Ultimately, as the user continues to pull the tail portion 208, the leading perforation line 206' is exposed to enough tension to separate the leading sheet 202' from the next sheet 202" along the leading perforation line 206', as is shown. Upon separation of the leading sheet 202', the crescent rollers 232, 234 are no longer constrained to rotate at the same rate as the drive roller 222. Accordingly, the crescent preloader spring 278 expands and releases the stored energy, which causes the first and second non-circular gears 260, 262 to continue to rotate (clockwise and counter-clockwise, respectively), which ultimately causes the crescent rollers 232, 234 to continue to rotate (clockwise and counter-clockwise, respectively) and advance the leading sheet 202'.

Further, upon separation of the leading sheet 202', the drive roller 222 is no longer inputting force into the mechanical dispensing mechanism 220. However, the tail spring 282 is beyond the top-dead-center orientation and continues to release the stored energy by rotating the tail spring arm 280 (clockwise) along with the tail spring axle 274, which causes the sixth non-circular gear 272 to continue to rotate (clockwise). The tail spring 282 continues to release the stored energy until it reaches the bottom-dead-center orientation. The rotation of the sixth non-circular gear 272 causes the fifth non-circular gear 270 to continue to rotate (counter-clockwise) along with the transfer axle 268, which causes the fourth non-circular gear 266 to continue to rotate (counter-clockwise). The rotation of the fourth non-circular gear 266 causes the third non-circular gear 264 to continue to rotate (clockwise) along with the preloader axle 254. In the third state of the dispense cycle, due to the orientation of the first and second one-way bearings 256, 258, the second transfer gear 252 locks to and thus rotates (clockwise) with the preloader axle 254, while first transfer gear 250 overrides the preloader axle 254. In other words, when the tail spring 282 is releasing the stored energy and thus driving the mechanical dispensing mechanism 220, the second one-way bearing 258 is configured to lock the second transfer gear 252 to the preloader axle 254, and the first one-way bearing 256 is configured to cause the first transfer gear 250 to override the preloader axle 254. The rotation of the second transfer gear 252 causes the second drive roller gear 248 to continue to rotate (counter-clockwise) along with the drive roller axle 226, which causes the drive roller 222 to continue to rotate (counter-clockwise) and advance the next sheet 202". In this manner, upon separation of the leading sheet 202', the release of the stored energy by the crescent preloader spring 278 ultimately causes the crescent rollers 232, 234 to continue to rotate and advance the leading sheet 202', and the release of the stored energy by the tail spring 282 ultimately causes the drive roller 222 to continue to rotate and advance the next sheet 202". The crescent rollers 232, 234 continue to rotate into an open orientation in which the crescent rollers 232, 234 disengage and release grip of the leading sheet 202', allowing the user to take the leading sheet 202'. Meanwhile, the drive roller 222 continues to rotate and advance the next sheet 202", as the mechanical dispensing mechanism 220 returns to the first state, as is shown in FIG. 5A, and is ready to begin a subsequent dispense cycle.

The dispenser 200 may be configured to mechanically synchronize a dispense cycle with the perforation lines 206 of the roll 204 of sheet product. Specifically, the mechanical dispensing mechanism 220 may be configured to mechanically synchronize a dispense cycle with a leading perforation line 206' (a next perforation line 206" of a previous dispense cycle) that advanced too far during the previous dispense cycle (i.e., a leading perforation line 206' that is advanced further than the leading perforation line 206' shown in FIG. 5A). The mechanical dispensing mechanism 220 also may be configured to mechanically synchronize a dispense cycle with a leading perforation line 206' (a next perforation line 206" of a previous dispense cycle) that did not advance far enough during the previous dispense cycle (i.e. a leading perforation line 206' that is not advanced as far as the leading perforation line 206' shown in FIG. 5A).

Mechanical synchronization may occur between the second state and the third state of the dispense cycle. As described above, in the second state (before separation of the leading sheet 202'), as the drive roller 222 is inputting force into the mechanical dispensing mechanism 220 (due to the continued driving force imparted by the user prior to separation of the leading sheet 202'), the first transfer gear 250 is locked to and thus rotates the preloader axle 254 along with the third non-circular gear 264 according to the lower output of the first drive roller gear 246 and the first transfer gear 250. In this manner, before separation of the leading sheet 202', the first drive roller gear 246 and the first transfer gear 250 cause the third non-circular gear 264 to rotate at a relatively low speed. In the third state (after separation of the leading sheet 202'), as the tail spring 282 drives the mechanical dispensing mechanism 220 (due to the release of the stored energy by the tail spring 282), the second transfer gear 252 is locked to and thus rotates with the preloader axle 254 being rotated by the third non-circular gear 264, and the second drive roller gear 248 rotates the drive roller axle 226 and the drive roller 222 according to the different output of the second transfer gear 252 and the second drive roller gear 248. In this manner, after separation of the leading sheet 202', the second drive roller gear 248 and the second transfer gear 252 allow the third non-circular gear 264 to rotate at a relatively high speed. It may be appreciated that, in the illustrated embodiment, the third non-circular gear 264 nominally rotates once per dispense cycle. As described above, the drive roller 222 rotates relatively quickly compared to the third non-circular gear 264 during the first state and the second state. The drive roller 222 rotates less quickly compared to the third non-circular gear 264 during the third state.

If, for some reason, a leading perforation line 206' advanced too far during a previous dispense cycle, during a new dispense cycle, the second state would end sooner (the sheet product would be pulled over the drive roller 222 for a decreased period of time as compared to a typical dispense cycle) because the leading perforation line 206' would be exposed sooner to enough tension to separate the leading sheet 202' from the next sheet 202". Accordingly, the third state would begin sooner, and the drive roller 222 would spend an increased portion of time (as compared to a typical dispense cycle) rotating less quickly, allowing the mechanical dispensing mechanism 220 to catch up to the next perforation line 206". If, for some reason, a leading perforation line 206' did not advance far enough during a previous dispense cycle, during a new dispense cycle, the second state would last a longer duration (the sheet product would be pulled over the drive roller 222 for an increased period of time as compared to a typical dispense cycle) because the leading perforation line 206' would be exposed later to enough tension to separate the leading sheet 202' from the next sheet 202". Accordingly, the third state would begin later, and the drive roller 222 would spend an increased portion of time (as compared to a typical dispense cycle) rotating more quickly, allowing the next perforation line 206" to catch up to the mechanical dispensing mechanism 220. In this manner, the mechanical dispensing mechanism 220, and thus the overall dispenser 200, may compensate and synchronize a dispense cycle with the perforation lines 206 of the roll 204 of sheet product.

The dispenser 200 may be configured to dispense individual sheets 202 having a predetermined sheet length (i.e., the roll 204 has a predetermined distance between adjacent perforation lines 206), which may depend on the type of sheet product dispensed. For example, the dispenser 200 may be configured to dispense individual sheets 202 of paper towels having a predetermined sheet length of 8.5 inches. Based on the configuration and operation of the mechanical dispensing mechanism 220, the sheet length may be equal to a sum of a length of the tail portion 208 (a "tail length") and a length over which a user pulls the tail portion 208 (a "pull length") during the dispense cycle. For example, the dispenser 200 may be configured to dispense individual sheets 202 having a sheet length of 8.5 inches, wherein the tail length is 4.25 inches and the pull length is 4.25 inches.

The dispenser 200 also may be configured to mechanically "lockout" (i.e., prevent dispensing of) a roll 204 of sheet product including individual sheets 202 having a sheet length outside of a predetermined range. For example, the dispenser 200 may be configured to mechanically lockout a roll 204 of sheet product including individual sheets 202 having a sheet length outside of a predetermined range of 7.85 to 9.15 inches. As described above, proper operation of the mechanical dispensing mechanism 220 requires the perforation lines 206 to be disposed generally at certain positions relative to the various rollers and gears at certain portions of a dispense cycle. Attempting to dispense a roll 204 of sheet product including individual sheets 202 having a sheet length outside of a predetermined range would cause the perforation lines 206 to be disposed at incorrect positions relative to the various rollers and gears at certain portions of a dispense cycle. It will be understood that the dimensions of the dispenser 200, particularly the mechanical dispensing mechanism 220, and the individual sheets 202 may be selected depending upon the type of sheet product to be dispensed.

The mechanical dispensing mechanism 220 of dispenser 200 may provide significant advantages over mechanical dispensing mechanisms of known hands-free sheet product dispensers. In particular, the various non-circular gears of the mechanical dispensing mechanism 220 may provide significant advantages over conventional circular gears used in known mechanical dispensing mechanisms.

As described above, the first and second non-circular gears 260, 262 may be configured to drive the crescent rollers 232, 234 at a varying speed throughout a dispense cycle. Specifically, the first and second non-circular gears 260, 262 may be configured to drive the crescent rollers 232, 234 at a higher speed while the crescent rollers 232, 234 are engaging and gripping the sheet product, and to drive the crescent rollers 232, 234 at a lower speed while the crescent rollers 232, 234 are not engaging the sheet product. The portions of the first and second non-circular gears 260, 262 that mesh while the crescent rollers 232, 234 are engaging and gripping the sheet product may have a constant pitch radius. In this manner, the first and second non-circular gears 260, 262 may maintain a constant gear ratio while the crescent rollers 232, 234 are engaging and gripping the sheet product, such that a known tension is maintained in the sheet product as the leading sheet 202' separates from the next sheet 202" along the leading perforation line 206'.

It would be possible to drive the crescent rollers 232, 234 of the dispenser 200 with conventional circular gears (instead of the first and second non-circular gears 260, 262), such that the crescent rollers 232, 234 would rotate at a constant speed throughout a dispense cycle. However, the crescent rollers 232, 234 would require a much larger radius in order to rotate fast enough while gripping to generate enough tension in the sheet product to separate the leading sheet 202' from the next sheet 202" along the leading perforation line 206'. The larger crescent rollers 232, 234 would require a larger housing 210 to contain the mechanical dispensing mechanism 220. Further, the larger crescent rollers 232, 234 would require a higher pull force (i.e., a driving force imparted by a user) for a given sheet length, as the larger crescent rollers 232, 234 would require a shorter pull length and a longer tail length in order for the tail portion 208 to extend far enough beyond the crescent rollers 232, 234 to be grasped and pulled by a user. Ultimately, as compared to conventional circular gears, the first and second non-circular gears 260, 262 may allow a smaller housing 210 to be used, a lower pull force required for a given sheet length, and a longer pull length required for a given sheet length.

As described above, the fifth and sixth non-circular gears 270, 272 may be configured to drive the tail spring arm 280 to cause the tail spring 282 to extend and store energy during a first portion of the dispense cycle, and to be driven by the tail spring arm 280 as the tail spring 282 retracts and releases the stored energy during a second portion of the dispense cycle. In this manner, a portion of the pull force required to carry out the dispense cycle is used to extend the tail spring 282 throughout the first portion of the dispense cycle. As is shown, the fifth and sixth non-circular gears 270, 272 may have varying radius relationships with respect to one another throughout the dispense cycle. Specifically, in the first state (FIG. 5A), the fifth non-circular gear 270 may have a larger pitch radius than the sixth non-circular gear 272, while the tail spring 282 is held at the bottom-dead-center orientation. Accordingly, as the user pulls the tail portion 208 and the fifth and sixth non-circular gears 270, 272 rotate as described above, the sixth non-circular gear 272 rotates at a higher rate than the fifth non-circular gear 270, which causes the tail spring arm 280 to rotate at the higher rate and more quickly be positioned to extend the tail spring 282 to store energy. Following continued pulling of the tail portion 208 and rotation of the fifth non-circular gear 270 about ninety degrees, the sixth non-circular gear 272 may also have rotated about ninety degrees, positioning the tail spring arm 280 with the greatest moment art with the tail spring 282. In this position, the sixth non-circular gear 272 has a larger pitch radius than the fifth non-circular gear 270, while the tail spring 282 exerts the maximum torque against the sixth non-circular gear 272. Accordingly, the fifth and sixth non-circular gears 270, 272 may reduce the pull force required at this point of the dispense cycle.

Figure 6:
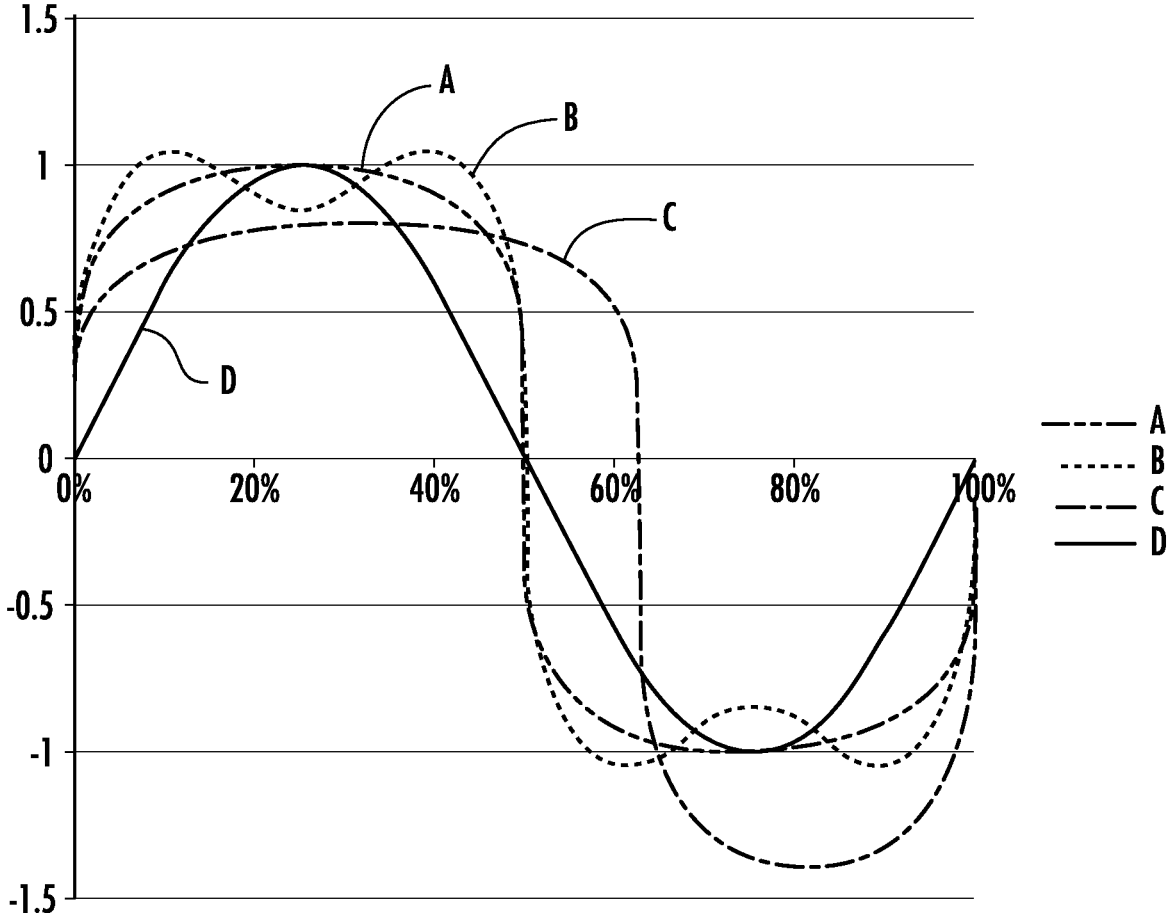
FIG. 6 is a graph of a force required to extend a tail spring as a function of a percentage of completion of a dispense cycle as may be carried out using the example mechanical hands-free sheet product dispenser of FIG. 3.

FIG. 6 shows a graph of a force required to pull the tail portion 208 in order to extend the tail spring 282 as a function of a percentage of completion of a dispense cycle of the dispenser 200, including force curves A, B, C according to different embodiments of the dispenser 200. For comparison, the graph also shows a force curve D for a conventional tail spring of a known mechanical hands-free dispenser including a rotating drum, as described above. A user pulls sheet product from the dispenser throughout a dispense cycle, which causes the drum to rotate and the tail spring to extend and then retract. As is shown by the force curve D, the force required to extend the tail spring increases and decreases in a generally sinusoidal pattern. In this manner, for a first half of the dispense cycle, the force required to extend the tail spring gradually increases, reaches a peak, and then gradually decreases to zero. For a second half of the dispense cycle, the force gradually increases negatively (i.e., the spring retracts and causes the drum to rotate), reaches a peak, and then gradually decreases negatively to zero. The area under the positive portion of the force curve D represents the energy input to the tail spring by rotating the drum, and the area under the negative portion of the force curve D (equal to the area under the positive portion) represents the energy output from the tail spring to rotate the drum.

It would be possible to drive the tail spring 282 of the dispenser 200 with conventional circular gears (instead of the fifth and sixth non-circular gears 270, 272), which would result in a force curve similar to the force curve D. However, the constant radius relationship of the conventional circular gears would determine the energy input and output for a given peak force, and the constant radius relationship of the conventional circular gears also would determine the peak force for a given energy input and output. In contrast, the varying radius relationships of the fifth and sixth non-circular gears 270, 272 may be configured to independently determine the peak force and the energy input and output. As is shown, the force curves A, B, C each have a positive portion corresponding to the portion of the dispense cycle during which the fifth and sixth non-circular gears 270, 272 drive the tail spring arm 280 to cause the tail spring 282 to extend and store energy. The force curves A, B, C also each have a negative portion corresponding to the portion of the dispense cycle during which the tail spring arm 280 drives the fifth and sixth non-circular gears 270, 272 as the tail spring 282 retracts and releases the stored energy. According to different embodiments, the fifth and sixth non-circular gears 270, 272 may have radius relationships that affect the peak force required to extend the tail spring 282 and the energy input required to extend the tail spring 282 (and thus also the energy output from the tail spring 282). For example, as compared to conventional circular gears, the fifth and sixth non-circular gears 270, 272 may be configured to provide a greater energy input and output for a given peak force required to extend the tail spring 282, as shown by force curves A and B. Alternatively, as compared to conventional circular gears, the fifth and sixth non-circular gears 270, 272 may be configured to provide a lower peak force required to extend the tail spring 282 for a given energy input and output. Further, as compared to conventional circular gears, the fifth and sixth non-circular gears 270, 272 may be configured to provide a lower peak force required to extend the tail spring 282 and a greater energy input and output. Ultimately, because the peak force required to extend the tail spring 282 is provided by the user pulling the tail portion 208, the fifth and sixth non-circular gears 270, 272 may be configured to allow a lower overall pull force required for a given sheet length, which may allow a lower paper strength of the sheet product and also may improve user perception of the dispenser 200.

As described above, the third and fourth non-circular gears 264, 266 may be configured to be driven by the preloader axle 254 during a first portion of the dispense cycle (before separation of the leading sheet 202'), and to drive the preloader axle 254 during a second portion of the dispense cycle (after separation of the leading sheet 202') to ultimately cause the drive roller 222 to advance a tail portion 208 for a subsequent dispense cycle. As is shown, the third and fourth non-circular gears 264, 266 each may have discontinuous pitch radii defined by a larger section and a smaller section thereof, the larger section having a larger, constant pitch radius and the smaller section having a smaller, constant pitch radius. In this manner, the third and fourth non-circular gears 264, 266 may be configured to provide two different rate relationships, depending on the orientation of the third and fourth non-circular gears 264, 266. Specifically, the third non-circular gear 264 may have the larger pitch radius during the first portion of the dispense cycle, such that the fourth non-circular gear 266 rotates at a higher rate than the third non-circular gear 264. Accordingly, during the first portion of the dispense cycle, the transfer axle 268 may rotate at a higher rate than the preloader axle 254. Further, the fourth non-circular gear 266 may have the larger pitch radius during the second portion of the dispense cycle, such that the third non-circular gear 264 rotates at a higher rate than the fourth non-circular gear 266. Accordingly, during the second portion of the dispense cycle, the preloader axle 254 may rotate at a higher rate than the transfer axle 268. The rate relationship of the third and fourth non-circular gears 264, 266 during the first portion of the dispense cycle may be configured such that the user is allowed to pull the tail portion 208 over a predetermined pull length. The rate relationship of the third and fourth non-circular gears 264, 266 during the second portion of the dispense cycle may be configured such that the drive roller 222 advances the next tail portion 208 having a predetermined tail length. For example, the dispenser 200 may be configured to dispense individual sheets 202 having a sheet length of 8.5 inches, and the rate relationships of the third and fourth non-circular gears 264, 266 may be configured such that, in conjunction with the above-described behavior of the drive roller gears 246, 248, the transfer gears 250, 252, the one-way bearings 256, 258, the first non-circular gear 260, and the second non-circular gear 262, the user is allowed to pull the tail portion 208 over a pull length of 4.9 inches, and such that the drive roller 222 advances the next tail portion 208 having a tail length of 3.6 inches.

It will be understood that the rate relationships of the third and fourth non-circular gears 264, 266 may be selected depending upon the sheet length, pull length, and tail length desired. A longer sheet length may allow for a pull length that is greater than a tail length. For example, the dispenser 200 may be configured to dispense individual sheets 202 having a sheet length of 11.0 inches, and the rate relationships of the third and fourth non-circular gears 264, 266 may be configured such that the user is allowed to pull the tail portion 208 over a pull length of 7.0 inches, and such that the drive roller 222 advances the next tail portion 208 having a tail length of 4.0 inches. According to this example, the fifth and sixth non-circular gears 270, 272 may be configured to produce the force curve C, which provides a lower peak force required to extend the tail spring 282 and a greater spring force available to advance the next tail portion 208 for greater dispenser reliability. The force curve C also provides a flatter, smoother shape than a sine wave for greater energy input and output to advance the next tail portion 208 as well as improved user perception.

Ultimately, as compared to known dispensers, the dispenser 200 may allow a lower pull force (i.e., a driving force imparted by a user) required for a given sheet length and tail length. Additionally, as compared to known dispensers, the dispenser 200 may allow a lower paper strength required for a given sheet length and tail length, due to the lower pull force allowed. Further, as compared to known dispensers, the dispenser 200 may generate a greater amount of energy from a given pull force, which may provide greater reliability in presenting a tail portion.

Figure 7:
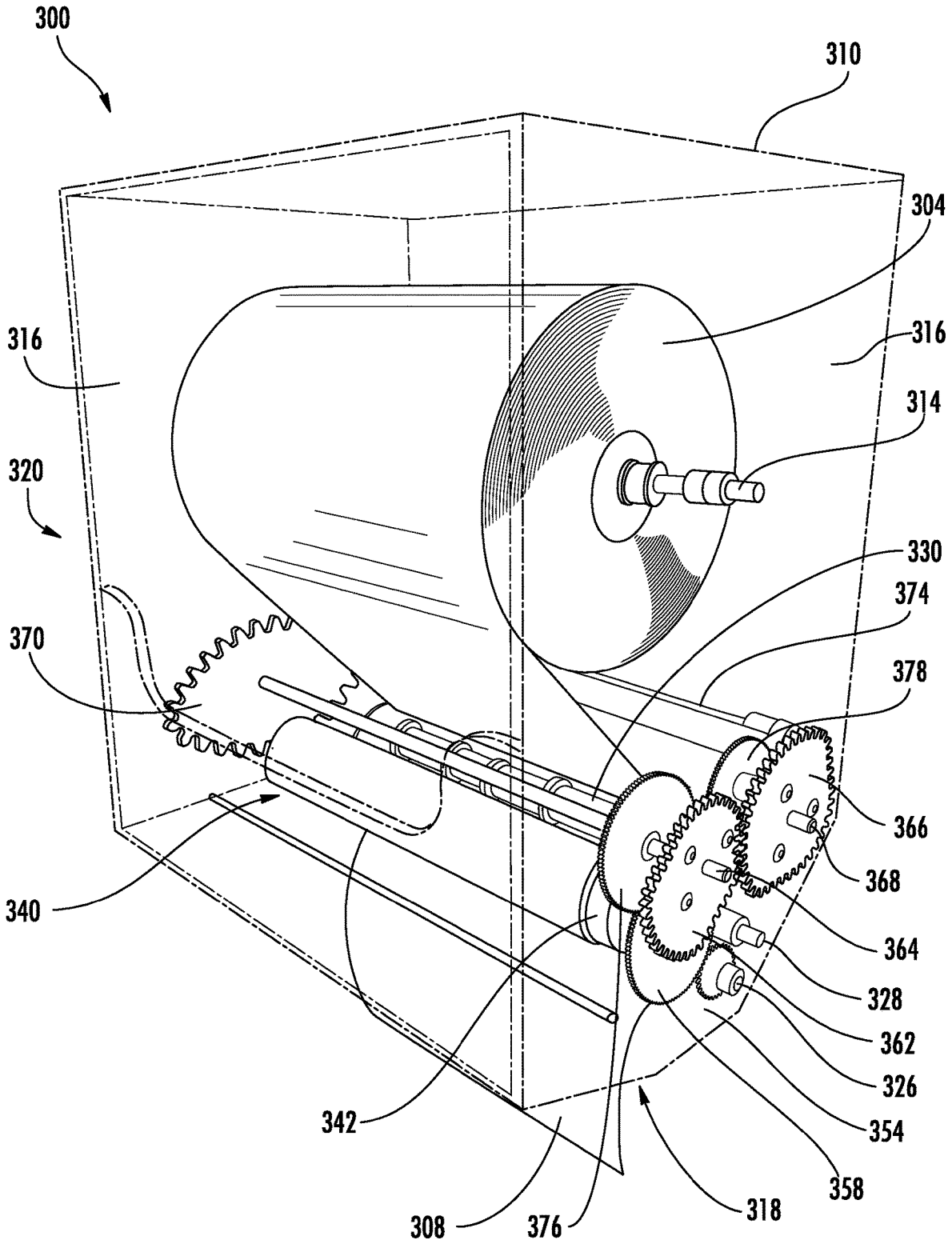
FIG. 7 is a perspective view of an example mechanical hands-free sheet product dispenser in accordance with one or more embodiments of the disclosure.
Figure 8:
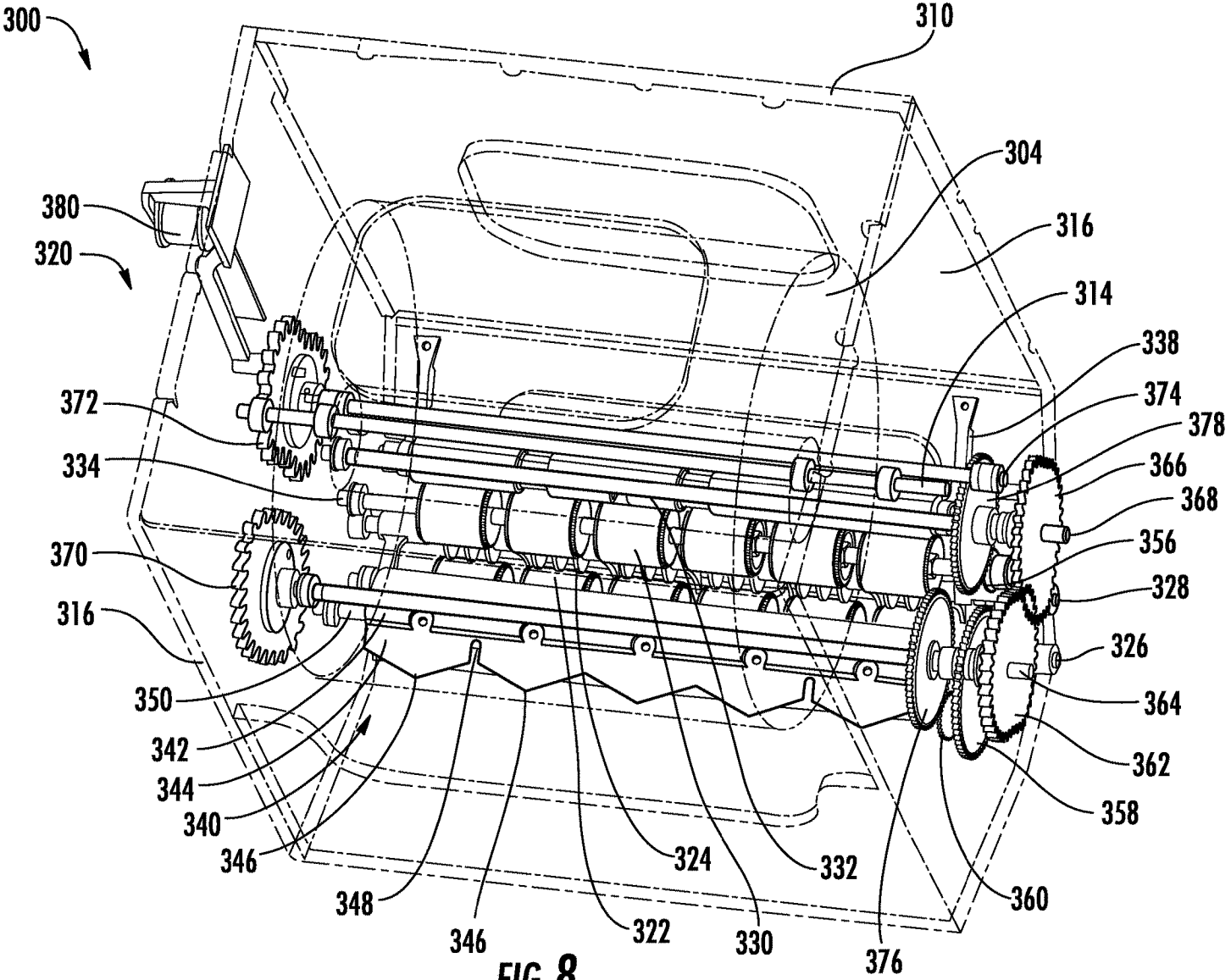
FIG. 8 is a perspective view of the example mechanical hands-free sheet product dispenser of FIG. 7.

FIGS. 7 and 8 show perspective views of an example mechanical hands-free sheet product dispenser 300 in accordance with one or more embodiments of the disclosure. FIGS. 9A-9F show side views of a portion of the dispenser 300 in different states during a dispense cycle. The dispenser 300 may be configured to dispense individual sheets 302 from a roll 304 of non-perforated sheet product. The roll 304 of non-perforated sheet product may be formed in a conventional manner. As is described in detail herein below, the dispenser 300 may be configured to present a tail portion 308 (i.e., an exposed end portion) of the roll 304 to be grasped and pulled by a user during a dispense cycle. Specifically, as is shown, the tail portion 308 may be a leading end portion of the roll 304 to be dispensed during a dispense cycle.

As is shown, the dispenser 300 may include a housing 310, and the roll 304 of non-perforated sheet product may be disposed within the housing 310 for dispensing the individual sheets 302 therefrom. The roll 304 may be rotatably supported within the housing 310 by a roll support, such as a roll shaft 314 attached to opposing side walls 316 of the housing 310. In some embodiments, the housing 310 may include a dispenser outlet 318 defined in a wall thereof, such as a front wall or a bottom wall of the housing. The dispenser 300 may be configured to present the tail portion 308 extending from the dispenser outlet 318 and out of the housing 310 to be grasped and pulled by a user.

The dispenser 300 also may include a mechanical dispensing mechanism 320 disposed within the housing 310 and configured to guide and advance the sheet product from the roll 304 during a dispense cycle. The mechanical dispensing mechanism 320 may include a number of rollers configured to guide and advance the sheet product from the roll 304 during a dispense cycle as a user grasps and pulls the tail portion 308 to impart a driving force thereto. Specifically, the number of rollers may include a first drive roller 322 and a first pinch roller 324 attached to the housing 310 and configured to receive the sheet product therebetween. The first drive roller 322 and the first pinch roller 324 may be configured to engage and grip the sheet product throughout the dispense cycle. As is shown, the first drive roller 322 may be positioned about and coupled to a first drive roller axle 326 supported by the side walls 316 of the housing 310 and allowing the first drive roller 322 to rotate with respect to the housing 310. The first pinch roller 324 similarly may be positioned about and coupled to a first pinch roller axle 328 supported by the housing 310 and allowing the first pinch roller 324 to rotate with respect to the housing 310. The number of rollers also may include a second drive roller 330 and a second pinch roller 332 attached to the housing 310 and configured to receive the sheet product therebetween. The second drive roller 330 and the second pinch roller 332 may be configured to engage and grip the sheet product throughout the dispense cycle. As is shown, the second drive roller 330 may be positioned about and coupled to a second drive roller axle 334 supported by the side walls 316 of the housing 310 and allowing the second drive roller 330 to rotate with respect to the housing 310. The second pinch roller 332 similarly may be positioned about and coupled to a second pinch roller axle 336 supported by the housing 310 via a second pinch roller arm 338 and allowing the second pinch roller 332 to rotate with respect to the housing 310.

The mechanical dispensing mechanism 320 also may include a cutting mechanism 340 configured to guide and cut the sheet product during a dispense cycle to define an individual sheet 302 to be dispensed to a user. The cutting mechanism 340 may include a drum 342 and a cutting knife 344. As is shown, the cutting knife 344 may be coupled to the drum 342 and may include a plurality of teeth 346 extending outward from the drum 342. The teeth 346 may be configured to penetrate and cut the sheet product during a portion of the dispense cycle to at least partially define the individual sheet 302 to be dispensed to the user. The cutting knife 344 also may include one or more notches 348 defined between one or more adjacent pairs of the teeth 346. The notches 348 may be configured to allow the individual sheet 302 to remain partially connected to a remainder of the roll 304 of sheet product after the teeth 346 penetrate and cut the sheet product. In other words, the cutting knife 344 may be configured to cut the sheet product to partially define the individual sheet 302, while allowing the individual sheet 302 to remain connected to the remainder of the roll 304 via small strips of sheet product corresponding to the notches 348. As is shown, the drum 342 may be positioned about and coupled to a drum axle 350 supported by the side walls 316 of the housing 310 and allowing the drum 342 to rotate with respect to the housing 310.

The mechanical dispensing mechanism 320 also may include a number of gears configured to drive the second drive roller 330 at a varying rate throughout a dispense cycle, as is described in detail below. Specifically, the number of gears may include a first drive roller gear 354 positioned about and coupled to the first drive roller axle 326 supported by the housing 310 and allowing the first drive roller gear 354 to rotate with respect to the housing 310. As is shown, the first drive roller gear 354 may be a circular gear. The number of gears also may include a second drive roller gear 356 positioned about and coupled to the second drive roller axle 334 supported by the housing 310 and allowing the second drive roller gear 356 to rotate with respect to the housing 310. As is shown, the second drive roller gear 356 may be a circular gear. The number of gears also may include first and second drum gears 358, 360 each positioned about and coupled to the drum axle 350 supported by the housing 310 and allowing the first and second drum gears 358, 360 to rotate with respect to the housing 310. As is shown, the first and second drum gears 358, 360 may be circular gears, and the first drum gear 358 may engage the first drive roller gear 354 throughout the dispense cycle.

The number of gears also may include a first non-circular gear 362 positioned about and coupled to a first non-circular gear axle 364 supported by the housing 310 and allowing the first non-circular gear 362 to rotate with respect to the housing 310. As is shown, the first non-circular gear 362 may have a customized shape including segments with constant pitch radius and other segments with smooth and continuously changing pitch radii. The number of gears also may include a second non-circular gear 366 positioned about and coupled to a second non-circular gear axle 368 supported by the housing 310 and allowing the second non-circular gear 366 to rotate with respect to the housing 310. As is shown, the second non-circular gear 366 may have a customized shape that complements the shape of the first non-circular gear 362 and may engage the first non-circular gear 362 throughout the dispense cycle. The number of gears also may include a third non-circular gear 370 positioned about and coupled to the first non-circular gear axle 364 supported by the housing 310 and allowing the third non-circular gear 370 to rotate with respect to the housing 310. As is shown, the third non-circular gear 370 may have a shape that has a continually changing pitch radius that is customized to deliver a desired dispenser performance. The number of gears also may include a fourth non-circular gear 372 positioned about and coupled to a fourth non-circular gear axle 374 supported by the housing 310 and allowing the fourth non-circular gear 372 to rotate with respect to the housing 310. As is shown, the fourth non-circular gear 372 may have a shape that complements the shape of the third non-circular gear 370 and may engage the third non-circular gear 370 throughout the dispense cycle.

The number of gears also may include a first transfer gear 376 positioned about and coupled to the first non-circular gear axle 364 supported by the housing 310 and allowing the first transfer gear 376 to rotate with respect to the housing 310. As is shown, the first transfer gear 376 may be a circular gear that engages the second drum gear 360 throughout the dispense cycle. The number of gears also may include a second transfer gear 378 positioned about and coupled to the second non-circular gear axle 368 supported by the housing 310 and allowing the second transfer gear 378 to rotate with respect to the housing 310. As is shown, the second transfer gear 378 may be a circular gear that engages the second drive roller gear 356 throughout the dispense cycle.

The mechanical dispensing mechanism 320 also may include a tail spring 380, such as a coil spring, coupled to the fourth non-circular gear 372 and the housing 310, as is shown. As is described in detail below, the tail spring 380 may be configured to extend and store energy as the fourth non-circular gear 372 rotates with respect to the housing 310 during a portion of the dispense cycle, and to retract and release the stored energy as the fourth non-circular gear 372 rotates with respect to the housing 310 during another portion of the dispense cycle.

Figure 9A:
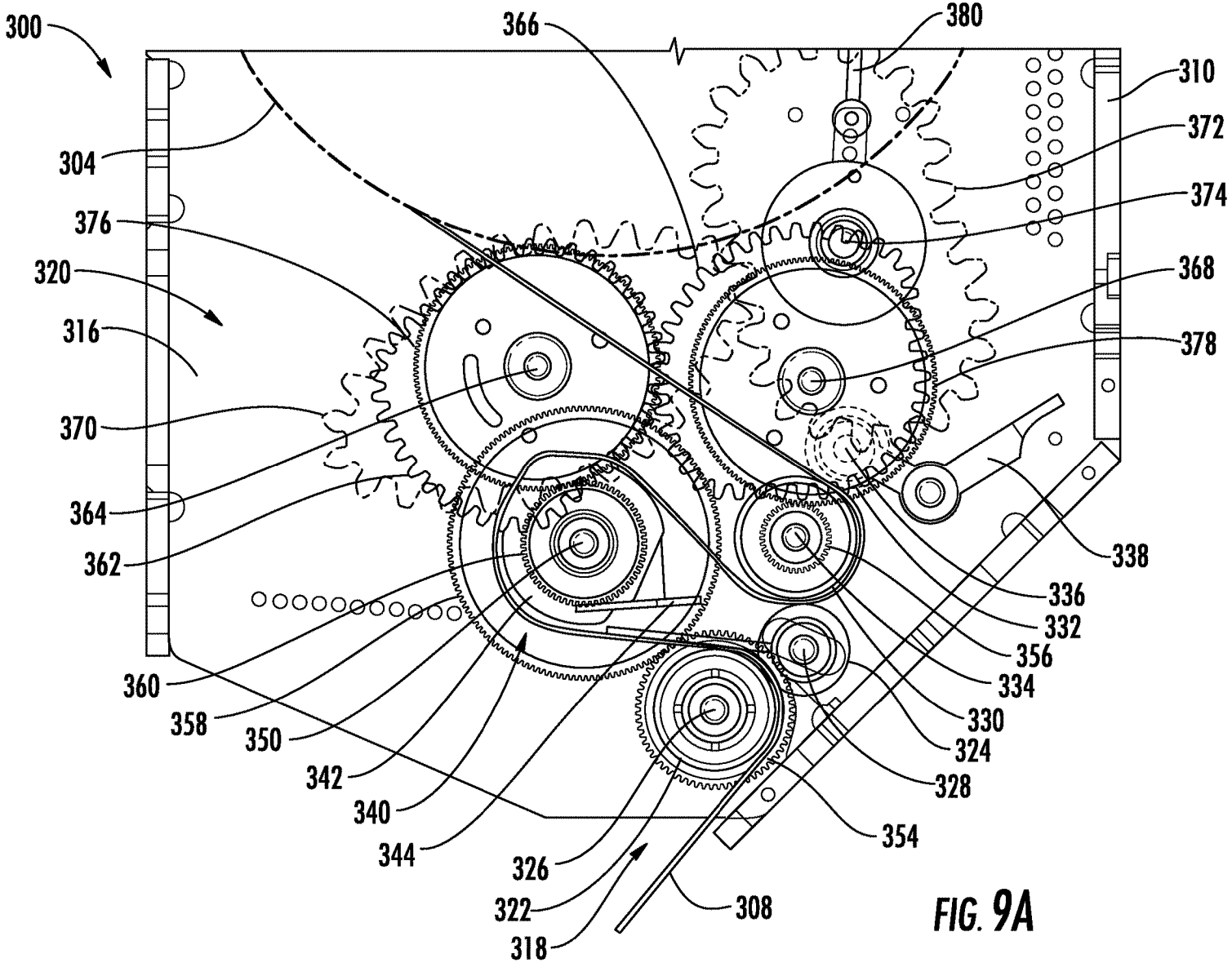
FIG. 9A is a side view of a portion of the example mechanical hands-free sheet product dispenser of FIG. 7, showing a mechanical dispensing mechanism in a first state during a dispense cycle.

FIGS. 9A-9F show side views of the mechanical dispensing mechanism 320 in a number of different states during a dispense cycle as may be carried out using the dispenser 300. FIG. 9A shows the mechanical dispensing mechanism 320 in a first state of the dispense cycle, in which the tail portion 308 (the exposed end portion of the roll 304) is presented and available to be grasped and pulled by a user. In the first state, the first drive roller 322 and the first pinch roller 324 are engaging and gripping a portion of the sheet product received therebetween, while the second drive roller 330 and the second pinch roller 332 are engaging and gripping another portion of the sheet product therebetween. Meanwhile, the drum 342 is loosely engaging yet another portion of the sheet product disposed thereover, and the cutting knife 344 is oriented such that it does not engage the sheet product. In other words, the portion of the sheet product disposed over drum 342 has some slack, as is shown. In the first state, the tail spring 380 is retracted and has its shortest length of the dispense cycle.

The user pulls the tail portion 308 downward to impart a driving force to the sheet product to carry out the dispense cycle. As the user initially pulls the tail portion 308 downward, the first drive roller 322 and the first pinch roller 324 continue to grip a portion of the sheet product received therebetween, which causes the first drive roller 322 to rotate (clockwise in the side views shown) along with the first drive roller axle 326. The rotation of the first drive roller axle 326 causes the first drive roller gear 354 to rotate (clockwise), which causes first drum gear 358 to rotate (counter-clockwise) along with the drum axle 350. The rotation of the drum axle 350 causes the cutting mechanism 340 and the second drum gear 360 to rotate (both counter-clockwise), which causes the first transfer gear 376 to rotate (clockwise) along with the first non-circular gear axle 364. The rotation of the first non-circular gear axle 364 causes the first non-circular gear 362 and the third non-circular gear 370 to rotate (both clockwise). The rotation of the third non-circular gear 370 causes the fourth non-circular gear 372 to rotate (counter-clockwise) along with the fourth non-circular gear axle 374, which causes the tail spring 380 to extend downward and store energy. The rotation of the first non-circular gear 362 causes the second non-circular gear 366 to rotate (counter-clockwise) along with the second non-circular gear axle 368, which causes the second transfer gear 378 to rotate (counter-clockwise). The rotation of the second transfer gear 378 causes the second drive roller gear 356 to rotate (clockwise) along with the second drive roller axle 334, which causes the second drive roller 330 to rotate (clockwise) and advance the engaged portion of the sheet product. In this manner, initial pulling of the tail portion 308 downward by the user causes the first drive roller 322 to rotate (clockwise), which ultimately causes the second drive roller 330 to rotate (clockwise) and the tail spring 380 to extend and store energy.

As discussed above, by their nature, the first and second non-circular gears 362, 366 have a varying gear ratio, which is dependent upon the orientation of the non-circular gears 362, 366 throughout a rotation thereof. Accordingly, an output of the first and second non-circular gears 362, 366 to the second drive roller 330 (via the second non-circular gear axle 368, the second transfer gear 378, the second drive roller gear 356, and the second drive roller axle 334) varies throughout the dispense cycle, and thus the non-circular gears 362, 366 drive the second drive roller 330 at a varying rate throughout the dispense cycle. In the first state of the dispense cycle, the first and second non-circular gears 362, 366 are in an orientation in which the output to the second drive roller 330 is slow compared to the input from the initial pulling of the tail portion 308. Accordingly, as the user initially pulls the tail portion 308, the second drive roller 330 rotates at a slower rate than the tail portion 308 is pulled and the first drive roller 322 rotates.

Figure 9B:
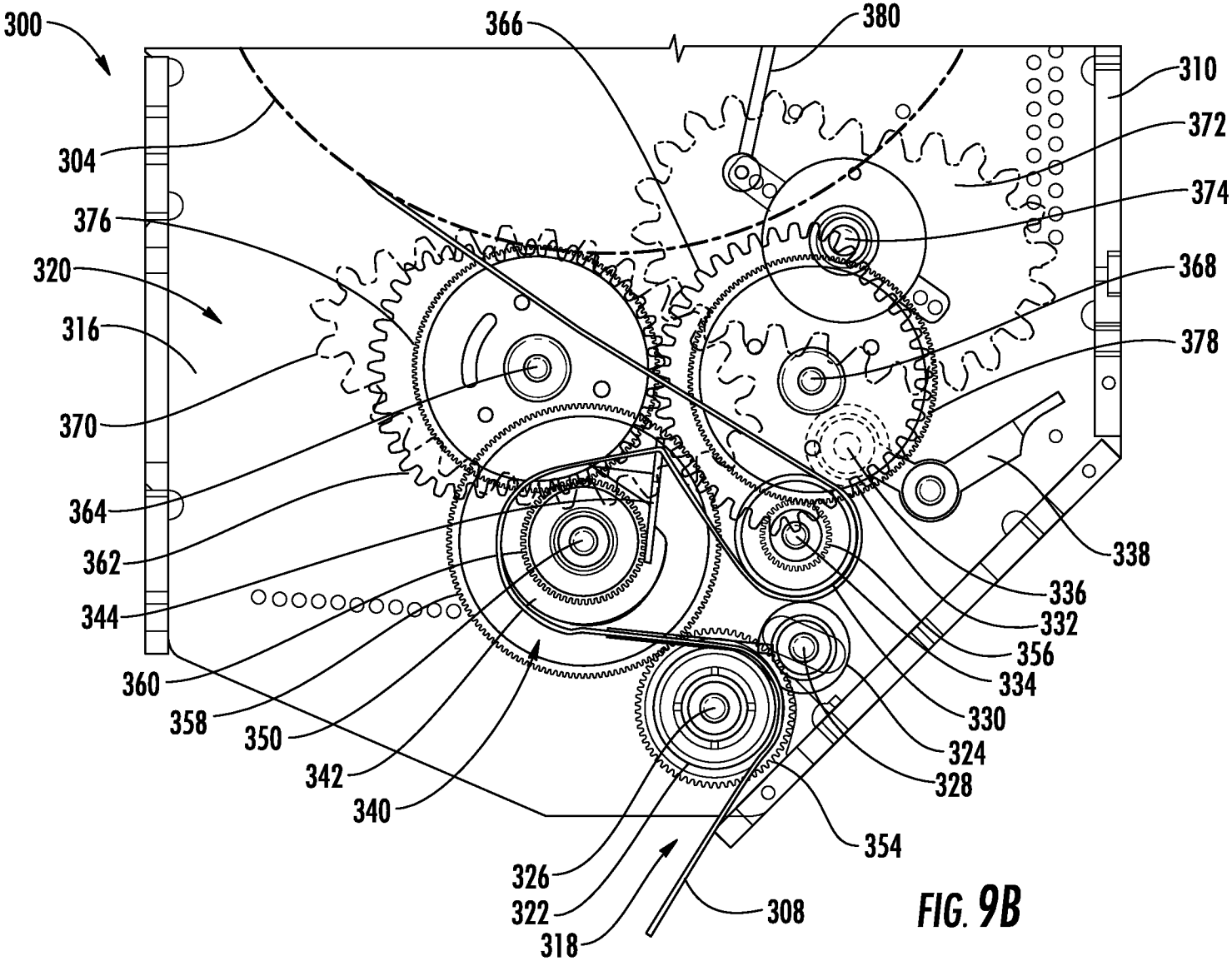
FIG. 9B is a side view of a portion of the example mechanical hands-free sheet product dispenser of FIG. 7, showing the mechanical dispensing mechanism in a second state during the dispense cycle.

FIG. 9B shows the mechanical dispensing mechanism 320 in a second state of the dispense cycle, following initial pulling of the tail portion 308. In the second state, the first drive roller 322 and the first pinch roller 324 continue to engage and grip a portion of the sheet product received therebetween, while the second drive roller 330 and the second pinch roller 332 continue to engage and grip another portion of the sheet product therebetween. As described above, the second drive roller 330 has rotated at a slower rate than the tail portion 308 has been pulled and the first drive roller 322 has rotated. In this manner, some of the slack has been removed from the portion of the sheet product disposed over the drum 342. In the second state, the cutting mechanism 340 has rotated such that the cutting knife 344 engages and begins to cut the sheet product. Further, as is shown, the fourth non-circular gear 372 has rotated and caused the tail spring 380 to extend downward and store energy. As the user continues to pull the tail portion 308, the various gears continue to rotate as described above and the tail spring 380 continues to extend and store more energy. Further, as the user continues to pull the tail portion 308, the second drive roller 330 continues to rotate at a slower rate than the tail portion 308 is pulled and the first drive roller 322 rotates, thereby causing the sheet product to be pulled more tightly over the cutting mechanism 340.

Figure 9C:
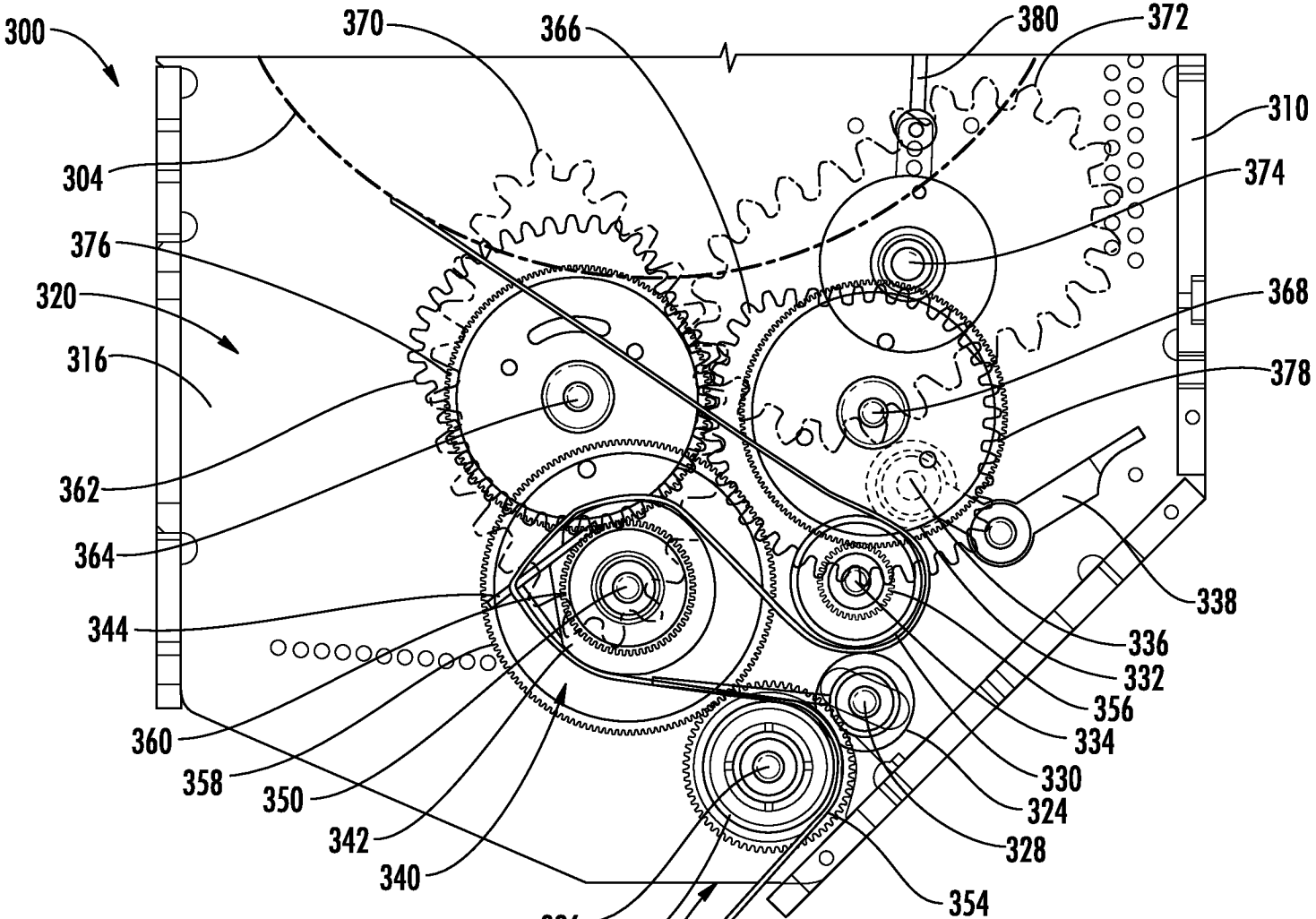
FIG. 9C is a side view of a portion of the example mechanical hands-free sheet product dispenser of FIG. 7, showing the mechanical dispensing mechanism in a third state during the dispense cycle.

FIG. 9C shows the mechanical dispensing mechanism 320 in a third state of the dispense cycle, following continued pulling of the tail portion 308. In the third state, the first drive roller 322 and the first pinch roller 324 continue to engage and grip a portion of the sheet product received therebetween, while the second drive roller 330 and the second pinch roller 332 continue to engage and grip another portion of the sheet product therebetween. In the third state, the cutting mechanism 340 has rotated such that portions of the teeth 346 of the cutting knife 344 have cut through the sheet product to partially define the individual sheet 302 to be dispensed to the user. However, the individual sheet 302 remains connected to the remainder of the roll 304, as described above. Further, as is shown, the fourth non-circular gear 372 has rotated further and caused the tail spring 380 to extend further downward and store more energy. As the user continues to pull the tail portion 308, the various gears continue to rotate as described above and the tail spring 380 continues to extend and store more energy. Further, as the user continues to pull the tail portion 308, the second drive roller 330 continues to rotate at a slower rate than the tail portion 308 is pulled and the first drive roller 322 rotates, thereby causing the sheet product to be pulled more tightly over the cutting mechanism 340.

Figure 9D:
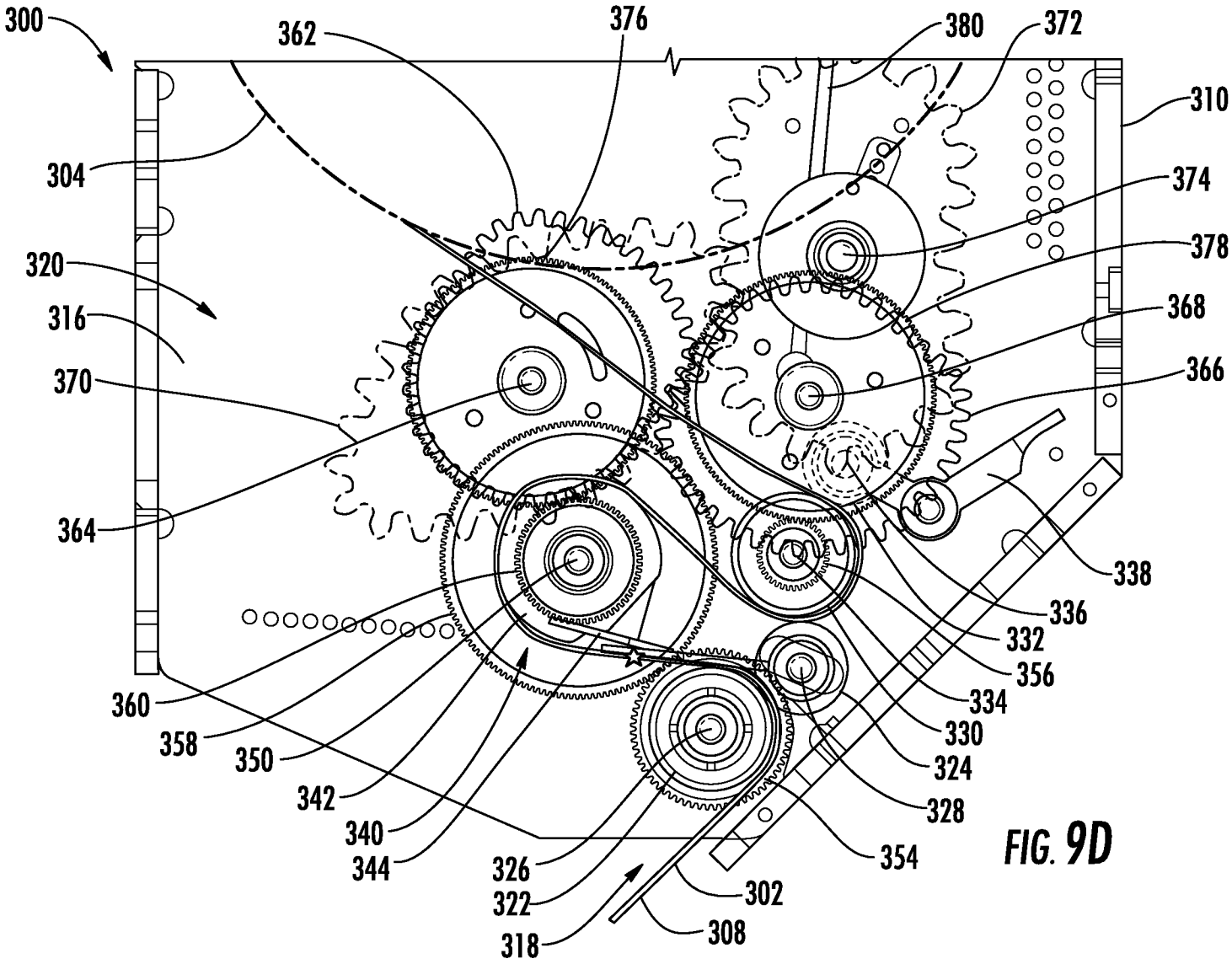
FIG. 9D is a side view of a portion of the example mechanical hands-free sheet product dispenser of FIG. 7, showing the mechanical dispensing mechanism in a fourth state during the dispense cycle.

FIG. 9D shows the mechanical dispensing mechanism 320 in a fourth state of the dispense cycle, following continued pulling of the tail portion 308. In the fourth state, the first drive roller 322 and the first pinch roller 324 continue to engage and grip a portion of the sheet product received therebetween, while the second drive roller 330 and the second pinch roller 332 continue to engage and grip another portion of the sheet product therebetween. In the fourth state, the cutting mechanism 340 has rotated such that the cutting knife 344 disengages the sheet product. As described above, the individual sheet 302 remains connected to the remainder of the roll 304 via small strips of sheet product corresponding to the notches 348 of the cutting knife 344. Further, as is shown, the fourth non-circular gear 372 has rotated further and caused the tail spring 380 to extend further downward and store more energy. In the fourth state, the tail spring 380 is almost fully extended. As the user continues to pull the tail portion 308, the various gears continue to rotate as described above and the tail spring 380 continues to extend and store more energy until reaching its longest length of the dispense cycle. At that point, the tail spring 380 begins to retract and release the stored energy, which reduces the driving force required from the user. Further, in the fourth state, the first and second non-circular gears 362, 366 are in an orientation in which the output to the second drive roller 330 is fast compared to the input from the continued pulling of the tail portion 308. Accordingly, as the user continues to pull the tail portion 308, the second drive roller 330 rotates at a faster rate than the tail portion 308 is pulled and the first drive roller 322 rotates, thereby causing the sheet product disposed over the cutting mechanism 340 to have some slack between the first drive roller 322 and the second drive roller 330.

Figure 9E:
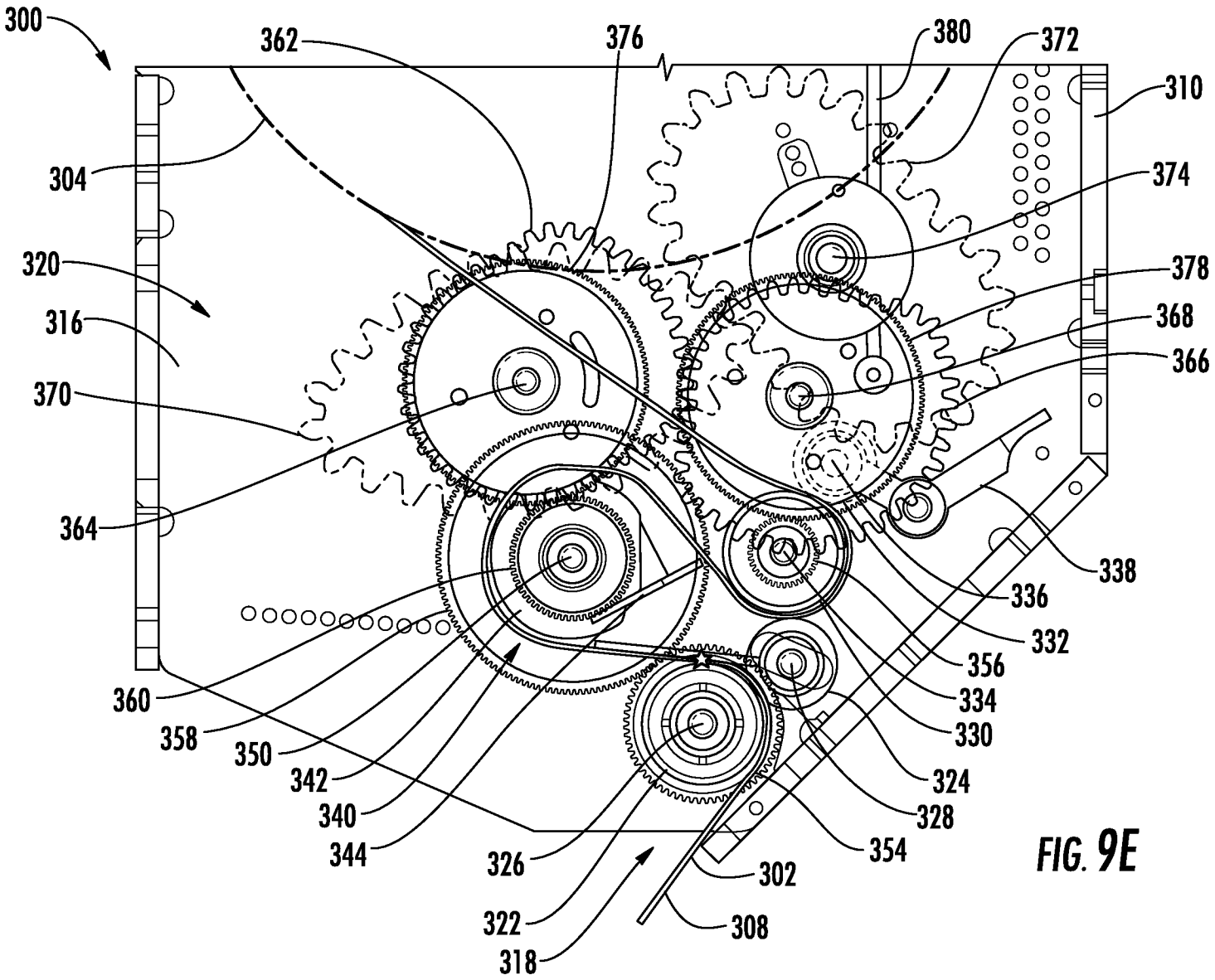
FIG. 9E is a side view of a portion of the example mechanical hands-free sheet product dispenser of FIG. 7, showing the mechanical dispensing mechanism in a fifth state during the dispense cycle.

FIG. 9E shows the mechanical dispensing mechanism 320 in a fifth state of the dispense cycle, following continued pulling of the tail portion 308. In the fifth state, the first drive roller 322 and the first pinch roller 324 continue to engage and grip a portion of the sheet product received therebetween, while the second drive roller 330 and the second pinch roller 332 continue to engage and grip another portion of the sheet product therebetween. In the fifth state, the cutting mechanism 340 has rotated such that the cutting knife 344 begins to engage the sheet product again. Further, as is shown, the fourth non-circular gear 372 has rotated further, and the tail spring 380 has retracted and released some of the stored energy, thereby reducing the driving force required from the user. In the fifth state, the lagging end of the individual sheet 302 engages the first drive roller 322, as is shown. As the user continues to pull the tail portion 308, the various gears continue to rotate as described above and the tail spring 380 continues to retract and release more energy. Further, as the user continues to pull the tail portion 308, the second drive roller 330 continues to rotate at a faster rate than the tail portion 308 is pulled and the first drive roller 322 rotates, thereby causing the sheet product disposed over the cutting mechanism 340 to have more slack.

Figure 9F:
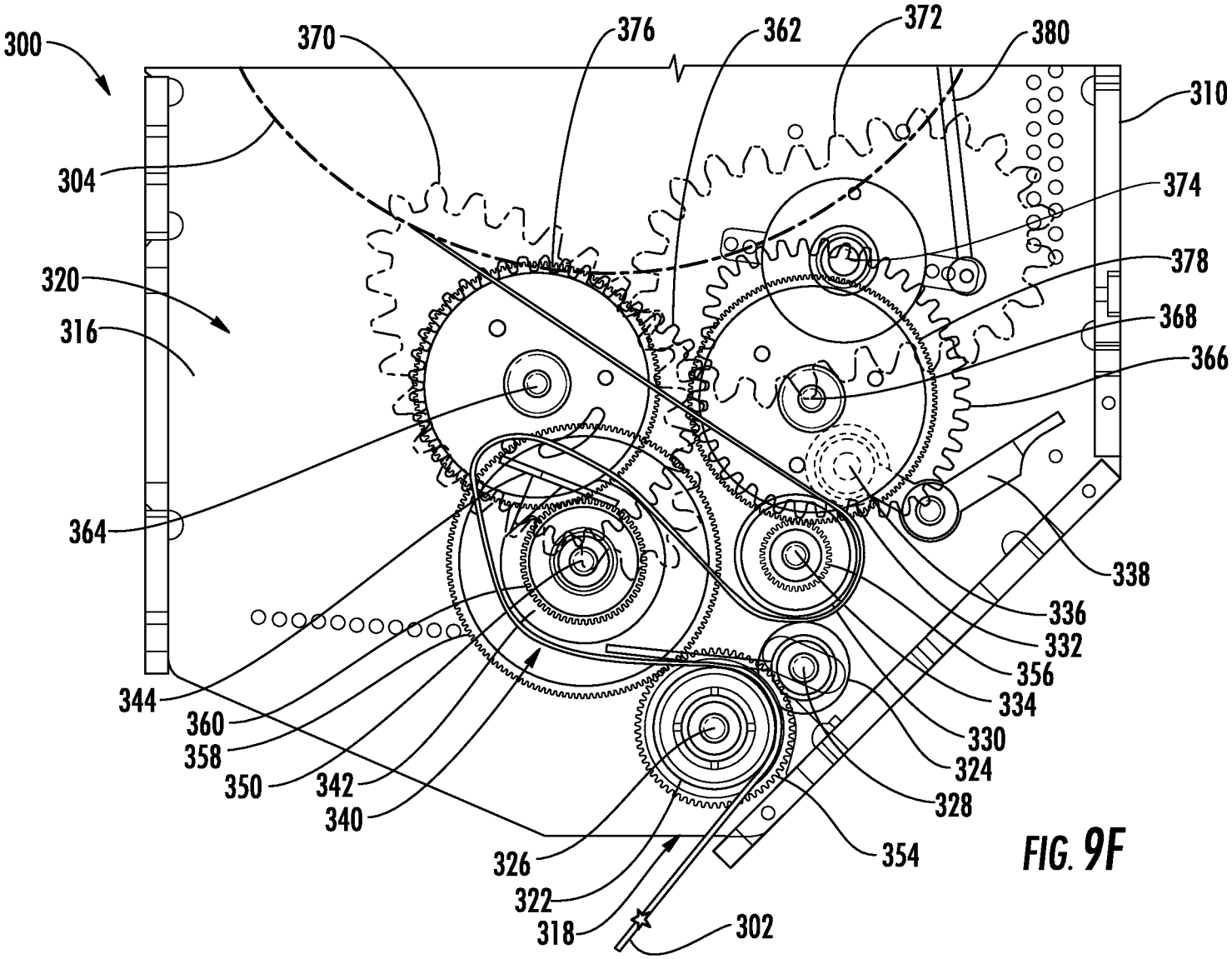
FIG. 9F is a side view of a portion of the example mechanical hands-free sheet product dispenser of FIG. 7, showing the mechanical dispensing mechanism in a sixth state during the dispense cycle.

FIG. 9F shows the mechanical dispensing mechanism 320 in a sixth state of the dispense cycle, following continued pulling of the tail portion 308. In the sixth state, the first drive roller 322 and the first pinch roller 324 continue to engage and grip a portion of the sheet product received therebetween, while the second drive roller 330 and the second pinch roller 332 continue to engage and grip another portion of the sheet product therebetween. In the sixth state, the cutting mechanism 340 has rotated such that the cutting knife 344 continues to engage the sheet product. However, due to the slack in the sheet product disposed over the cutting mechanism 340, the cutting knife 344 does not cut the sheet product. Further, as is shown, the fourth non-circular gear 372 has rotated further, and the tail spring 380 has retracted and released more of the stored energy, thereby reducing the driving force required from the user and facilitating advancement of the sheet product. In the sixth state, the lagging end of the individual sheet 302 has disengaged the first drive roller 322 and passed through the dispenser outlet 318, as is shown. As the tail spring 380 continues to retract and release more energy, the first and second drive rollers 322, 330 continue to rotate and advance the sheet product to present a new tail portion 308, as the mechanical dispensing mechanism 320 returns to the first state, as is shown in FIG. 9A, and is ready to begin a subsequent dispense cycle. Ultimately, as the user pulls against the tail spring 380 in the subsequent dispense cycle, the small strips of sheet product connecting the individual sheet 302 to the remainder of the roll 304 are exposed to enough tension to separate the individual sheet 302 from the remainder of the roll 304.

The dispenser 300 may be configured to dispense individual sheets 302 having a predetermined sheet length (i.e., the cutting mechanism 340 cuts the sheet product at a predetermined distance from the exposed end of the roll 304), which may depend on the type of sheet product dispensed. For example, the dispenser 300 may be configured to dispense individual sheets 302 of paper towels having a predetermined sheet length of 8.5 inches. Based on the configuration and operation of the mechanical dispensing mechanism 320, the sheet length may be equal to a sum of a length of the tail portion 308 (a "tail length") and a length over which a user pulls the tail portion 308 (a "pull length") during the dispense cycle. For example, the dispenser 300 may be configured to dispense individual sheets 302 having a sheet length of 8.5 inches, wherein the tail length is 4.25 inches and the pull length is 4.25 inches. It will be understood that the dimensions of the dispenser 300, particularly the mechanical dispensing mechanism 320, and the individual sheets 302 may be selected depending upon the type of sheet product to be dispensed.

The mechanical dispensing mechanism 320 of dispenser 300 may provide significant advantages over mechanical dispensing mechanisms of known hands-free sheet product dispensers. In particular, the various non-circular gears of the mechanical dispensing mechanism 320 may provide significant advantages over conventional circular gears used in known mechanical dispensing mechanisms.

As described above, the first and second non-circular gears 362, 366 may be configured to drive the second drive roller 330 at a varying speed throughout a dispense cycle. Specifically, the first and second non-circular gears 362, 366 may be configured to drive the second drive roller 330 at a lower speed than the first drive roller 322 during a first portion of the dispense cycle, and to drive the second drive roller 330 at a higher speed than the first drive roller 322 during a second portion of the dispense cycle. The portions of the first and second non-circular gears 362, 366 that mesh during the first portion of the dispense cycle may have a constant pitch radius, wherein the pitch radius of the first non-circular gear 362 is less than the pitch radius of the second non-circular gear 366, as is shown. Further, the portions of the first and second non-circular gears 362, 366 that mesh during the second portion of the dispense cycle may have a constant pitch radius, wherein the pitch radius of the first non-circular gear 362 is greater than the pitch radius of the second non-circular gear 366, as is shown. In this manner, the first and second non-circular gears 362, 366 may maintain a constant first gear ratio during the first portion of the dispense cycle and a constant second gear ratio during the second portion of the dispense cycle.

As described above, the third and fourth non-circular gears 370, 372 may be configured to cause the tail spring 380 to extend and store energy during a first portion of the dispense cycle, and to be at least partially driven by the tail spring 380 as the tail spring 380 retracts and releases the stored energy during a second portion of the dispense cycle. In this manner, a portion of the pull force required to carry out the dispense cycle is used to extend the tail spring 380 throughout the first portion of the dispense cycle. As is shown, the third and fourth non-circular gears 370, 372 may have varying radius relationships with respect to one another throughout the dispense cycle. Specifically, in the first state (FIG. 9A), the third non-circular gear 370 may have a larger pitch radius than the fourth non-circular gear 372, while the tail spring 380 is retracted and at its shortest length. Accordingly, as the user pulls the tail portion 308 and the third and fourth non-circular gears 370, 372 rotate as described above, the fourth non-circular gear 372 rotates at a higher rate than the third non-circular gear 370, which causes the tail spring 380 to quickly assume a position where it can extend and store energy. Following continued pulling of the tail portion 308 and rotation of the third non-circular gear 370 about ninety degrees (FIG. 9C), the fourth non-circular gear 372 may have a larger pitch radius than the third non-circular gear 370, which causes the tail spring 380 to slowly extend and store energy. Following continued pulling of the tail portion 308 and rotation of the third non-circular gear 370 about another ninety degrees (FIG. 9E), the third non-circular gear 370 again may have a larger pitch radius than the fourth non-circular gear 372, which allows the tail spring to quickly assume a position where it can retract and release stored energy to facilitate advancement of the sheet product. Accordingly, the third and fourth non-circular gears 370, 372 may reduce the pull force required at this point of the dispense cycle. According to different embodiments, the third and fourth non-circular gears 370, 372 may have various radius relationships that affect the peak force required to extend the tail spring 380 and the energy input required to extend the tail spring 380 (and thus also the energy output from the tail spring 380).

Ultimately, as compared to known dispensers, the dispenser 300 may allow a lower pull force (i.e., a driving force imparted by a user) required for a given sheet length and tail length. Additionally, as compared to known dispensers, the dispenser 300 may allow a lower paper strength required for a given sheet length and tail length, due to the lower pull force allowed. Moreover, as compared to known dispensers, the dispenser 300 may generate a greater amount of energy from a given pull force, which may provide greater reliability in presenting a tail portion. Further, as compared to known dispensers, the dispenser 300 may enable use of a smaller drum and thus a smaller housing, as the drum 342 of the cutting mechanism 340 completes two rotations during a dispense cycle instead of only one. Additionally, as compared to known dispensers, the dispenser 300 may enable a simpler cutting mechanism, as the cutting knife 344 is fixed relative to the drum 342.

Figure 10:
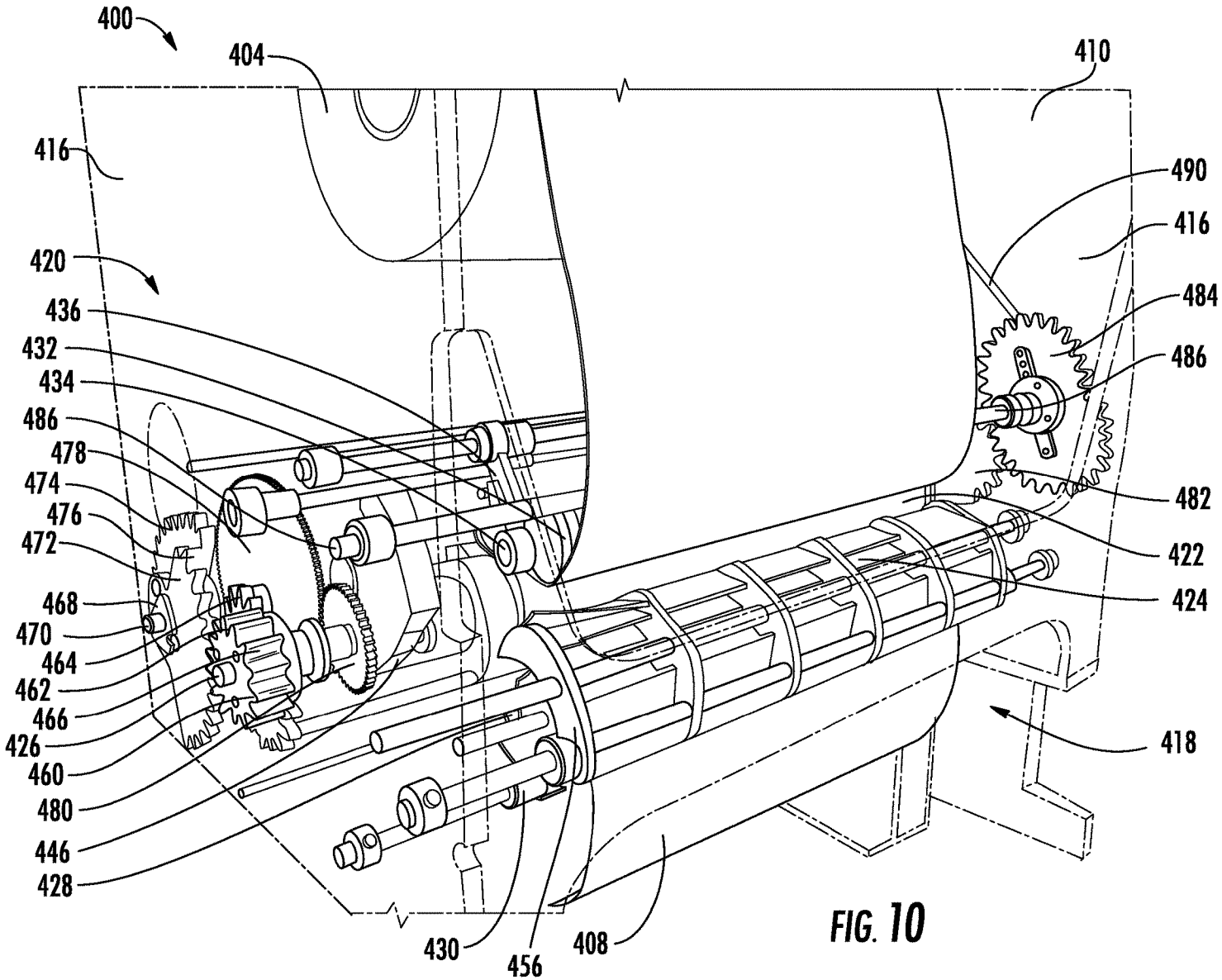
FIG. 10 is a perspective view of an example mechanical hands-free sheet product dispenser in accordance with one or more embodiments of the disclosure.
Figure 11:
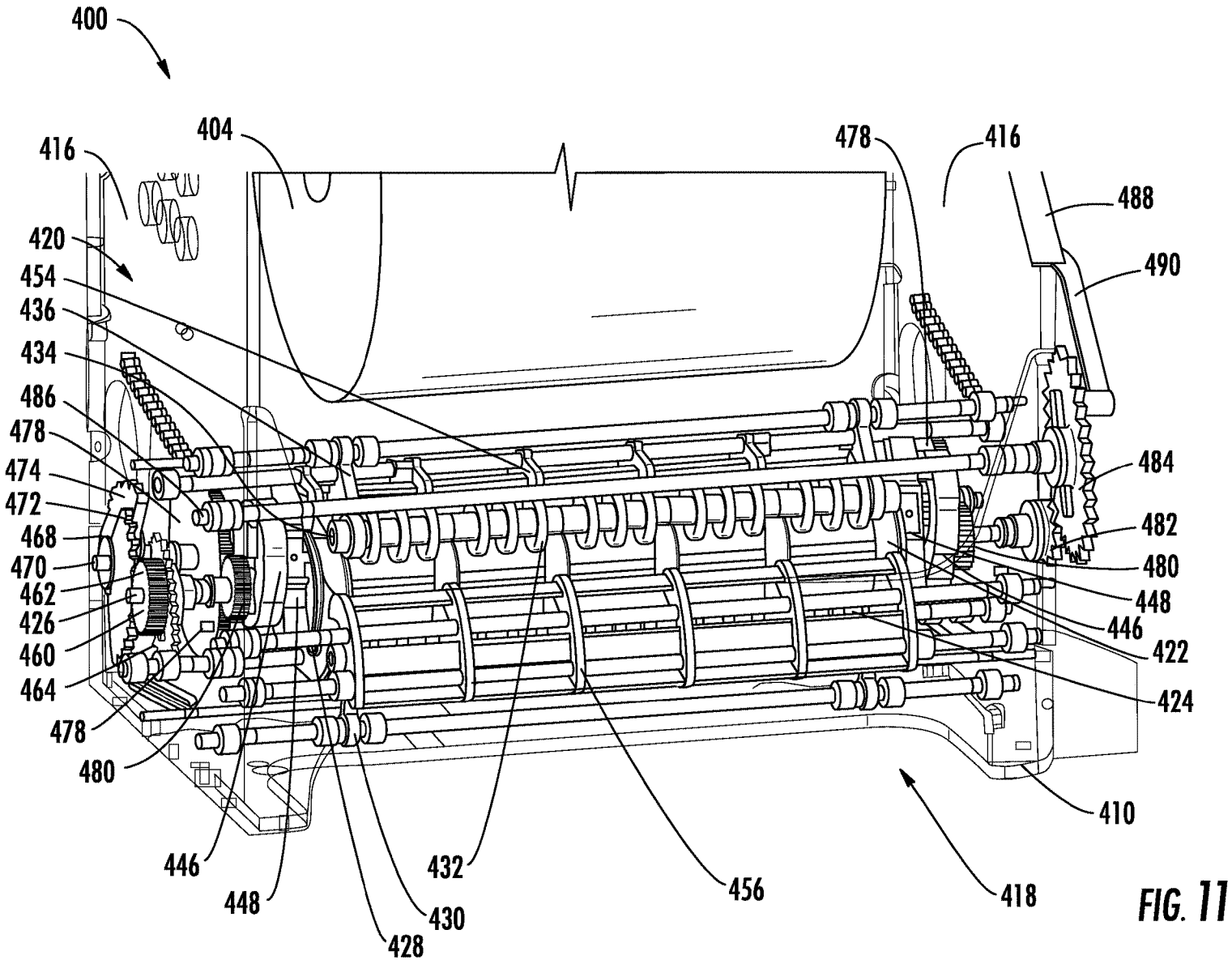
FIG. 11 is a perspective view of the example mechanical hands-free sheet product dispenser of FIG. 10.
Figure 12:
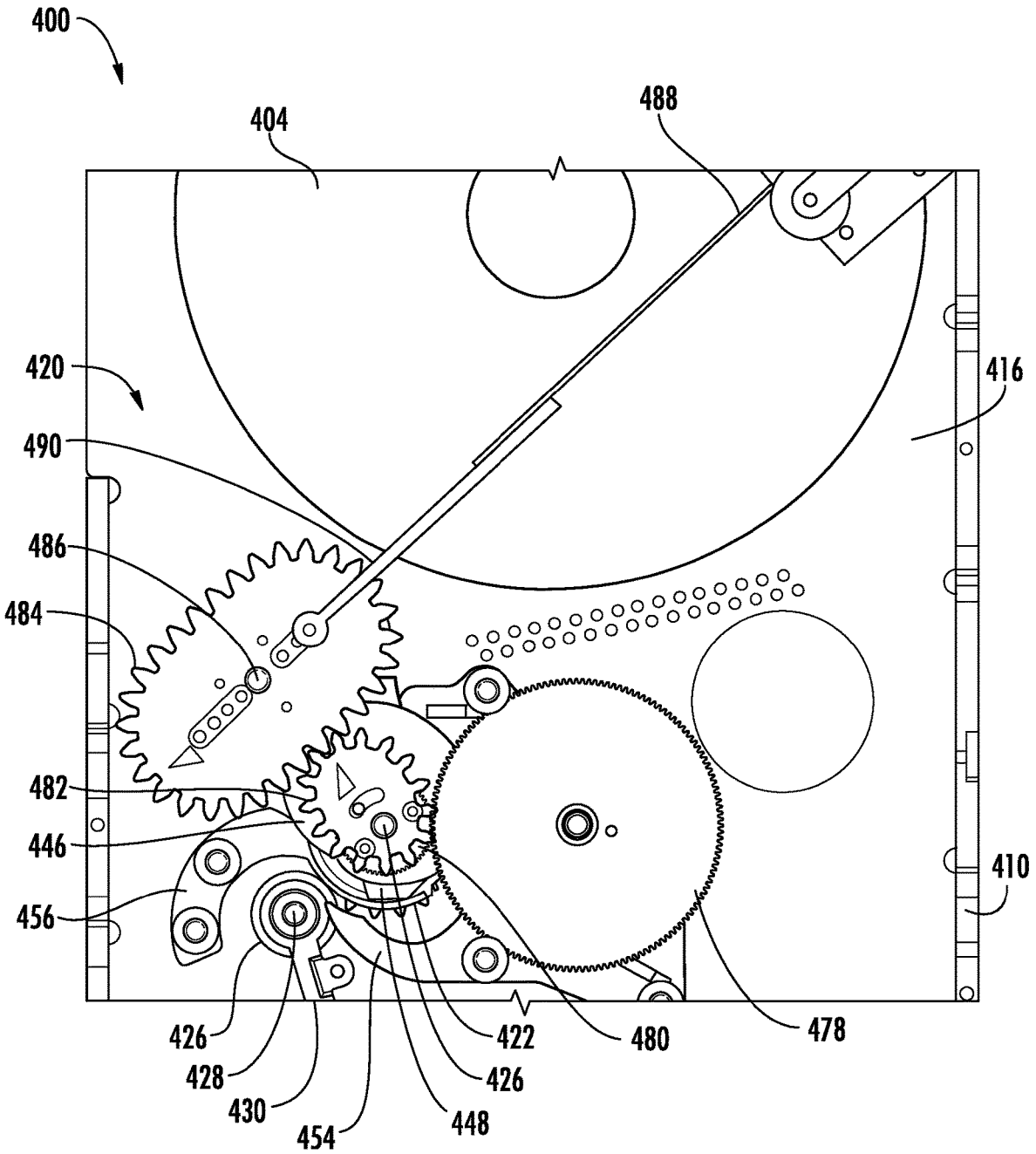
FIG. 12 is a detailed side view of a portion of the example mechanical hands-free sheet product dispenser of FIG. 10.
Figure 13:
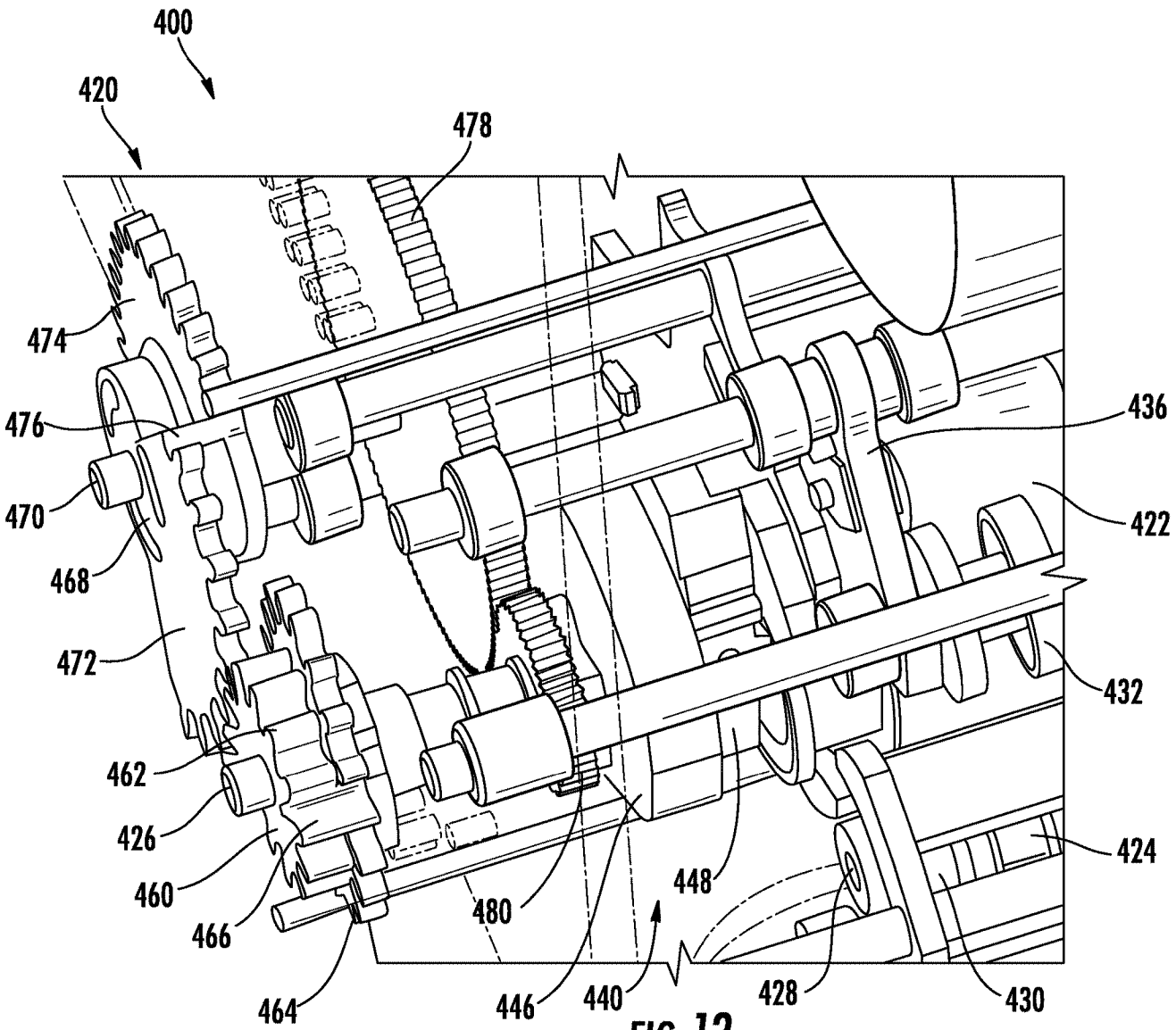
FIG. 13 is a detailed perspective view of a portion of the example mechanical hands-free sheet product dispenser of FIG. 10.
Figure 14:
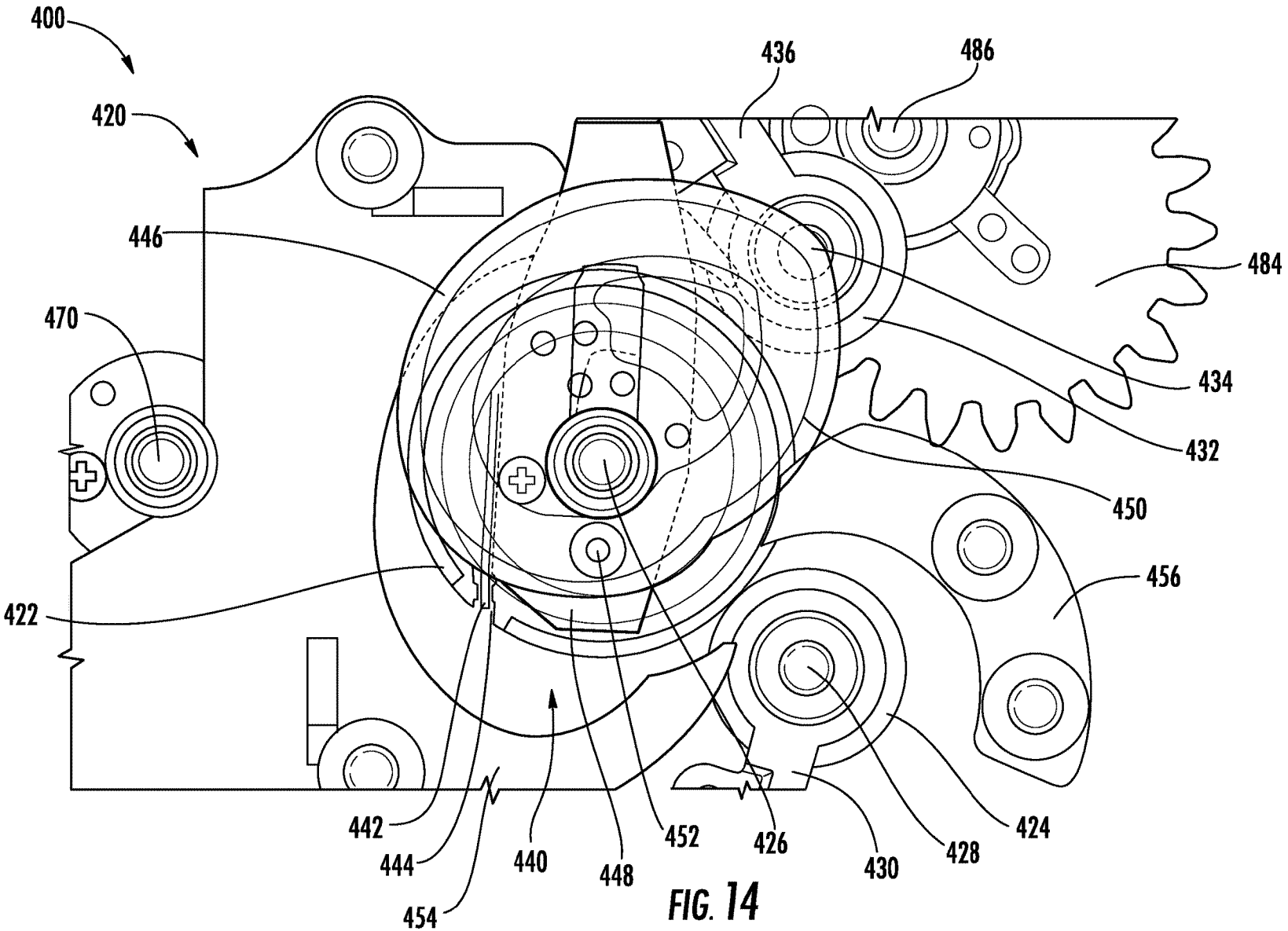
FIG. 14 is a detailed side view of a portion of the example mechanical hands-free sheet product dispenser of FIG. 10.

FIGS. 10 and 11 show perspective views of an example mechanical hands-free sheet product dispenser 400 in accordance with one or more embodiments of the disclosure. FIGS. 12-14 show detailed views of portions of the dispenser 400. FIGS. 15A-15E show side views of a portion of the dispenser 400 in different states during a dispense cycle. The dispenser 400 may be configured to dispense individual sheets 402 from a roll 404 of non-perforated sheet product. The roll 404 of non-perforated sheet product may be formed in a conventional manner. As is described in detail herein below, the dispenser 400 may be configured to present a tail portion 408 (i.e., an exposed end portion) of the roll 404 to be grasped and pulled by a user during a dispense cycle. Specifically, as is shown, the tail portion 408 may be a leading end portion of the roll 404 to be dispensed during a dispense cycle.

As is shown, the dispenser 400 may include a housing 410, and the roll 404 of non-perforated sheet product may be disposed within the housing 410 for dispensing the individual sheets 402 therefrom. The roll 404 may be rotatably supported within the housing 410 by a roll support, such as a roll shaft 414 attached to opposing side walls 416 of the housing 410. In some embodiments, the housing 410 may include a dispenser outlet 418 defined in a wall thereof, such as a front wall or a bottom wall of the housing. The dispenser 400 may be configured to present the tail portion 408 extending from the dispenser outlet 418 and out of the housing 410 to be grasped and pulled by a user.

The dispenser 400 also may include a mechanical dispensing mechanism 420 disposed within the housing 410 and configured to guide and advance the sheet product from the roll 404 during a dispense cycle. The mechanical dispensing mechanism 420 may include a number of rollers configured to guide and advance the sheet product from the roll 404 during a dispense cycle as a user grasps and pulls the tail portion 408 to impart a driving force thereto. Specifically, the number of rollers may include a drum 422 and a first pinch roller 424 attached to the housing 410 and configured to receive the sheet product therebetween. The drum 422 and the first pinch roller 424 may be configured to engage and grip the sheet product throughout the dispense cycle. As is shown, the drum 422 may be positioned about and coupled to a drum axle 426 supported by the side walls 416 of the housing 410 and allowing the drum 422 to rotate with respect to the housing 410. The first pinch roller 424 may be positioned about and coupled to a first pinch roller axle 428 supported by the housing 410 via a first pinch roller arm 430 and allowing the first pinch roller 424 to rotate with respect to the housing 410. The number of rollers also may include a second pinch roller 432 attached to the housing 410, and the drum 422 and the second pinch roller 432 may be configured to receive the sheet product therebetween. The drum 422 and the second pinch roller 432 may be configured to engage and grip the sheet product throughout the dispense cycle. As is shown, the second pinch roller 432 may be positioned about and coupled to a second pinch roller axle 434 supported by the housing 410 via a second pinch roller arm 436 and allowing the second pinch roller 432 to rotate with respect to the housing 410.

The mechanical dispensing mechanism 420 also may include a cutting mechanism 440 configured to guide and cut the sheet product during a dispense cycle to define an individual sheet 402 to be dispensed to a user. The cutting mechanism 440 may include a cutting knife 442 movably coupled to the drum 422. The cutting knife 442 may be configured to move from a retracted position, in which the cutting knife 442 is received within a slot 444 defined in the drum 422, to an extended position, in which at least a portion of the cutting knife 442 extends out of the slot 444. The cutting knife 442 may include a plurality of teeth configured to penetrate and cut the sheet product during a portion of the dispense cycle to at least partially define the individual sheet 402 to be dispensed to the user. The cutting knife 442 also may include one or more notches defined between one or more adjacent pairs of the teeth. The notches may be configured to allow the individual sheet 402 to remain partially connected to a remainder of the roll 404 of sheet product after the teeth penetrate and cut the sheet product. In other words, the cutting knife 442 may be configured to cut the sheet product to partially define the individual sheet 402, while allowing the individual sheet 402 to remain connected to the remainder of the roll 404 via small strips of sheet product corresponding to the notches.

The cutting mechanism 440 also may include a pair of cams 446 and a pair of sliders 448. The cams 446 may be positioned about and free to rotate with respect to (i.e., not coupled to) the drum axle 426 supported by the housing 410. As is shown, one of the cams 446 may be positioned near one end of the drum 422, and the other cam 446 may be positioned near the other end of the drum 422. Each of the cams 446 may include a cam track 450 defined therein and providing a profile having a varying distance from the longitudinal axis of the drum axle 426. The sliders 448 may be positioned about and free to translate with respect to (i.e., not coupled to) the drum axle 426 supported by the housing 410. As is shown, one of the sliders 448 may be positioned between the one cam 446 and the one end of the drum 422, and the other slider 448 may be positioned between the other cam 446 and the other end of the drum 422. Each of the sliders 448 may include a cam follower 452 extending into the cam track 450 of the respective cam 446. The cam follower 452 may be a protrusion configured to travel along the profile of the cam track 450 as the cam 446 rotates with respect to the drum axle 426. In this manner, as the cams 446 rotate with respect to the drum axle 426, the sliders 448 may translate with respect to the drum axle 426. The sliders 448 may be rigidly coupled to respective ends of the cutting knife 442. In this manner, as the sliders 448 translate with respect to the drum axle 426, the cutting knife 442 may move between the retracted position and the extended position.

The mechanical dispensing mechanism 420 also may include a first sheet product guide 454 extending around a top of the drum 422, a rear side of the drum 422, and a bottom of the drum 422, as is shown. In this manner, the first sheet product guide 454 may be configured to guide the sheet product over and around the drum 422 and from the drum 422 toward the first pinch roller 424. The mechanical dispensing mechanism 420 also may include a second sheet product guide 456 extending around a top of the first pinch roller 424 and a front side of the first pinch roller 424, as is shown. In this manner, the second sheet product guide 456 may be configured to guide the sheet product over and around the first pinch roller 424 and from the first pinch roller 424 toward the user.

The mechanical dispensing mechanism 420 also may include a number of gears configured to drive the cams 446 at a varying rate throughout a dispense cycle, as is described in detail below. Specifically, the number of gears may include a first non-circular gear 460 positioned about and coupled to the drum axle 426 supported by the housing 410 and allowing the first non-circular gear 460 to rotate with respect to the housing 410. As is shown, the first non-circular gear 460 may include a first step 462 and a second step 464 that are offset from one another along a longitudinal axis of the first non-circular gear 460. The first step 462 may have a generally constant pitch radius, the second step 464 may have a generally constant pitch radius, and the pitch radius of the first step 462 may be less than the pitch radius of the second step 464. The first non-circular gear 460 may include a common tooth 466 that spans both the first step 462 and the second step 464. The number of gears also may include a second non-circular gear 468 positioned about and coupled to a second non-circular gear axle 470 supported by the housing 410 and allowing the second non-circular gear 468 to rotate with respect to the housing 410. As is shown, the second non-circular gear 468 may include a first step 472 and a second step 474 that are offset from one another along a longitudinal axis of the second non-circular gear 468. The first step 472 may have a generally constant pitch radius, the second step 474 may have a generally constant pitch radius, and the pitch radius of the first step 472 may be greater than the pitch radius of the second step 474. The second non-circular gear 468 may include transition teeth 476 that span between the first step 472 and the second step 474. As is shown, the first non-circular gear 460 may engage the second non-circular gear 468 throughout the dispense cycle. Specifically, the first step 462 of the first non-circular gear 460 may engage the first step 472 of the second non-circular gear 468 during a portion of the dispense cycle, and the second step 464 of the first non-circular gear 460 may engage the second step 474 of the second non-circular gear 468 during another portion of the dispense cycle.

The number of gears also may include a pair of first transfer gears 478 positioned about and coupled to the second non-circular gear axle 470 supported by the housing 410 and allowing the first transfer gears 478 to rotate with respect to the housing 410. As is shown, one of the first transfer gears 478 may be positioned near one end of the second non-circular gear axle 470, and the other first transfer gear 478 may be positioned near the other end of the second non-circular gear axle 470. The first transfer gears 478 may be circular gears, as is shown. The number of gears also may include a pair of second transfer gears 480 positioned about and free to rotate with respect to (i.e., not coupled to) the drum axle 426 supported by the housing 410. As is shown, one of the second transfer gears 480 may be positioned near one end of the drum axle 426, and the other second transfer gear 480 may be positioned near the other end of the drum axle 426. The second transfer gears 480 may be respectively coupled to the cams 446 such that the cams 446 are configured to rotate along with the second transfer gears 480 about the drum axle 426. As is shown, the second transfer gears 480 may be circular gears that respectively engage the first transfer gears 478 throughout the dispense cycle.

The number of gears also may include a third non-circular gear 482 positioned about and coupled to the drum axle 426 supported by the housing 410 and allowing the third non-circular gear 482 to rotate with respect to the housing 410. As is shown, the third non-circular gear 482 may have a generally elliptical shape. The number of gears also may include a fourth non-circular gear 484 positioned about and coupled to a fourth non-circular gear axle 486 supported by the housing 410 and allowing the fourth non-circular gear 484 to rotate with respect to the housing 410. As is shown, the fourth non-circular gear 484 may have a generally discorectangular or stadium shape, and the fourth non-circular gear 484 may engage the third non-circular gear 482 throughout the dispense cycle.

The mechanical dispensing mechanism 420 also may include a tail spring 488, such as a constant-force spring, coupled to the fourth non-circular gear 484 and the housing 410, as is shown. The tail spring 488 may be coupled to the fourth non-circular gear 484 via a tail spring arm 490 pivotally attached to the fourth non-circular gear 484, as is shown. As is described in detail below, the tail spring 488 may be configured to extend and store energy as the fourth non-circular gear 484 rotates with respect to the housing 410 during a portion of the dispense cycle, and to retract and release the stored energy as the fourth non-circular gear 484 rotates with respect to the housing 410 during another portion of the dispense cycle.

Figure 15A:
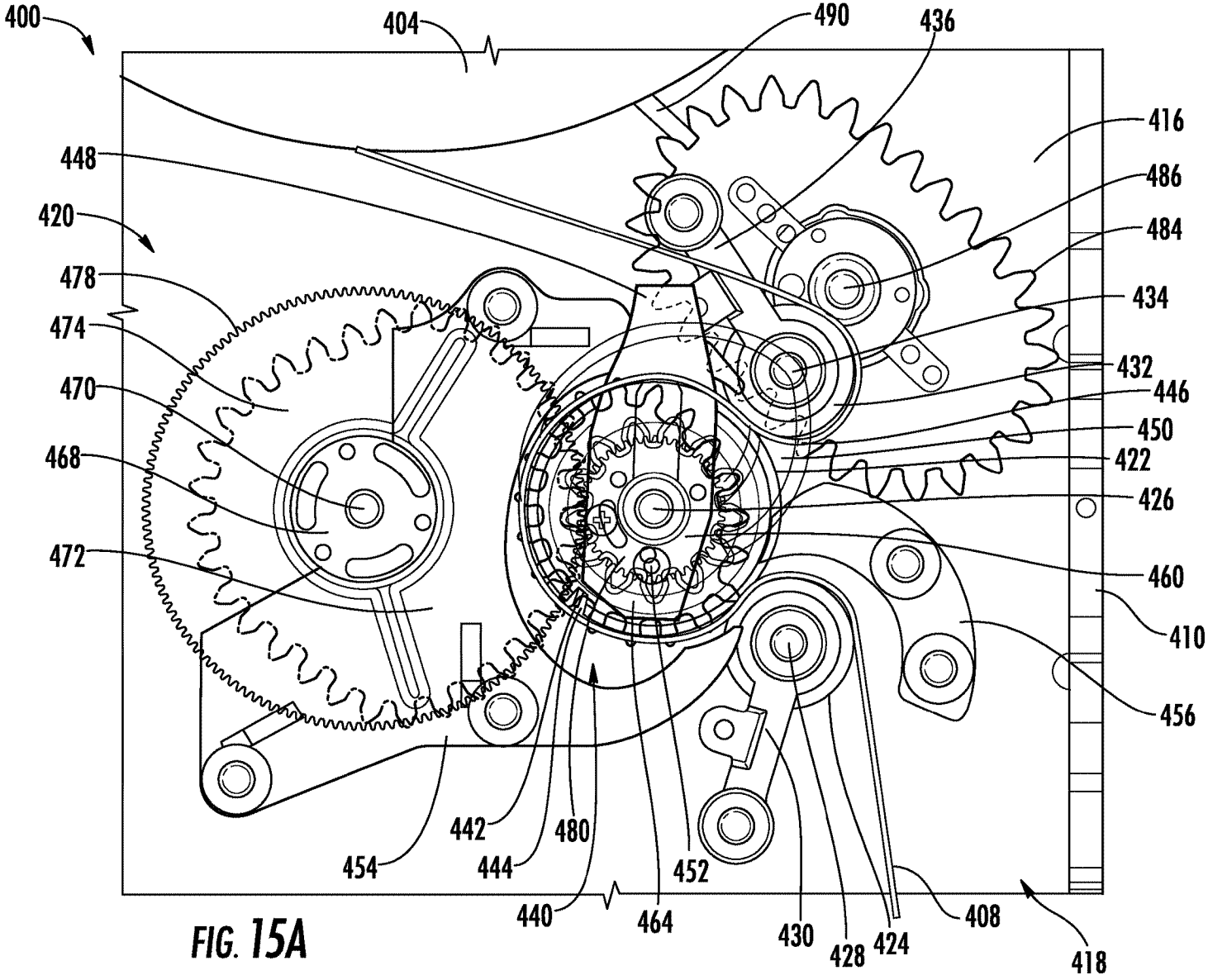
FIG. 15A is a side view of a portion of the example mechanical hands-free sheet product dispenser of FIG. 10, showing a mechanical dispensing mechanism in a first state during a dispense cycle.

FIGS. 15A-15E show side views of the mechanical dispensing mechanism 420 in a number of different states during a dispense cycle as may be carried out using the dispenser 400. FIG. 15A shows the mechanical dispensing mechanism 420 in a first state of the dispense cycle, in which the tail portion 408 (the exposed end portion of the roll 404) is presented and available to be grasped and pulled by a user. In the first state, the drum 422 and the first pinch roller 424 are engaging and gripping a portion of the sheet product received therebetween, while the drum 422 and the second pinch roller 432 are engaging and gripping another portion of the sheet product received therebetween. Meanwhile, the top, rear side, and bottom of the drum 422 are engaging yet another portion of the sheet product disposed thereover, while the cutting knife 442 is in the retracted position within the slot 444 such that the cutting knife 442 does not engage the sheet product. In the first state, the tail spring 488 is retracted at a bottom-dead-center orientation, and thus the tail spring 488 has its shortest length of the dispense cycle.

The user pulls the tail portion 408 downward to impart a driving force to the sheet product to carry out the dispense cycle. As the user initially pulls the tail portion 408 downward, the drum 422 and the first pinch roller 424 continue to grip a portion of the sheet product received therebetween, which causes the drum 422 to rotate (counter-clockwise in the side views shown) along with the drum axle 426. The rotation of the drum axle 426 causes the first non-circular gear 460 and the third non-circular gear 482 to rotate (both counter-clockwise). The rotation of the first non-circular gear 460 causes the second non-circular gear 468 to rotate (clockwise) along with the second non-circular gear axle 470, which causes the first transfer gears 478 to rotate (clockwise). The rotation of the first transfer gears 478 causes the second transfer gears 480 to rotate (counter-clockwise) along with the cams 446. The rotation of the third non-circular gear 482 causes the fourth non-circular gear 484 to rotate (clockwise), which causes the tail spring 488 to extend downward and store energy. In this manner, initial pulling of the tail portion 408 downward by the user causes the drum 422 to rotate (counter-clockwise), which ultimately causes the cams 446 to rotate (counter-clockwise) and the tail spring 488 to extend and store energy.

As discussed above, by their nature, the first and second non-circular gears 460, 468 have a varying gear ratio, which is dependent upon the orientation of the non-circular gears 460, 468 throughout a rotation thereof. Accordingly, an output of the first and second non-circular gears 460, 468 to the cams 446 (via the second non-circular gear axle 470, the first transfer gears 478, and the second transfer gears 480) varies during the dispense cycle, and thus the non-circular gears 460, 468 drive the cams 446 at a varying rate during the dispense cycle. In the first state of the dispense cycle, the first and second non-circular gears 460, 468 are in an orientation in which the first step 462 of the first non-circular gear 460 engages the first step 472 of the second non-circular gear 468. Based on the pitch radii of the first step 462 of the first non-circular gear 460 and the first step 472 of the second non-circular gear 468 (as well as the pitch radii of the first and second transfer gears 478, 480), the cams 446 rotate at substantially the same rate as the drum 422 rotates. Accordingly, as the user initially pulls the tail portion 408, the cam followers 452 remain at approximately the same position along the cam tracks 450, the sliders 448 remain at approximately the same position with respect to the drum 422, and the cutting knife 442 remains in the retracted position within the slot 444.

Figure 15B:
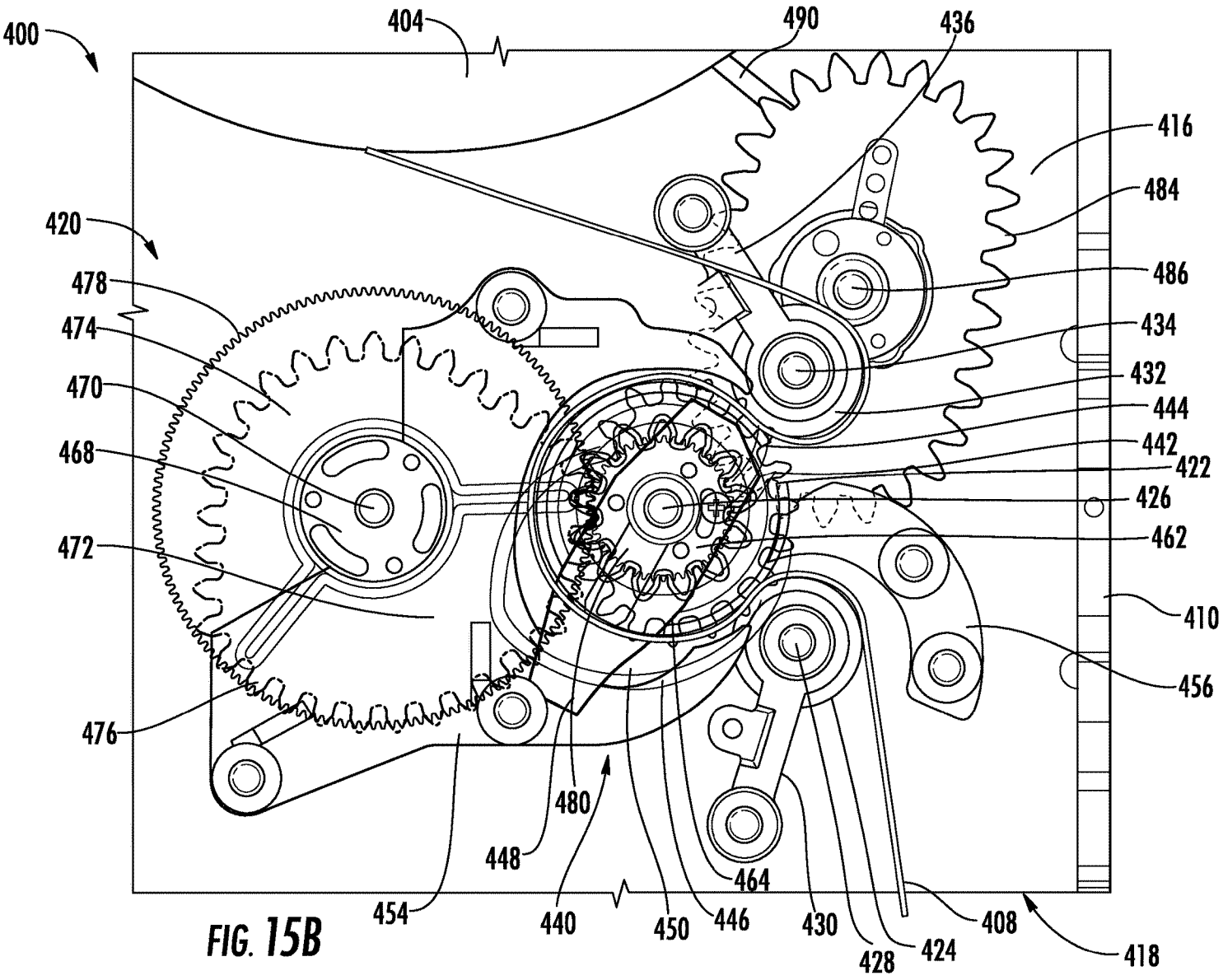
FIG. 15B is a side view of a portion of the example mechanical hands-free sheet product dispenser of FIG. 10, showing the mechanical dispensing mechanism in a second state during the dispense cycle.

FIG. 15B shows the mechanical dispensing mechanism 420 in a second state of the dispense cycle, following initial pulling of the tail portion 408. In the second state, the drum 422 and the first pinch roller 424 continue to engage and grip a portion of the sheet product received therebetween, the drum 422 and the second pinch roller 432 continue to engage and grip another portion of the sheet product received therebetween, and the top, rear side, and bottom of the drum 422 continue to engage yet another portion of the sheet product disposed thereover. As is shown, the drum 422 has rotated approximately 170 degrees. As described above, the cams 446 have rotated at substantially the same rate as the drum 422 has rotated. In this manner, the cam followers 452 remain at approximately the same position along the cam tracks 450, the sliders 448 remain at approximately the same position with respect to the drum 422, and the cutting knife 442 remains in the retracted position within the slot 444. Further, as is shown, the fourth non-circular gear 484 has rotated and caused the tail spring 488 to extend downward and store energy. In the second state, the common tooth 466 of the first non-circular gear 460 is engaging one of the transition teeth 476 of the second non-circular gear 468, as engagement of the first and second non-circular gears 460, 468 transitions from the first steps 462, 472 to the second steps 464, 474. As the user continues to pull the tail portion 408, the various gears continue to rotate as described above, and the tail spring 488 continues to extend and store more energy.

Figure 15C:
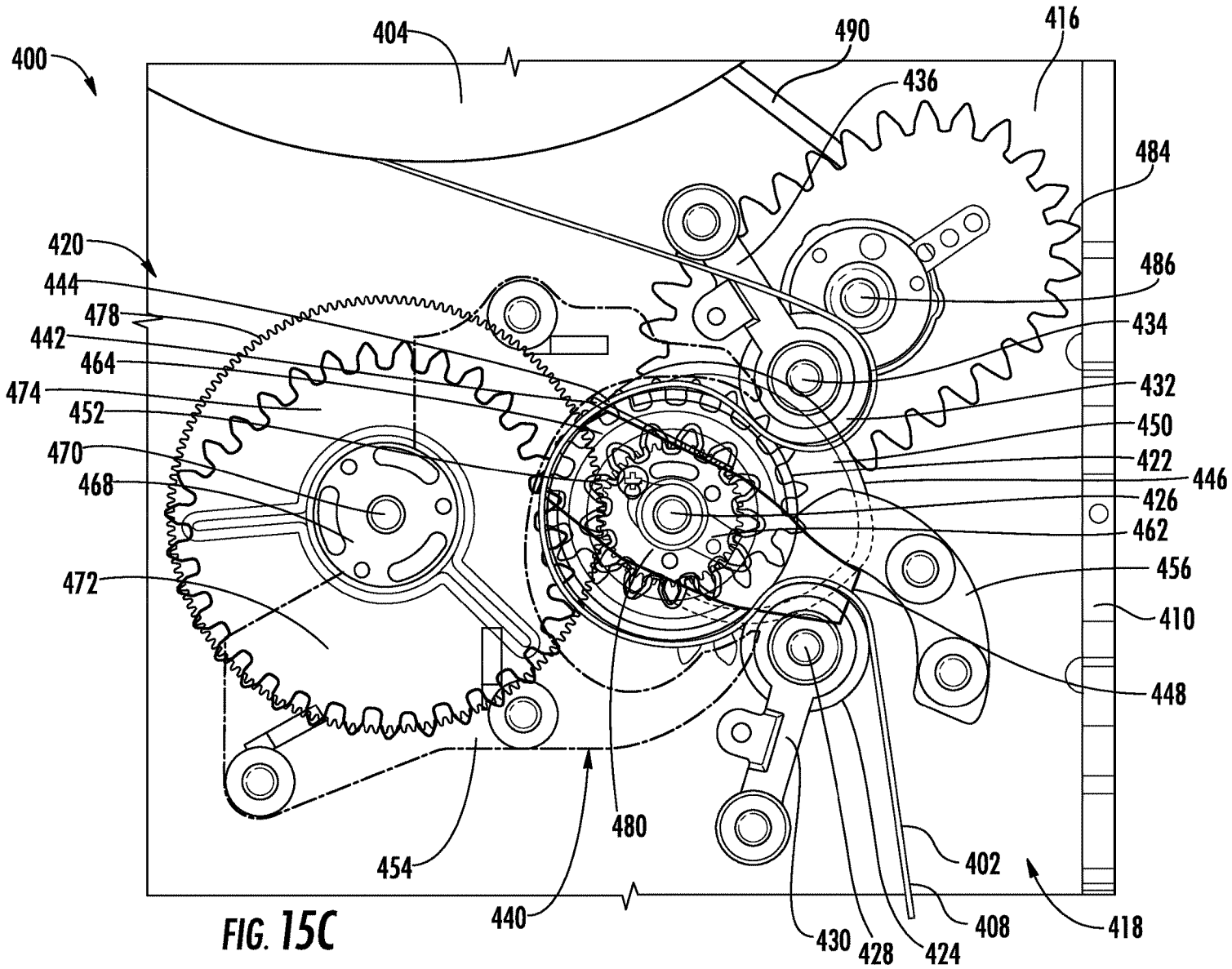
FIG. 15C is a side view of a portion of the example mechanical hands-free sheet product dispenser of FIG. 10, showing the mechanical dispensing mechanism in a third state during the dispense cycle.

FIG. 15C shows the mechanical dispensing mechanism 420 in a third state of the dispense cycle, following continued pulling of the tail portion 408. In the third state, the drum 422 and the first pinch roller 424 continue to engage and grip a portion of the sheet product received therebetween, the drum 422 and the second pinch roller 432 continue to engage and grip another portion of the sheet product received therebetween, and the top, rear side, and bottom of the drum 422 continue to engage yet another portion of the sheet product disposed thereover. As is shown, the drum 422 has further rotated approximately 90 degrees. In the third state of the dispense cycle, the first and second non-circular gears 460, 468 are in an orientation in which the second step 464 of the first non-circular gear 460 engages the second step 474 of the second non-circular gear 468. Based on the pitch radii of the second step 464 of the first non-circular gear 460 and the second step 474 of the second non-circular gear 468 (as well as the pitch radii of the first and second transfer gears 478, 480), the cams 446 rotate at a higher rate than the drum 422 rotates. Accordingly, as the user continues to pull the tail portion 408, the cam followers 452 travel along the cam tracks 450 and move away from the drum axle 426, the sliders 448 translate with respect to the drum axle 426, and the cutting knife 442 moves out of the slot 444 from the retracted position toward the extended position. In this manner, portions of the teeth of the cutting knife 442 begin to engage and cut through the sheet product to partially define the individual sheet 402 to be dispensed to the user. However, the individual sheet 402 remains connected to the remainder of the roll 404, as described above. Further, as is shown, the fourth non-circular gear 484 has rotated further and caused the tail spring 488 to extend further downward and store more energy. As the user continues to pull the tail portion 408, the various gears continue to rotate as described above and the tail spring 488 continues to extend and store more energy. Further, as the user continues to pull the tail portion 408, the cams 446 continue to rotate at a higher rate than the drum 422 rotates, thereby causing the cutting knife 442 to move further out of the slot 444 from the retracted position toward the extended position.

Figure 15D:
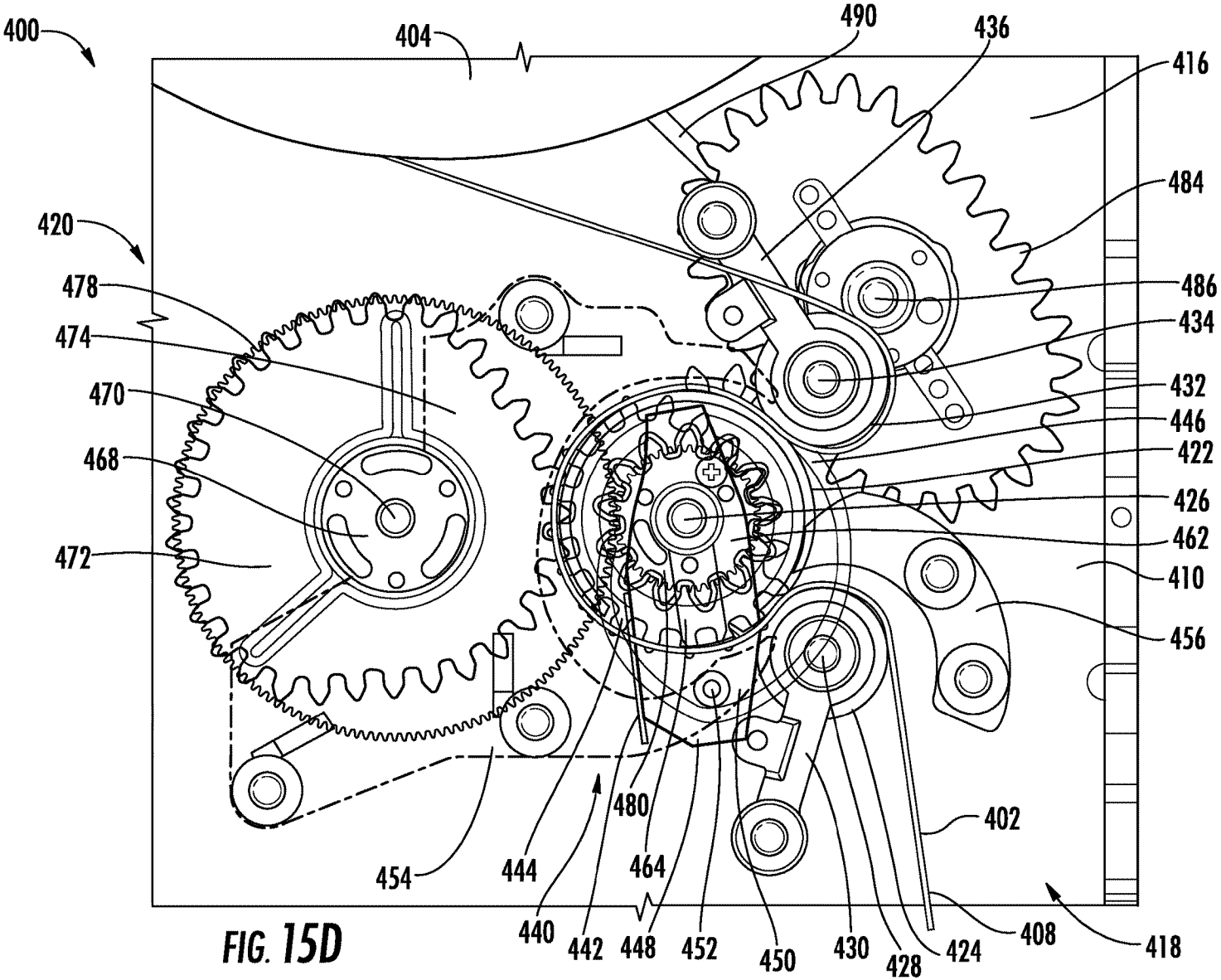
FIG. 15D is a side view of a portion of the example mechanical hands-free sheet product dispenser of FIG. 10, showing the mechanical dispensing mechanism in a fourth state during the dispense cycle.

FIG. 15D shows the mechanical dispensing mechanism 420 in a fourth state of the dispense cycle, following continued pulling of the tail portion 408. In the fourth state, the drum 422 and the first pinch roller 424 continue to engage and grip a portion of the sheet product (a portion of the individual sheet 402) received therebetween, the drum 422 and the second pinch roller 432 continue to engage and grip another portion of the sheet product (a portion of the remainder of the roll 404) received therebetween, and the top, rear side, and bottom of the drum 422 continue to engage yet another portion of the sheet product disposed thereover. As is shown, the drum 422 has further rotated approximately 110 degrees. The cam followers 452 have traveled along the cam tracks 450 and moved further away from the drum axle 426, the sliders 448 have translated further with respect to the drum axle 426, and the cutting knife 442 has moved further out of the slot 444 to the fully extended position. The teeth of the cutting knife 442 have cut through the sheet product to partially define the individual sheet 402 to be dispensed to the user, although the individual sheet 402 remains connected to the remainder of the roll 404, as described above. As the user continues to pull the tail portion 408, the cam followers 452 continue to travel along the cam tracks 450 and now move toward the drum axle 426, the sliders 448 translate with respect to the drum axle 426, and the cutting knife 442 moves into the slot 444 from the extended position toward the retracted position. As is shown, the fourth non-circular gear 484 has rotated further and caused the tail spring 488 to move beyond a top-dead-center orientation, in which the tail spring 488 has its longest length of the dispense cycle. In this manner, the tail spring 488 has begun to retract and release the stored energy, which reduces the driving force required from the user. In the fourth state of the dispense cycle, the first and second non-circular gears 460, 468 are in an orientation in which the second step 464 of the first non-circular gear 460 continues to engage the second step 474 of the second non-circular gear 468. As the user continues to pull the tail portion 408, the various gears continue to rotate as described above and the tail spring 488 continues to retract and release the stored energy. Further, as the user continues to pull the tail portion 408, the cams 446 continue to rotate at a higher rate than the drum 422 rotates, thereby causing the cutting knife 442 to move further into the slot 444 from the extended position toward the retracted position.

Figure 15E:
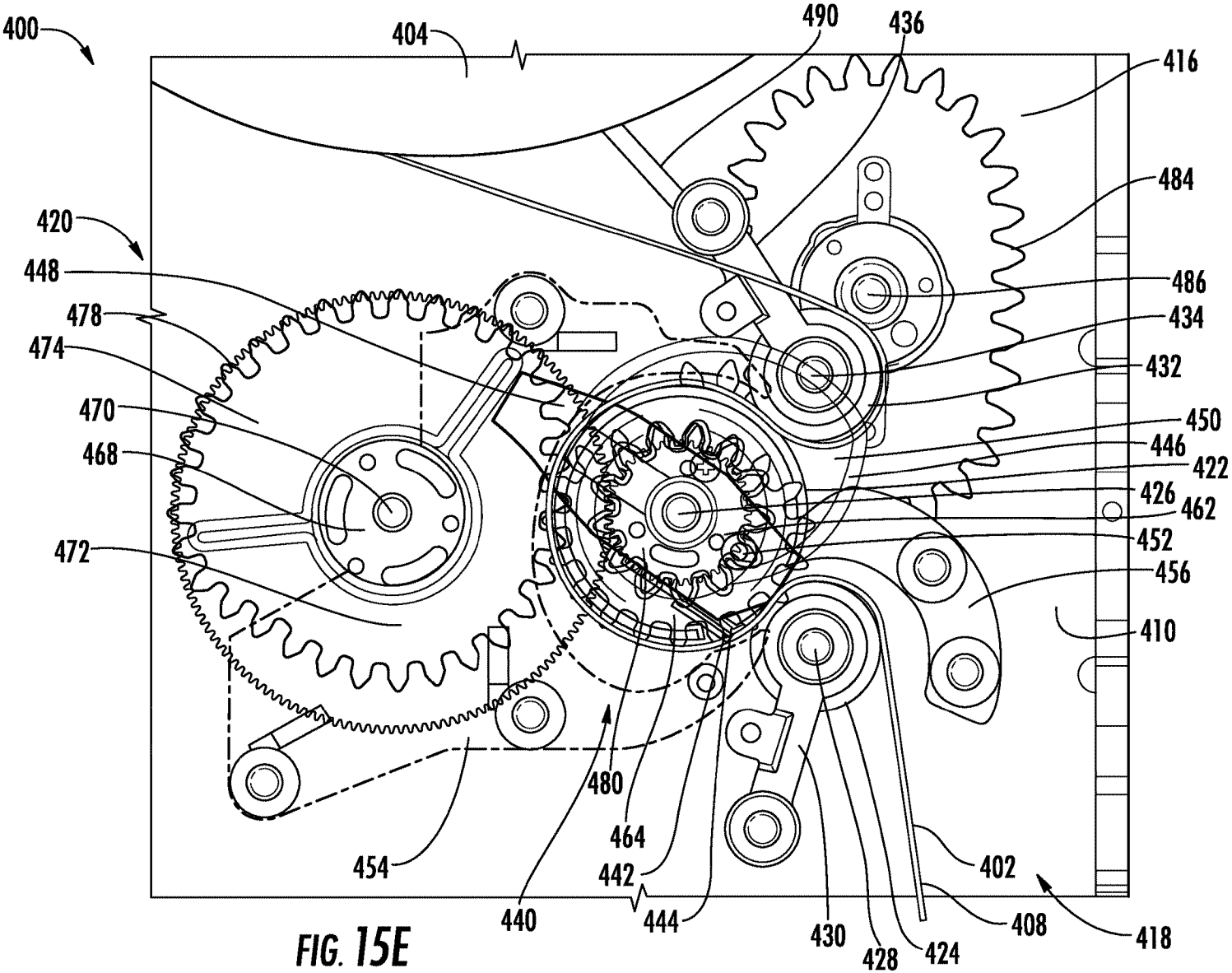
FIG. 15E is a side view of a portion of the example mechanical hands-free sheet product dispenser of FIG. 10, showing the mechanical dispensing mechanism in a fifth state during the dispense cycle.

FIG. 15E shows the mechanical dispensing mechanism 420 in a fifth state of the dispense cycle, following continued pulling of the tail portion 408. In the fifth state, the drum 422 and the first pinch roller 424 continue to engage and grip a portion of the sheet product (a portion of the individual sheet 402) received therebetween, the drum 422 and the second pinch roller 432 continue to engage and grip another portion of the sheet product (a portion of the remainder of the roll 404) received therebetween, and the top, rear side, and bottom of the drum 422 continue to engage yet another portion of the sheet product disposed thereover. As is shown, the drum 422 has further rotated approximately 60 degrees. The cam followers 452 have continued to travel along the cam tracks 450 and move toward the drum axle 426, the sliders 448 have translated further with respect to the drum axle 426, and the cutting knife 442 has moved into the slot 444 to the fully retracted position. As the user continues to pull the tail portion 408, the cam followers 452 continue to travel along the cam tracks 450 but remain at approximately the same position with respect to the drum axle 426, the sliders 448 remain at approximately the same position with respect to the drum axle 426, and the cutting knife 442 remains in the retracted position within the slot 444. In this manner, the cutting knife 442 does not interfere with or contact the first pinch roller 424 as the cutting knife 442 rotates past the first pinch roller 424. As is shown, the fourth non-circular gear 484 has rotated further, while the tail spring 488 has further retracted and released more of the stored energy, thereby reducing the driving force required from the user and facilitating advancement of the sheet product. As the tail spring 488 continues to retract and release more of the stored energy, the drum 422 continues to rotate and advance the sheet product to present a new tail portion 408, as the mechanical dispensing mechanism 420 returns to the first state, as is shown in FIG. 15A, and is ready to begin a subsequent dispense cycle. Ultimately, as the user pulls against the tail spring 488 in the subsequent dispense cycle, the small strips of sheet product connecting the individual sheet 402 to the remainder of the roll 404 are exposed to enough tension to separate the individual sheet 402 from the remainder of the roll 404.

The dispenser 400 may be configured to dispense individual sheets 402 having a predetermined sheet length (i.e., the cutting mechanism 440 cuts the sheet product at a predetermined distance from the exposed end of the roll 404), which may depend on the type of sheet product dispensed. For example, the dispenser 400 may be configured to dispense individual sheets 402 of paper towels having a predetermined sheet length of 8.5 inches. Based on the configuration and operation of the mechanical dispensing mechanism 420, the sheet length may be equal to a sum of a length of the tail portion 408 (a "tail length") and a length over which a user pulls the tail portion 408 (a "pull length") during the dispense cycle. For example, the dispenser 400 may be configured to dispense individual sheets 402 having a sheet length of 8.5 inches, wherein the tail length is 4.25 inches and the pull length is 4.25 inches. It will be understood that the dimensions of the dispenser 400, particularly the mechanical dispensing mechanism 420, and the individual sheets 402 may be selected depending upon the type of sheet product to be dispensed.

The mechanical dispensing mechanism 420 of dispenser 400 may provide significant advantages over mechanical dispensing mechanisms of known hands-free sheet product dispensers. In particular, the various non-circular gears of the mechanical dispensing mechanism 420 may provide significant advantages over conventional circular gears used in known mechanical dispensing mechanisms.

As described above, the first and second non-circular gears 460, 468 may be configured to drive the cams 446 at a varying rate during the dispense cycle. Specifically, the first and second non-circular gears 460, 468 may be configured to drive the cams 446 at substantially the same rate as the drum 422 rotates during a portion of the dispense cycle, and to drive the cams 446 at a higher rate than the drum 422 rotates during another portion of the dispense cycle. As described above, during a portion of the dispense cycle, the first and second non-circular gears 460, 468 are in an orientation in which the first step 462 of the first non-circular gear 460 engages the first step 472 of the second non-circular gear 468. Based on the pitch radii of the first step 462 of the first non-circular gear 460 and the first step 472 of the second non-circular gear 468 (as well as the pitch radii of the first and second transfer gears 478, 480), the cams 446 rotate at substantially the same rate as the drum 422 rotates. During another portion of the dispense cycle, the first and second non-circular gears 460, 468 are in an orientation in which the second step 464 of the first non-circular gear 460 engages the second step 474 of the second non-circular gear 468. Based on the pitch radii of the second step 464 of the first non-circular gear 460 and the second step 474 of the second non-circular gear 468 (as well as the pitch radii of the first and second transfer gears 478, 480), the cams 446 rotate at a higher rate than the drum 422 rotates.

As described above, the third and fourth non-circular gears 482, 484 may be configured to cause the tail spring 488 to extend and store energy during a first portion of the dispense cycle, and to be at least partially driven by the tail spring 488 as the tail spring 488 retracts and releases the stored energy during a second portion of the dispense cycle. In this manner, a portion of the pull force required to carry out the dispense cycle is used to extend the tail spring 488 throughout the first portion of the dispense cycle. As is shown, the third and fourth non-circular gears 482, 484 may have varying radius relationships with respect to one another throughout the dispense cycle. Specifically, in the first state (FIG. 15A), while the tail spring 488 is retracted and at its shortest length, the portion of the third non-circular gear 482 that engages the fourth non-circular gear 484 may have a larger pitch radius than other portions of the third non-circular gear 482. Accordingly, as the user pulls the tail portion 408 and the third and fourth non-circular gears 482, 484 rotate as described above, the fourth non-circular gear 484 rotates at a higher rate than during other states, which causes the tail spring 488 to quickly assume a position where it can extend and store energy. Following continued pulling of the tail portion 408 and rotation of the third non-circular gear 482 (FIG. 15B), the third non-circular gear 482 may have a smaller pitch radius than during the first state, which causes the tail spring 488 to slowly extend and store energy. Following continued pulling of the tail portion 408 and rotation of the third non-circular gear 482 (FIG. 15D), the third non-circular gear 482 again may have a larger pitch radius, which allows the tail spring to quickly assume a position where it can retract and release the stored energy to facilitate advancement of the sheet product. Accordingly, the third and fourth non-circular gears 482, 484 may reduce the pull force required at this point of the dispense cycle. According to different embodiments, the third and fourth non-circular gears 482, 484 may have various radius relationships that affect the peak force required to extend the tail spring 488 and the energy input required to extend the tail spring 488 (and thus also the energy output from the tail spring 488).

Ultimately, as compared to known dispensers, the dispenser 400 may allow a lower pull force (i.e., a driving force imparted by a user) required for a given sheet length and tail length. Additionally, as compared to known dispensers, the dispenser 400 may allow a lower paper strength required for a given sheet length and tail length, due to the lower pull force allowed. Moreover, as compared to known dispensers, the dispenser 400 may generate a greater amount of energy from a given pull force, which may provide greater reliability in presenting a tail portion. Further, as compared to known dispensers, the dispenser 400 may enable use of a smaller drum and thus a smaller housing, as the drum 422 of the mechanical dispensing mechanism 420 completes two rotations during a dispense cycle instead of only one.

The present disclosure thus provides improved hands-free sheet product dispensers and related methods for dispensing individual sheets from a roll of sheet product to address one or more of the potential drawbacks associated with known hands-free sheet product dispensers and methods in certain applications. For example, as compared to known dispensers, the mechanical hands-free sheet product dispensers and methods may provide certain advantages including a lower pull force required for a given sheet length and tail length, a lower paper strength required for a given sheet length and tail length, a greater amount of energy generated from a given pull force, a greater reliability in presenting a tail portion, a reduced size of a mechanical dispensing mechanism and the overall dispenser, mechanical synchronization of a dispense cycle with perforation lines of a roll of perforated sheet product, elimination of a mechanical cutting mechanism, simplification of a mechanical cutting mechanism, and lockout protection. It will be understood that, although the mechanical dispensing mechanisms provided herein are described as being incorporated into mechanical hands-free sheet product dispensers, the mechanical dispensing mechanisms provided alternatively may be incorporated into automated hands-free sheet product dispensers to provide similar advantages.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific exemplary hands-free sheet product dispenser configurations, it will be appreciated that numerous other hands-free sheet product dispenser configurations are within the scope of the disclosure. Conditional language used herein, such as "can," "could," "might," or "may," unless specifically stated otherwise, or otherwise understood within the context as used, generally is intended to convey that certain embodiments could include, while other embodiments do not include, certain features, elements, or functional capabilities. Thus, such conditional language generally is not intended to imply that certain features, elements, or functional capabilities are in any way required for one or more embodiments.

I claim:

1. A sheet product dispenser for dispensing individual sheets from a roll of perforated sheet product, the dispenser comprising:

a housing;

a roll support disposed within the housing and configured to rotatably support the roll of perforated sheet product; and a mechanical dispensing mechanism disposed within the housing and configured to advance the sheet product during each dispense cycle, the dispense cycle comprising (i) dispensing of a first sheet of the roll of perforated sheet product, and (ii) causing a leading portion of a second sheet of the roll of perforated sheet product to extend from the sheet product dispenser, wherein the mechanical dispensing mechanism is further configured to mechanically synchronize the dispense cycle with perforation lines of the sheet product.

2. The sheet product dispenser of claim 1, wherein the mechanical dispensing mechanism comprises a carriage configured to move with respect to the housing during the dispense cycle, wherein the carriage is configured to move downward with respect to the housing during a portion of the dispense cycle and to move upward with respect to the housing during another portion of the dispense cycle.

3. The sheet product dispenser of claim 2, wherein the mechanical dispensing mechanism further comprises a return spring configured to bias the carriage to move upward with respect to the housing.

4. The sheet product dispenser of claim 2, wherein the mechanical dispensing mechanism further comprises:

a crescent roller rotatably supported by the carriage and configured to engage the sheet product, wherein the crescent roller is configured to engage and grip the sheet product during a portion of the dispense cycle and to disengage the sheet product during another portion of the dispense cycle;

a drive roller rotatably supported by the housing, wherein the drive roller is configured to engage and grip the sheet product during a portion of the dispense cycle and to engage but release grip of the sheet product during another portion of the dispense cycle; and a pinch roller rotatably supported by the housing, wherein the drive roller and the pinch roller are configured to receive the sheet product therebetween.

5. The sheet product dispenser of claim 4, wherein the mechanical dispensing mechanism further comprises a plurality of gears configured to drive the drive roller at a varying rate during the dispense cycle.

6. The sheet product dispenser of claim 5, wherein the plurality of gears comprises a pair of non-circular gears respectively positioned about and coupled to a pair of non-circular gear axles supported by the housing, wherein the non-circular gears are configured to drive the drive roller at a varying rate during the dispense cycle, and wherein the non-circular gears are configured to drive the drive roller at a slower rate during a first portion of the dispense cycle and at a faster rate during a second portion of the dispense cycle.

7. The sheet product dispenser of claim 6, wherein the crescent roller is positioned about and coupled to a crescent roller axle supported by the carriage, wherein the plurality of gears comprises a crescent roller gear positioned about and coupled to the crescent roller axle, wherein the crescent roller gear is configured to drive the non-circular gears, and wherein the crescent roller gear is a circular gear.

8. The sheet product dispenser of claim 6, wherein the mechanical dispensing mechanism is further configured to present a tail portion of the roll of perforated sheet product to be grasped and pulled by a user during the dispense cycle, wherein the crescent roller is configured to grip the first sheet of the sheet product and rotate as the user pulls the tail portion, wherein the drive roller is configured to release grip of the first sheet of the sheet product as the user pulls the tail portion, wherein the non-circular gears are configured to drive the drive roller at a higher rate than the tail portion is pulled by the user, and wherein the mechanical dispensing mechanism further comprises a return spring configured to extend and store energy as the user pulls the tail portion.

9. The sheet product dispenser of claim 1, wherein the mechanical dispensing mechanism comprises:

a crescent roller rotatably supported by the housing and configured to engage the sheet product, wherein the crescent roller is configured to engage and grip the sheet product during a portion of the dispense cycle and to disengage the sheet product during another portion of the dispense cycle;

a drive roller rotatably supported by the housing, wherein the drive roller is configured to engage and grip the sheet product throughout the dispense cycle;

a pinch roller rotatably supported by the housing, wherein the drive roller and the pinch roller are configured to receive the sheet product therebetween; and a plurality of gears configured to drive the crescent roller at a varying rate during the dispense cycle.

10. The sheet product dispenser of claim 9, wherein the plurality of gears comprises a pair of non-circular gears configured to drive the crescent roller at a varying rate during the dispense cycle, wherein the non-circular gears are configured to drive the crescent roller at a slower rate during a first portion of the dispense cycle and at a faster rate during a second portion of the dispense cycle.

11. The sheet product dispenser of claim 9, wherein the mechanical dispensing mechanism further comprises:

a tail spring arm rotatably supported by the housing;

a tail spring attached to the tail spring arm and configured to extend and store energy during a portion of the dispense cycle and to retract and release energy during another portion of the dispense cycle; and a plurality of gears configured to drive the tail spring arm during a portion of the dispense cycle and to be driven by the tail spring arm during another portion of the dispense cycle, wherein the plurality of gears comprises a pair of non-circular gears configured to drive the tail spring arm at a varying rate and to be driven by the tail spring arm at a varying rate.

12. A sheet product dispenser for dispensing individual sheets from a roll of perforated sheet product, the dispenser comprising:

a housing;

a roll support disposed within the housing and configured to rotatably support the roll of perforated sheet product; and a mechanical dispensing mechanism disposed within the housing and configured to advance the sheet product during each dispense cycle, the dispense cycle comprising (i) dispensing of a first sheet of the roll of perforated sheet product, and (ii) causing a leading portion of a second sheet of the roll of perforated sheet product to extend from the sheet product dispenser, wherein the mechanical dispensing mechanism comprises:

a crescent roller configured to engage the sheet product;

a drive roller configured to engage the sheet product; and a plurality of gears configured to drive the crescent roller or the drive roller at a varying rate during the dispense cycle responsive to user input force;

wherein the mechanical dispensing mechanism is further configured to mechanically synchronize the dispense cycle with perforation lines of the sheet product.

13. The sheet product dispenser of claim 12, wherein the crescent roller is configured to engage and grip the sheet product during a portion of the dispense cycle and to disengage the sheet product during another portion of the dispense cycle.

14. The sheet product dispenser of claim 12, wherein the drive roller is configured to engage the sheet product throughout the dispense cycle.

15. The sheet product dispenser of claim 12, wherein the plurality of gears comprises a pair of non-circular gears.

16. The sheet product dispenser of claim 12, wherein the plurality of gears is configured to drive the drive roller at a varying rate during the dispense cycle.

17. The sheet product dispenser of claim 12, wherein the mechanical dispensing mechanism further comprises a carriage configured to move with respect to the housing during the dispense cycle, and wherein the carriage is configured to move downward with respect to the housing during a portion of the dispense cycle and to move upward with respect to the housing during another portion of the dispense cycle.

18. The sheet product dispenser of claim 17, wherein the crescent roller is rotatably supported by the carriage, and wherein the drive roller is rotatably supported by the housing.

19. The sheet product dispenser of claim 17, wherein the mechanical dispensing mechanism further comprises a return spring configured to bias the carriage to move upward with respect to the housing.

20. The sheet product dispenser of claim 12, wherein the mechanical dispensing mechanism is further configured to present a tail portion of the roll of perforated sheet product to be grasped and pulled by a user during the dispense cycle, and wherein the plurality of gears is configured to drive the drive roller at a higher rate than the tail portion is pulled by the user.

21. The sheet product dispenser of claim 20, wherein the crescent roller is configured to grip a leading sheet of the sheet product and rotate as the user pulls the tail portion, and wherein the drive roller is configured to release grip of the leading sheet of the sheet product as the user pulls the tail portion.

22. The sheet product dispenser of claim 20, wherein the mechanical dispensing mechanism further comprises a return spring configured to extend and store energy as the user pulls the tail portion.

23. A sheet product dispenser for dispensing individual sheets from a roll of perforated sheet product, the dispenser comprising:

a housing;

a roll support disposed within the housing and configured to rotatably support the roll of perforated sheet product; and a mechanical dispensing mechanism disposed within the housing and configured to advance the sheet product during each dispense cycle, the dispense cycle comprising (i) dispensing of a first sheet of the roll of perforated sheet product, and (ii) causing a leading portion of a second sheet of the roll of perforated sheet product to extend from the sheet product dispenser, wherein the mechanical dispensing mechanism comprises:

a crescent roller configured to engage and grip the sheet product during a portion of the dispense cycle and to disengage the sheet product during another portion of the dispense cycle;

a drive roller configured to engage the sheet product throughout the dispense cycle; and a plurality of gears configured to drive the crescent roller or the drive roller at a varying rate during the dispense cycle responsive to user input force, the plurality of gears comprising a pair of non-circular gears;

wherein the mechanical dispensing mechanism is further configured to mechanically synchronize the dispense cycle with perforation lines of the sheet product.

24. The sheet product dispenser of claim 23, wherein the plurality of gears is configured to drive the drive roller at a varying rate during the dispense cycle.

25. The sheet product dispenser of claim 23, wherein the mechanical dispensing mechanism further comprises a carriage configured to move with respect to the housing during the dispense cycle, and wherein the carriage is configured to move downward with respect to the housing during a portion of the dispense cycle and to move upward with respect to the housing during another portion of the dispense cycle.

26. The sheet product dispenser of claim 25, wherein the crescent roller is rotatably supported by the carriage, and wherein the drive roller is rotatably supported by the housing.

27. The sheet product dispenser of claim 23, wherein the mechanical dispensing mechanism is further configured to present a tail portion of the roll of perforated sheet product to be grasped and pulled by a user during the dispense cycle, and wherein the plurality of gears is configured to drive the drive roller at a higher rate than the tail portion is pulled by the user.

* * * * *